US008177234B2

(12) United States Patent
Nicely

(10) Patent No.: US 8,177,234 B2
(45) **Date of Patent: *May 15, 2012**

(54) ROTOR-BASED GAMING DEVICE HAVING A SYSTEM FOR CHANGING THE QUANTITY OF POTENTIAL GAME OUTCOMES FOR SUBSEQUENT PLAYS

(75) Inventor: Mark C. Nicely, Daly City, CA (US)

(73) Assignee: IGT, Reno, NV (US)

( * ) Notice: Subject to any disclaimer, the term of this patent is extended or adjusted under 35 U.S.C. 154(b) by 91 days.

This patent is subject to a terminal disclaimer.

(21) Appl. No.: 12/731,862

(22) Filed: Mar. 25, 2010

(65) Prior Publication Data

US 2010/0227665 A1 Sep. 9, 2010

Related U.S. Application Data

(63) Continuation of application No. 11/609,149, filed on Dec. 11, 2006, now Pat. No. 7,708,630.

(60) Provisional application No. 60/748,845, filed on Dec. 9, 2005.

(51) Int. Cl.
*A63F 5/00* (2006.01)

(52) U.S. Cl. ..... 273/142 E; 273/274; 463/17

(58) Field of Classification Search ..... 273/142 E, 273/142 R, 142 F, 142 G, 142 H, 142 HA, 273/142 J, 142 JA, 142 JB, 142 JC, 142 JD, 273/274; 463/17

See application file for complete search history.

(56) References Cited

U.S. PATENT DOCUMENTS

| | | | |
|---|---|---|---|
| 1,578,412 | A | 3/1926 | Ewig |
| 3,628,259 | A | 12/1971 | Kahn |
| 3,819,186 | A | 6/1974 | Hinterstocker |
| 4,077,631 | A | 3/1978 | Tela, Sr. |
| 4,156,976 | A | 6/1979 | Mikun |
| 4,198,052 | A | 4/1980 | Gauselmann |
| 4,222,561 | A | 9/1980 | Whitten |
| 4,260,159 | A | 4/1981 | Hoffman |
| 4,337,945 | A | 7/1982 | Levy |
| 4,448,419 | A | 5/1984 | Telnaes |
| 4,621,814 | A | 11/1986 | Stepan et al. |

(Continued)

FOREIGN PATENT DOCUMENTS

AU B-13331/88 9/1988

(Continued)

OTHER PUBLICATIONS

"A Salute to Game Shows," The Price is Right—Pricing Games, printed from schuminweb.com/game-shows/shows/price-is-right/pricing-games.htm on Mar. 16, 2001.

(Continued)

*Primary Examiner* — Benjamin Layno
(74) *Attorney, Agent, or Firm* — K&L Gates LLP

(57) ABSTRACT

A gaming device including a game operable upon one or more wagers. The game is operable for a first play and a second play. Each one of the plays involves a spin of a rotor. The rotor has a plurality of symbols and a plurality of ball landings adjacent to the symbols. A first quantity of the ball landings is available for the first play, and a lower, second quantity of the ball landings is available for the second play. The gaming device also includes an indicator that is operable to indicate information relating to the availability of the second quantity of ball landings.

28 Claims, 34 Drawing Sheets

U.S. PATENT DOCUMENTS

| | | | |
|---|---|---|---|
| 4,624,459 | A | 11/1986 | Kaufman |
| 4,669,731 | A | 6/1987 | Clarke |
| 4,695,053 | A | 9/1987 | Vazquez, Jr. et al. |
| 4,732,386 | A | 3/1988 | Rayfiel |
| 4,805,907 | A | 2/1989 | Hagiwara |
| 4,836,546 | A | 6/1989 | DiRe et al. |
| 4,838,552 | A | 6/1989 | Hagiwara |
| 4,880,237 | A | 11/1989 | Kishita |
| 4,906,005 | A | 3/1990 | Manabe |
| 4,941,665 | A | 7/1990 | Klamer |
| 4,989,878 | A | 2/1991 | Davies |
| 4,991,848 | A | 2/1991 | Greenwood et al. |
| 5,011,159 | A | 4/1991 | Fortunato et al. |
| 5,019,973 | A | 5/1991 | Wilcox et al. |
| 5,046,735 | A | 9/1991 | Hamano et al. |
| 5,085,436 | A | 2/1992 | Bennett |
| 5,088,737 | A | 2/1992 | Frank et al. |
| 5,102,134 | A | 4/1992 | Smyth |
| 5,102,135 | A | 4/1992 | Addiechi |
| 5,116,055 | A | 5/1992 | Tracy |
| 5,123,649 | A | 6/1992 | Tiberio |
| 5,152,529 | A | 10/1992 | Okada |
| 5,167,413 | A | 12/1992 | Fulton |
| 5,184,821 | A | 2/1993 | Korenek |
| 5,197,736 | A | 3/1993 | Backus et al. |
| 5,224,706 | A | 7/1993 | Bridgeman et al. |
| 5,259,616 | A | 11/1993 | Bergmann |
| 5,294,120 | A | 3/1994 | Schultz |
| 5,294,128 | A | 3/1994 | Marquez |
| 5,308,065 | A | 5/1994 | Bridgeman et al. |
| 5,332,228 | A | 7/1994 | Schultz |
| 5,342,047 | A | 8/1994 | Heidel et al. |
| 5,344,144 | A | 9/1994 | Canon |
| 5,356,140 | A | 10/1994 | Dabrowski et al. |
| 5,375,830 | A | 12/1994 | Takemoto et al. |
| 5,377,973 | A | 1/1995 | Jones et al. |
| 5,393,057 | A | 2/1995 | Marnell, II |
| 5,393,061 | A | 2/1995 | Manship et al. |
| 5,395,111 | A | 3/1995 | Inoue |
| 5,397,125 | A | 3/1995 | Adams |
| 5,401,023 | A | 3/1995 | Wood |
| 5,407,200 | A | 4/1995 | Zalabak |
| 5,415,404 | A | 5/1995 | Joshi et al. |
| 5,423,539 | A | 6/1995 | Nagao |
| 5,431,408 | A | 7/1995 | Adams |
| 5,437,452 | A | 8/1995 | Graf et al. |
| 5,449,173 | A | 9/1995 | Thomas et al. |
| 5,456,465 | A | 10/1995 | Durham |
| 5,489,101 | A | 2/1996 | Moody |
| 5,511,781 | A | 4/1996 | Wood et al. |
| 5,531,448 | A | 7/1996 | Moody |
| 5,540,442 | A | 7/1996 | Orselli et al. |
| 5,542,669 | A | 8/1996 | Charron et al. |
| 5,553,851 | A | 9/1996 | Malavazos et al. |
| 5,560,603 | A | 10/1996 | Seelig et al. |
| 5,569,084 | A | 10/1996 | Nicastro et al. |
| 5,570,885 | A | 11/1996 | Ornstein |
| 5,580,055 | A | 12/1996 | Hagiwara |
| 5,584,486 | A | 12/1996 | Franklin |
| 5,584,763 | A | 12/1996 | Kelly et al. |
| 5,584,764 | A | 12/1996 | Inoue |
| 5,588,650 | A | 12/1996 | Eman et al. |
| 5,593,161 | A | 1/1997 | Boylan et al. |
| 5,611,535 | A | 3/1997 | Tiberio |
| 5,636,838 | A | 6/1997 | Caro |
| 5,639,089 | A | 6/1997 | Matsumoto et al. |
| 5,645,485 | A | 7/1997 | Clapper, Jr. |
| 5,647,798 | A | 7/1997 | Falciglia |
| 5,655,961 | A | 8/1997 | Acres et al. |
| 5,678,001 | A | 10/1997 | Nagel et al. |
| 5,707,285 | A | 1/1998 | Place et al. |
| 5,711,715 | A | 1/1998 | Ringo et al. |
| 5,718,431 | A | 2/1998 | Ornstein |
| 5,720,662 | A | 2/1998 | Holmes, Jr. et al. |
| 5,722,891 | A | 3/1998 | Inoue |
| 5,725,428 | A | 3/1998 | Achmuller |
| 5,732,950 | A | 3/1998 | Moody |
| 5,743,798 | A | 4/1998 | Adams et al. |
| 5,755,440 | A | 5/1998 | Sher |
| 5,766,074 | A | 6/1998 | Cannon et al. |
| 5,769,716 | A | 6/1998 | Saffari et al. |
| 5,770,533 | A | 6/1998 | Franchi |
| 5,772,506 | A | 6/1998 | Marks et al. |
| 5,772,509 | A | 6/1998 | Weiss |
| 5,775,692 | A | 7/1998 | Watts et al. |
| 5,788,573 | A | 8/1998 | Baerlocher et al. |
| 5,791,987 | A | 8/1998 | Chen et al. |
| 5,807,172 | A | 9/1998 | Piechowiak |
| 5,810,361 | A | 9/1998 | Kadlic |
| 5,816,916 | A | 10/1998 | Moody |
| 5,816,918 | A | 10/1998 | Kelly et al. |
| 5,817,172 | A | 10/1998 | Yamada et al. |
| 5,823,873 | A | 10/1998 | Moody |
| 5,823,874 | A | 10/1998 | Adams |
| D400,597 | S | 11/1998 | Hedrick et al. |
| 5,833,537 | A | 11/1998 | Barrie |
| 5,836,583 | A | 11/1998 | Towers |
| 5,848,932 | A | 12/1998 | Adams |
| 5,855,514 | A | 1/1999 | Kamille |
| 5,857,909 | A | 1/1999 | Rubin |
| 5,868,619 | A | 2/1999 | Wood et al. |
| 5,876,284 | A | 3/1999 | Acres et al. |
| 5,882,105 | A | 3/1999 | Barlow |
| 5,882,258 | A | 3/1999 | Kelly et al. |
| 5,882,261 | A | 3/1999 | Adams |
| 5,890,962 | A | 4/1999 | Takemoto |
| 5,902,184 | A | 5/1999 | Bennett |
| 5,910,048 | A | 6/1999 | Feinberg |
| 5,911,418 | A | 6/1999 | Adams |
| 5,918,880 | A | 7/1999 | Voigt, IV et al. |
| 5,934,672 | A | 8/1999 | Sines et al. |
| 5,934,999 | A | 8/1999 | Valdez |
| 5,935,002 | A | 8/1999 | Falciglia |
| 5,947,820 | A | 9/1999 | Morro et al. |
| 5,951,397 | A | 9/1999 | Dickinson |
| 5,954,335 | A | 9/1999 | Moody |
| 5,964,463 | A | 10/1999 | Moore, Jr. |
| 5,967,893 | A | 10/1999 | Lawrence et al. |
| 5,971,849 | A | 10/1999 | Falciglia |
| 5,976,016 | A | 11/1999 | Moody et al. |
| 5,980,384 | A | 11/1999 | Barrie |
| 5,984,310 | A | 11/1999 | English |
| 5,984,781 | A | 11/1999 | Sunaga |
| 5,984,782 | A | 11/1999 | Inoue |
| 5,988,638 | A | 11/1999 | Rodesch et al. |
| 5,993,316 | A | 11/1999 | Coyle et al. |
| 5,997,401 | A | 12/1999 | Crawford |
| 6,003,867 | A | 12/1999 | Rodesch et al. |
| 6,004,207 | A | 12/1999 | Wilson, Jr. et al. |
| 6,007,066 | A | 12/1999 | Moody |
| 6,007,424 | A | 12/1999 | Evers et al. |
| 6,012,720 | A | 1/2000 | Webb |
| 6,012,981 | A | 1/2000 | Fujioka et al. |
| 6,012,982 | A | 1/2000 | Piechowiak et al. |
| 6,012,983 | A | 1/2000 | Walker et al. |
| 6,032,955 | A | 3/2000 | Luciano et al. |
| 6,033,307 | A | 3/2000 | Vancura |
| 6,053,823 | A | 4/2000 | Mathews |
| 6,056,642 | A | 5/2000 | Bennett |
| 6,059,289 | A | 5/2000 | Vancura |
| 6,059,658 | A | 5/2000 | Mangano et al. |
| 6,059,659 | A | 5/2000 | Busch et al. |
| 6,062,980 | A | 5/2000 | Luciano |
| 6,062,981 | A | 5/2000 | Luciano, Jr. |
| 6,071,192 | A | 6/2000 | Weiss |
| 6,083,105 | A | 7/2000 | Ronin et al. |
| 6,089,977 | A | 7/2000 | Bennett |
| 6,089,978 | A | 7/2000 | Adams |
| 6,089,980 | A | 7/2000 | Gauselmann |
| 6,093,101 | A | 7/2000 | Mourad |
| 6,093,102 | A | 7/2000 | Bennett |
| 6,098,985 | A | 8/2000 | Moody |
| 6,102,400 | A | 8/2000 | Scott et al. |
| 6,102,402 | A | 8/2000 | Scott et al. |
| 6,102,798 | A | 8/2000 | Bennett |
| 6,105,962 | A | 8/2000 | Malavazos et al. |
| 6,110,041 | A | 8/2000 | Walker et al. |

6,113,098 A 9/2000 Adams
6,120,031 A 9/2000 Adams
6,120,378 A 9/2000 Moody et al.
6,126,165 A 10/2000 Sakamoto
6,126,541 A 10/2000 Fuchs
6,126,542 A 10/2000 Fier
6,129,632 A 10/2000 Luciano
6,132,311 A 10/2000 Williams
6,135,884 A 10/2000 Hedrick et al.
6,142,872 A 11/2000 Walker et al.
6,142,873 A 11/2000 Weiss et al.
6,142,874 A 11/2000 Kodachi et al.
6,142,875 A 11/2000 Kodachi et al.
6,149,521 A 11/2000 Sanduski
6,155,925 A 12/2000 Giobbi et al.
6,158,741 A 12/2000 Koelling
6,159,095 A 12/2000 Frohm et al.
6,159,096 A 12/2000 Yoseloff
6,159,097 A 12/2000 Gura
6,159,098 A 12/2000 Slomiany et al.
6,162,121 A 12/2000 Morro et al.
6,168,520 B1 1/2001 Baerlocher et al.
6,168,522 B1 1/2001 Walker et al.
6,168,523 B1 1/2001 Piechowiak et al.
6,173,955 B1 1/2001 Perrie et al.
6,174,233 B1 1/2001 Sunaga et al.
6,174,235 B1 1/2001 Walker et al.
6,179,711 B1 1/2001 Yoseloff
6,186,894 B1 2/2001 Mayeroff
6,190,254 B1 2/2001 Bennett
6,190,255 B1 2/2001 Thomas et al.
6,193,606 B1 2/2001 Walker et al.
6,196,547 B1 3/2001 Pascal et al.
6,203,429 B1 3/2001 Demar et al.
6,209,869 B1 4/2001 Mathews
6,210,277 B1 4/2001 Stefan
6,217,022 B1 4/2001 Astaneha
6,217,448 B1 4/2001 Olsen
6,220,959 B1 4/2001 Holmes, Jr. et al.
6,224,482 B1 5/2001 Bennett
6,224,483 B1 5/2001 Mayeroff
6,224,484 B1 5/2001 Okuda et al.
6,227,542 B1 5/2001 Cosmi
6,227,969 B1 5/2001 Yoseloff
6,227,971 B1 5/2001 Weiss
6,231,442 B1 5/2001 Mayeroff
6,231,445 B1 5/2001 Acres
6,234,897 B1 5/2001 Frohm et al.
6,238,287 B1 5/2001 Komori et al.
6,244,957 B1 6/2001 Walker et al.
6,251,013 B1 6/2001 Bennett
6,254,482 B1 7/2001 Walker et al.
6,264,200 B1 7/2001 Smith
6,270,409 B1 8/2001 Shuster
6,270,411 B1 8/2001 Gura et al.
6,270,412 B1 8/2001 Crawford et al.
6,290,600 B1 9/2001 Glasson
6,299,165 B1 10/2001 Nagano
6,299,170 B1 10/2001 Yoseloff
6,302,398 B1 10/2001 Vecchio
6,302,790 B1 10/2001 Brossard
6,302,791 B1 10/2001 Frohm et al.
6,305,686 B1 10/2001 Perrie et al.
6,309,299 B1 10/2001 Weiss
6,311,976 B1 11/2001 Yoseloff et al.
6,312,331 B1 11/2001 Tamaki
6,312,334 B1 11/2001 Yoseloff
6,315,660 B1 11/2001 DeMar et al.
6,315,662 B1 11/2001 Jorasch et al.
6,315,663 B1 11/2001 Sakamoto
6,319,124 B1 11/2001 Baerlocher et al.
6,322,078 B1 11/2001 Adams
6,336,860 B1 1/2002 Webb
6,336,862 B1 1/2002 Byrne
6,336,863 B1 1/2002 Baerlocher et al.
6,340,158 B2 1/2002 Pierce et al.
6,352,260 B1 3/2002 Santiago
6,358,144 B1 3/2002 Kaddlic et al.
6,358,147 B1 3/2002 Jaffe et al.
6,364,314 B1 4/2002 Canterbury
6,364,766 B1 4/2002 Anderson et al.
6,364,768 B1 4/2002 Acres et al.
6,368,214 B1 4/2002 Luciano
6,375,569 B1 4/2002 Acres
6,375,570 B1 4/2002 Poole
6,394,902 B1 5/2002 Glavich et al.
6,398,218 B1 6/2002 Vancura
6,398,220 B1 6/2002 Inoue
6,398,644 B1 6/2002 Perrie et al.
6,409,602 B1 6/2002 Wiltshire et al.
6,413,162 B1 7/2002 Baerlocher et al.
6,413,163 B1 7/2002 Yamauchi et al.
6,419,579 B1 7/2002 Bennett
6,428,412 B1 8/2002 Anderson et al.
6,435,968 B1 8/2002 Torango
6,439,943 B1 8/2002 Aoki et al.
6,439,993 B1 8/2002 O'Halloran
6,439,995 B1 8/2002 Hughs-Baird et al.
6,443,452 B1 9/2002 Brune
6,443,456 B1 9/2002 Gajor
6,450,884 B1 9/2002 Seelig et al.
6,454,266 B1 9/2002 Breeding et al.
6,461,241 B1 10/2002 Webb et al.
6,467,770 B1 * 10/2002 Matosevic ..... 273/274
6,471,208 B2 10/2002 Yoseloff et al.
6,481,713 B2 11/2002 Perrie et al.
6,491,584 B2 12/2002 Graham et al.
6,494,454 B2 12/2002 Adams
6,497,409 B2 12/2002 Mathews
6,517,432 B1 2/2003 Jaffe
6,520,503 B1 2/2003 Porto
6,520,854 B1 2/2003 McNally
6,537,150 B1 3/2003 Luciano et al.
6,537,152 B2 3/2003 Seelig et al.
6,551,187 B1 4/2003 Jaffe
6,561,512 B2 5/2003 Luciano et al.
6,561,904 B2 5/2003 Locke et al.
6,565,436 B1 5/2003 Baerlocher
6,569,013 B1 5/2003 Taylor
6,575,834 B1 6/2003 Lindo
6,599,185 B1 7/2003 Kaminkow et al.
6,599,193 B2 7/2003 Baerlocher et al.
6,602,136 B1 8/2003 Baerlocher et al.
6,602,137 B2 8/2003 Kaminkow et al.
6,604,740 B1 8/2003 Singer et al.
6,609,969 B1 8/2003 Luciano et al.
6,609,970 B1 8/2003 Luciano, Jr.
6,612,927 B1 9/2003 Slomiany et al.
6,616,142 B2 9/2003 Adams
6,632,139 B1 10/2003 Baerlocher
6,632,140 B2 10/2003 Berman et al.
6,634,942 B2 10/2003 Walker et al.
6,634,945 B2 10/2003 Glavich et al.
6,652,378 B2 11/2003 Cannon et al.
6,656,043 B2 12/2003 Seelig et al.
6,659,462 B1 12/2003 Scott
6,663,106 B1 12/2003 Cosmi
6,682,073 B2 1/2004 Bryant et al.
6,695,696 B1 2/2004 Kaminkow
6,712,693 B1 3/2004 Hettinger
6,712,694 B1 3/2004 Nordman
6,712,695 B2 3/2004 Mothwurf et al.
6,726,563 B1 4/2004 Baerlocher et al.
6,733,389 B2 5/2004 Webb et al.
6,739,970 B2 5/2004 Luciano
6,758,749 B2 7/2004 Krintzman
6,764,396 B2 7/2004 Seelig et al.
6,776,711 B1 8/2004 Baerlocher
6,780,105 B1 8/2004 Kaminkow
6,786,824 B2 9/2004 Cannon
6,802,778 B1 10/2004 Lemay et al.
6,805,349 B2 10/2004 Baerlocher et al.
6,811,483 B1 11/2004 Webb et al.
6,857,957 B2 2/2005 Marks et al.
6,869,359 B1 3/2005 Mathews
6,869,360 B2 3/2005 Marks et al.
6,878,061 B2 4/2005 Baerlocher
6,884,167 B2 4/2005 Walker et al.

6,890,255 B2 5/2005 Jarvis et al.
6,890,257 B2 5/2005 Baerlocher
6,899,620 B2 5/2005 Kaminkow et al.
6,905,406 B2 6/2005 Kaminkow et al.
6,908,383 B2 6/2005 Baerlocher et al.
6,913,532 B2 7/2005 Baerlocher et al.
6,921,072 B2 7/2005 Hughes-Watts
6,921,335 B2 7/2005 Rodgers et al.
6,923,720 B2 8/2005 Loose
6,926,607 B2 8/2005 Slomiany et al.
6,929,952 B2 8/2005 Baerlocher
6,955,600 B2 10/2005 Glavich et al.
6,960,133 B1 11/2005 Marks et al.
6,988,731 B2 1/2006 Inoue
6,991,544 B2 1/2006 Soltys et al.
7,001,274 B2 2/2006 Baerlocher et al.
7,008,324 B1 3/2006 Johnson et al.
7,014,560 B2 3/2006 Glavich et al.
7,029,395 B1 4/2006 Baerlocher
7,052,395 B2 5/2006 Glavich et al.
7,066,814 B2 6/2006 Glavich et al.
7,094,150 B2 8/2006 Ungaro et al.
7,121,943 B2 10/2006 Webb et al.
7,204,488 B2 4/2007 Ilievski
RE39,659 E 5/2007 Luciano et al.
7,216,867 B1 5/2007 Luciano et al.
2001/0003709 A1 6/2001 Adams
2001/0005690 A1 6/2001 Boulton
2001/0009865 A1 7/2001 Demar et al.
2001/0015525 A1 8/2001 Mathews
2001/0018361 A1 8/2001 Acres
2001/0022429 A1 9/2001 Luciano et al.
2001/0023199 A1 9/2001 Walker et al.
2001/0038178 A1 11/2001 Vancura
2002/0010017 A1 1/2002 Bennett
2002/0052233 A1 5/2002 Gauselmann
2002/0086725 A1 7/2002 Fasbender et al.
2002/0137559 A1 9/2002 Baerlocher
2002/0165023 A1 11/2002 Brosnan et al.
2002/0167126 A1 11/2002 Herman De Raedt et al.
2002/0169017 A1* 11/2002 Visoenik ..... 463/17
2002/0187827 A1 12/2002 Blankstein
2002/0193160 A1 12/2002 Tarantino
2003/0027623 A1 2/2003 Rose
2003/0050110 A1 3/2003 Wichinsky
2003/0054873 A1 3/2003 Peterson
2003/0060266 A1 3/2003 Baerlocher
2003/0060269 A1 3/2003 Paulsen et al.
2003/0060272 A1 3/2003 Glavich et al.
2003/0060281 A1 3/2003 Vancura
2003/0069062 A1 4/2003 Shimizu
2003/0069063 A1 4/2003 Bilyeu et al.
2003/0073483 A1 4/2003 Glavich et al.
2003/0092480 A1 5/2003 White et al.
2003/0092490 A1 5/2003 Gauselmann
2003/0094752 A1 5/2003 Mathews
2003/0098543 A1 5/2003 Porto
2003/0153383 A1 8/2003 Baerlocher et al.
2003/0155708 A1 8/2003 Perrie et al.
2003/0162585 A1 8/2003 Bigelow et al.
2003/0195031 A1 10/2003 O'Donovan et al.
2003/0203753 A1 10/2003 Muir et al.
2003/0207713 A1 11/2003 Taylor
2003/0216165 A1 11/2003 Singer et al.
2003/0232651 A1 12/2003 Huard et al.
2004/0002372 A1 1/2004 Rodgers et al.
2004/0017043 A1 1/2004 Moody
2004/0038731 A1 2/2004 Englman
2004/0048650 A1 3/2004 Mierau et al.
2004/0048652 A1 3/2004 Ching et al.
2004/0053666 A1 3/2004 Vancura
2004/0053669 A1 3/2004 Gerrard et al.
2004/0053672 A1 3/2004 Baerlocher
2004/0061285 A1 4/2004 Hughes-Watts
2004/0063493 A1 4/2004 Baerlocher
2004/0072609 A1 4/2004 Ungaro et al.
2004/0072612 A1 4/2004 Rodgers et al.
2004/0077398 A1 4/2004 Jarvis et al.
2004/0102244 A1 5/2004 Kryuchkov et al.
2004/0116177 A1 6/2004 Frost et al.
2004/0137982 A1 7/2004 Cuddy et al.
2004/0147306 A1 7/2004 Randall et al.
2004/0152500 A1 8/2004 Baerlocher
2004/0159590 A1 8/2004 Mothwurf
2004/0162129 A1 8/2004 Nelson
2004/0176156 A1 9/2004 Walker et al.
2004/0212150 A1 10/2004 Huard et al.
2004/0219969 A1 11/2004 Casey et al.
2004/0242302 A1 12/2004 Baerlocher
2004/0242315 A1 12/2004 Paulsen et al.
2004/0251624 A1 12/2004 Hodapp et al.
2004/0254011 A1 12/2004 Muskin
2004/0256804 A1 12/2004 Huard et al.
2004/0266510 A1 12/2004 Kojima
2004/0266512 A1 12/2004 Kaminkow
2004/0266516 A1 12/2004 Thomas
2004/0266517 A1 12/2004 Bleich et al.
2005/0014550 A1 1/2005 Rhoten
2005/0020346 A1 1/2005 Baerlocher
2005/0029745 A1 2/2005 Walker et al.
2005/0037838 A1 2/2005 Dunaevsky et al.
2005/0049035 A1 3/2005 Baerlocher et al.
2005/0054429 A1 3/2005 Baerlocher et al.
2005/0059481 A1 3/2005 Joshi et al.
2005/0060050 A1 3/2005 Baerlocher
2005/0070354 A1 3/2005 Baerlocher et al.
2005/0075163 A1 4/2005 Cuddy et al.
2005/0079911 A1 4/2005 Nakatsu
2005/0090306 A1 4/2005 Seelig et al.
2005/0130737 A1 6/2005 Englman et al.
2005/0176494 A1 8/2005 Thomas
2005/0192076 A1 9/2005 Lowery
2005/0192079 A1 9/2005 Lowery
2005/0215307 A1 9/2005 Jarvis et al.
2005/0215311 A1 9/2005 Hornik et al.
2005/0218590 A1 10/2005 O'Halloran et al.
2005/0233796 A1 10/2005 Baerlocher et al.
2005/0233801 A1 10/2005 Baerlocher et al.
2005/0233803 A1 10/2005 Yang
2005/0253333 A1* 11/2005 Boulton ..... 273/138.1
2005/0255904 A1 11/2005 Duhamel
2005/0282615 A1 12/2005 Englman et al.
2005/0282629 A1 12/2005 Gagner
2005/0285336 A1 12/2005 Ilievski
2005/0285337 A1 12/2005 Durham et al.
2006/0003834 A1 1/2006 Okada
2006/0009283 A1 1/2006 Englman et al.
2006/0009286 A1 1/2006 Durham et al.
2006/0014580 A1 1/2006 Hawthorn
2006/0019744 A1 1/2006 Roemer
2006/0025193 A1 2/2006 Gail et al.
2006/0025211 A1 2/2006 Wilday et al.
2006/0046833 A1 3/2006 Hatakeyama et al.
2006/0066044 A1 3/2006 Dabosh
2006/0069619 A1 3/2006 Walker et al.
2006/0073873 A1 4/2006 Rodgers et al.
2006/0073897 A1 4/2006 Englman et al.
2006/0094495 A1 5/2006 Gelber et al.
2006/0157927 A1 7/2006 O'Halloran et al.
2006/0157928 A1 7/2006 O'Halloran
2006/0170154 A1 8/2006 Matsuno et al.
2006/0170155 A1 8/2006 Silverman
2006/0178191 A1 8/2006 Ellis
2006/0205480 A1 9/2006 Glavich et al.
2006/0217174 A1 9/2006 Walker et al.
2006/0237905 A1 10/2006 Nicely et al.
2006/0246989 A1 11/2006 Glavich et al.
2006/0249899 A1 11/2006 Lease
2006/0287034 A1 12/2006 Englman et al.
2006/0287053 A1 12/2006 Yokota
2007/0021182 A1 1/2007 Gauselmann
2007/0057452 A1 3/2007 Dargue
2007/0060262 A1 3/2007 Kosaka et al.
2007/0060292 A1 3/2007 Peterson
2007/0069459 A1 3/2007 Guindulain Vidondo
2007/0075488 A1 4/2007 Pececnik
2007/0135204 A1 6/2007 Nicely
2007/0265057 A1* 11/2007 Yoshizawa ..... 463/17

FOREIGN PATENT DOCUMENTS

| | | | |
|---|---|---|---|
| AU | PO7780 | | 7/1997 |
| AU | 199717601 | B2 | 9/1997 |
| AU | 199917318 | A1 | 9/1999 |
| AU | 200245837 | | 12/2002 |
| DE | 3 105 266 | | 9/1982 |
| DE | 3 716 849 | | 12/1988 |
| EP | 60 019 | A1 | 9/1982 |
| EP | 0 558 307 | A2 | 2/1993 |
| EP | 0 753 331 | A2 | 1/1997 |
| EP | 0 874 337 | A1 | 10/1998 |
| EP | 0 926 642 | A2 | 6/1999 |
| EP | 0 926 645 | A2 | 6/1999 |
| EP | 0 945 837 | A2 | 9/1999 |
| EP | 0 981 119 | A2 | 2/2000 |
| EP | 0 984 407 | A2 | 3/2000 |
| EP | 0 984 408 | A2 | 3/2000 |
| EP | 0 989 531 | A2 | 3/2000 |
| EP | 1 076 321 | A1 | 2/2001 |
| EP | 1 195 730 | A2 | 4/2002 |
| EP | 1 226 851 | | 7/2002 |
| EP | 1 536 388 | A1 | 1/2005 |
| EP | 1 513 114 | A2 | 3/2005 |
| EP | 1 513 116 | A2 | 3/2005 |
| EP | 1 513 117 | A2 | 3/2005 |
| EP | 1 580 701 | A1 | 3/2005 |
| EP | 1 589 501 | A1 | 10/2005 |
| EP | 1 671 684 | | 6/2006 |
| EP | 1 710 000 | | 10/2006 |
| EP | 1 721 642 | | 11/2006 |
| EP | 1 736 215 | | 12/2006 |
| EP | 1 769 828 | | 4/2007 |
| GB | 970806 | | 9/1964 |
| GB | 2 101 380 | A | 1/1983 |
| GB | 2 137 392 | A | 10/1984 |
| GB | 2 262 642 | A | 6/1993 |
| GB | 2 292 245 | | 2/1996 |
| GB | 2 371 494 | | 8/1997 |
| GB | 2 322 217 | A | 8/1998 |
| GB | 2 354 179 | | 3/2001 |
| GB | 2 358 591 | | 8/2001 |
| GB | 2 382 911 | | 6/2003 |
| GB | 2 387 950 | A | 10/2003 |
| GB | 2 395 139 | | 5/2004 |
| GB | 2 431 362 | | 4/2007 |
| WO | WO 85/00910 | | 2/1985 |
| WO | WO 97 32285 | | 9/1997 |
| WO | WO 97/38766 | | 10/1997 |
| WO | WO 98/00207 | | 1/1998 |
| WO | WO 99/03078 | | 1/1999 |
| WO | WO 00/32286 | | 6/2000 |
| WO | WO 00/33269 | | 6/2000 |
| WO | WO 00/66235 | | 11/2000 |
| WO | WO 00/76606 | A1 | 12/2000 |
| WO | WO 01/26019 | A1 | 4/2001 |
| WO | WO 02/056984 | | 7/2002 |
| WO | WO 02/078804 | | 10/2002 |
| WO | WO 03/026757 | | 4/2003 |
| WO | WO 2004/023400 | A1 | 3/2004 |
| WO | WO 2004/025584 | | 3/2004 |
| WO | WO 2005/077480 | | 8/2005 |
| WO | WO 2005/083599 | | 9/2005 |
| WO | WO 2006/015442 | | 2/2006 |
| WO | WO 2006/017431 | | 2/2006 |
| WO | WO 2006/061616 | | 6/2006 |
| WO | WO 2006/078219 | | 6/2006 |
| WO | WO 2006/094398 | | 10/2006 |
| WO | WO 2006/097007 | | 11/2006 |
| WO | WO 2007/024202 | | 3/2007 |
| WO | WO 2007/033430 | | 3/2007 |
| WO | WO 2007/077449 | A1 | 7/2007 |
| WO | WO 2007/080421 | | 7/2007 |

OTHER PUBLICATIONS

3RV—Jackpot Party Advertisement written by WMS Gaming, Inc., published Aug. 8, 2002.
Alfastreet D8 description, Alfa street Gaming Instruments, available on or before Nov. 13, 2006.
Alfastreet M8 description, Alfa street Gaming Instruments, available on or before Nov. 13, 2006.
American Bandstand Brochure written by Anchor Games, published in 2001.
Animator, [online] [printed on Nov. 8, 2006]. Retrieved from the Internet at <URL:http://www.tcsjohnhuxley.com.au/products/displays/animator.htm>.
Big Times Red, White & Blue Advertisement written by IGT published in 2005.
Black Swan Paytable Display written by IGT, published prior to 2001.
Blurring the Green-Felt Line, written by International Gaming & Wagering Business, published in Jan. 2003.
Bonus Games Advertisement written by IGT, published in 1999.
Bonus Roulette Brochure written by R. Franco, available prior to Sep. 25, 2006.
Boot Scootin Article written by Strictly Slots/Aristocrat Leisure Industries, PTY Ltd., published prior to Jul. 2002.
Break the Spell Advertisement written by Atronic Casino Technology, Ltd., published in 1999.
Break the Spell Article written by Strictly Slots/Atronic Casino Technology, Ltd., published in Sep. 2000.
Break the Spell Atronic Web Page, published in Jan. 2001.
Buck's Roulette Brochure written by R. Franco, available prior to Sep. 25, 2006.
Bunco History and Rules, printed from http://world-bunco.com/history.html on May 22, 2000.
Cash Chameleon Article written by Strictly Slots/Aristocrat Leisure Industries, PTY Ltd., published in Apr. 2001.
Catch A Wave Advertisement written by IGT, published in Dec. 2000.
Classic Pot of Gold Brochure written by Ace Coin Equipment Ltd., available prior to Nov. 10, 2006.
Cossack Dancer Advertisement written by Olympic Video Gaming, published prior to 2002.
Creepy and Kooky written by Frank Legato, published by Strictly Slots in Jul. 2000, pp. 52-54.
Cyberdyne Gaming Brochure written by Cyberdyne Gaming, available prior to Nov. 10, 2006.
Description of Symbol Feature in Australian UFO Gaming Machine written by Barcrest Ltd., published in 1995.
Doc. 03-191, Elvis Brochure written by IGT, published in 1999.
Dolphin Treasure Advertisement written by Aristocrat Leisure Industries Pty., Ltd., published in 1996.
Double Diamond Line Advertisement written by Bally Gaming Systems, published in 2000.
Double Roulette Wheel Excerpt, Loose Change Magazine, Oct. 1993, p. 26.
e-FX Roulette Display, [online] [printed on Nov. 8, 2006]. Retrieved from the Internet at <URL: file://C:\DOCUME~-1\rys\LOCALS~1\Temp\S4M2B8E0.htm>.
Elvis Hits Advertisement written by IGT, published in 1999.
Enchanted Forest™ Gaming Description from Aristocrat, available in 1994.
Enchanted Unicorn Advertisement written by IGT, published in 2001.
European Search Report from EP Patent Application EP 03 813 403.7.
Family Feud Bullseye advertisement, printed from www.igtonline.com/megajackpots/new_games/family_feud_bullseye_slots.html on Mar. 2, 2005 and available in 2003.
Field Testing New Slots Article, written by Strictly Slots, published in Jul. 2000.
Fishin' Buddies Article published in Strictly Slots/Anchor Games, published in Apr. 2001.
Frog Prince article written by International Game Technology, published in 2001.
Fully Automated Wheel, [online] [printed on Nov. 1, 2006]. Retrieved from the Internet at <URL:http://www.nrcgamingsystems.com/our_products.asp>.
Happy Camper Adveertisement written by IGT, published in 2001.
International Search Report in Corresponding European Application EP 07120368, Mailed Jun. 11, 2008.

Introducing the "Smiling Ape" Machine Advertisement (including Joker's Wild Poker description) written by IGT, published prior to 2001.
Jackpot Party Advertisement on website page http://www.wmsgaming.com/products/slot/jpp/index.html, printed on Mar. 21, 2001.
Jackpot Party Brochures and Articles written by WMS Gaming, Inc., published in Mar. 1998.
Jackpot Party Video 9-Line Advertisement written by WMS Gaming, Inc., available prior to Feb. 23, 2004.
Jeopardy Advertisement written by IGT, published in 2000.
Jeopardy Video Slots advertisement written by IGT, published in 2000.
Jeopardy, MegaJackpots Advertisement written by IGT, published in 1998.
Joker's Wild Advertisement written by IGT, published prior to 2001.
Letter from Mr. McClarnon regarding disclosure of U.S. Patent No. 6,409,602;dated May 10, 2008.
Little Devils Brochure, written by IGT, published in 1998.
Little Green Men, Jr. Advertisement written by A.C. Coin and Slot Services Company, published prior to 2002.
Live Random Dice Machines, written by General Automatic Amusement, available prior to Nov. 10, 2006.
Loco Loot Article written by Strictly Slots/Aristocrat Leisure Industries, PTY Ltd., published in May 2002.
Lucky Dolls, written by Strictly Slots, published in May 2002.
LuminAR (Illuminated Roulette), [online] [printed on Oct. 31, 2006]. Retrieved from the Internet at <URL:http://www.tcsjohnhuxley.com.au/products/roulette/luminar.htm>.
Mark VII Wheel, [online] [printed on Oct. 31, 2006]. Retrieved from the Internet at <URL:http://www.tcsjohnhuxley.com.au/products/roulette/roulettewheels/markvii.html>.
Mauritian Roulette from Ultimate Success Gaming, [online] [printed on Oct. 31, 2006]. Retrieved from the Internet at <URL:http://www.gamingfloor.com/features/usg/MagicR.htm>.
Megaster Family description, Aristocrat Technologies, Inc., available on or before Nov. 13, 2006.
Mistress of the Dark™ Advertisement written by IGT, published in 2002.
Monopoly Blackjack Edition Game described in Mikohn brochure, published in 2000.
Monte Carlo advertisement, written by Bally Gaming, Inc., published in 2002.
Mountain Money Article written by Strictly Slots/Aristocrat Leisure Industries, PTY Ltd., published in Jun. 2002.
Multi-Action Blackjack brochure, http://conjelco.com/faq/bj.html from Apr. 25, 2001, printed on Jul. 30, 2001.
Multi-Play Poker by Bally Gaming, described in Strictly Slots, published in Dec. 2000.
Multi-Play Poker by Bally Gaming, printed from ballygaming.com/products/multi-play-poker.html on Apr. 25, 2001.
Odds on Gaming™, Inc. brochure, published by Odds on Gaming, available prior to Nov. 10, 2006.
On the House Advertisement written by Olympic Video Gaming, published prior to 2002.
Penguin Pays Advertisement written by Aristocrat Incorporated, published in 1998.
Pick a Prize Brochure written by Acres Gaming Incorporated, published prior 2001.
Play It Again Poker Brochure, written by IGT, published in 1999.
Power Slotto Brochure published by AC Coin & Slot in or before Dec. 2002.
R&B™ Brochure published by AC Coin & Slot, available prior to Sep. 25, 2006.
Rapid Roulette written by ShuffleMaster™ Incorporated in 2005, in or before December thereof.
Rapid Roulette™ written by John Huxley Ltd., published in 2002.
REEL MAGIC™ Gaming Machine Description written by IGT, available in 1986.
Roulette Grand Jeu brochure, written by Amatic Industries, available prior to Nov. 10, 2006.
Roulette Wheel Analysis, [online] [printed on Oct. 31, 2006]. Retrieved from the Internet at <URL:http://www.tcsjohnhuxley.com.au/products/roulette/roulettewheelanalysis.htm>.
Roulette Wheels catalog, published by Gaming partners International SAS, available prior to Nov. 10, 2006.
Roulette written by Atronic Casino Technology, published in 1999.
Royal Roulette advertisement written by Barcrest Games, available prior to Sep. 25, 2006.
Royal Roulette Brochure written by Impulse Gaming Ltd., available prior to Nov. 10, 2006.
Saturn Data Logger, [online] [printed on Oct. 31, 2006]. Retrieved from the Internet at <URL:http://www.tcsjohnhuxley.com.au/products/roulette/santurndatalogger.htm>.
Saturn Wheel, [online] [Printed on Oct. 31, 2006]. retrieved from the Internet at <URL:http://www.tcsjohnhuxley.com.au/products/roulettewheels/saturn.htm>.
Silver City Roundup Brochure published by AC Coin & Slot, available prior to Sep. 25, 2006.
Slot Machine Buyer's Handbook, A Consumer's Guide to Slot Machines written by David L. Saul and Daniel R. Mead, published in 1998.
Slot Machines and Coin-Op Games written by Bill Kurtz, published in 1997.
Slot Machines Article, written by Marshall Fey, published by Reno-Tahoe Specialty, Inc., in 1989.
Slot Machines on Parade, 1st edition written by Robert N. Geddes and illustrated by Daniel R. Mead, published in 1980.
Slot Machines written by Marshall Fey, published in 1983, 1989, 1991, 1994, 1997.
Slot Machines, A Pictorial History of the First 100 Years, written by Marshall Fey, published by Liberty Belle Books, 1983 1989, 1991, 1994, 1997.
Slotopoly Brochure, written by IGT, published in 1998.
Slots 2003 Article written by Melissa Raimondi, published in Jan. 2003.
Spin Til You Win Game Description written by IGT, published in 1996.
Starburst Wheel, [online] [printed on Oct. 31, 2006]. Retrieved from the Internet at <URL:http://www.tcsjohnhuxley.com.au/products/roulette/roulettewheels/starburst.htm>.
Super Bonus Poker by Bally Gaming, described in Strictly Slots, published in Apr. 2000.
Super Times Pay Poker Advertisement, written by IGT, published in 2003.
Sure to Beat the Bank, article located on the web at http://query.nytimes.com/mem/archive-free/pdf?r=1 &res=9501E3DB1E3EEF33A25755C2A9679C94679FD7CF &oref=slogin, The New York Times, published Jan. 1886.
Take Your Pick Article written by Strictly Slots, published in Mar. 2001.
Technique of Victory, written by Odrex, available prior to Nov. 10, 2006.
The Basics of Winning Video Poker (Chapter VI Deuces Wild & Chapter VII Jokers Wild) written by J. Edward Allen, published in 1990.
The Latest Buzz Article written by Bally Gaming Systems, published in Fall 2000.
Top Dollar Brochure, written by IGT, published in 1998.
Totem Pole Brochure, written by IGT, published in 1997.
Tropical Fever Glass, written by IGT, published prior to Apr. 2001.
Turboreel by Barcrest (with English Translation), available in 2005.
We Make Gaming Fun! Advertisement written by WMS Gaming Inc., available prior to Feb. 23, 2004.
Wheel of Fortune Special Edition Classic Spin Video Slots, written by IGT, published before Sep. 30, 2004.
Wheel of Fortune Video advertisement, published by IGT in 1999.
Wheel of Fortune Video Slots advertisement, published by IGT in 2002.
Wheel of Madness Game, described in AC Coin & Slot brochure, published in 2000.
Wheel Spins Bonus (Video Wheel of Fortune) article written by IGT, published before Sep. 30, 2004.
Wild Bear Salmon Run Advertisement written by IGT, published in 2003.
Wild Streak Advertisement written by WMS Gaining, Inc., published in Strictly Slots Mar. 2001.

Winning Streak Brochure, written by Aristocrat, published in 1994.
Your Real Key to Gaming Success Advertisement (including Roll Over Beethoven and Wild Fortune) written by Olympic Video Gaming, published prior to Feb. 23, 2004.

* cited by examiner

258

| CONSECUTIVE OUTCOME | 1st | 2nd | 3rd | 4th | 5th | 6th |
|---|---|---|---|---|---|---|
| AWARD | 2X | 12X | 100X | 250X | 1000X | 25000X |

259 277

FIG. 18A

258a

259a

| NUMBER OF SYMBOLS | AWARD |
|---|---|
| 21+ | 25,000x |
| 20 | 1,000x |
| 19 | 500x |
| 18 | 300x |
| 17 | 200x |
| 16 | 100x |
| 15 | 75x |
| 14 | 50x |
| 13 | 35x |
| 12 | 30x |
| 11 | 25x |
| 10 | 20x |
| 9 | 10x |
| 8 | 5x |
| 7 | 4x |
| 6 | 3x |
| 5 | 2x |
| 4 | NO AWARD |
| 3 | NO AWARD |
| 2 | NO AWARD |
| 1 | NO AWARD |
| START | |

277a

FIG. 18B

ROTOR-BASED GAMING DEVICE HAVING A SYSTEM FOR CHANGING THE QUANTITY OF POTENTIAL GAME OUTCOMES FOR SUBSEQUENT PLAYS

PRIORITY CLAIM

This application is a continuation of, and claims priority to and the benefit of, U.S. Non-Provisional patent application Ser. No. 11/609,149, filed on Dec. 11, 2006, now U.S. Pat. No. 7,708,630 which claims priority to and the benefit of U.S. Provisional Patent Application No. 60/748,845, filed on Dec. 9, 2005, which are hereby incorporated by reference in their entirety.

CROSS REFERENCE TO RELATED APPLICATIONS

The present application relates to the following commonly-owned patent applications: U.S. patent application Ser. No. 11/558,777 filed on Nov. 10, 2006, now U.S. Pat. No. 7,674,172; U.S. patent application Ser. No. 11/064,314 filed on Feb. 23, 2005, now U.S. Pat. No. 7,533,885; U.S. patent application Ser. No. 11/119,997 filed on May 2, 2005, now U.S. Pat. No. 7,553,233; and U.S. patent application Ser. No. 11/609,173, filed on Dec. 11, 2006.

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND

There are a variety of games to play in casinos and other gaming environments. Roulette is one commonly known game which involves a moving Roulette-wheel and a ball which travels along the moving Roulette-wheel. Depending upon where the ball stops, the player may win or lose a bet. There is a need to increase the level of interest, excitement and volatility associated with playing Roulette-related games. There is also a need to enhance the operational functionality of Roulette-related games or otherwise provide improvements to, and interesting variations of, Roulette-related games.

SUMMARY

The gaming device, in one embodiment, includes a spinning Roulette-wheel having a rotor and a wagering layout operable for play of a Roulette-wheel game. The game can be played at a gaming table with a live dealer, through a stand alone gaming machine, or though a computer network such as the internet. Several players can simultaneously place bets on the wagering layout. The wager layout includes a plurality of wagering areas which enable the players to bet on where the ball will land on the Roulette-wheel. The game is administered by a dealer which can be a human dealer, a human dealer operating in a casino, a feed or transmission of a video of a dealer operating in a live game, through a real-time video feed of a live casino game, a computerized dealer, a virtual dealer of a casino, a gaming device, a gaming establishment, or a gaming system provided through a data network such as the internet.

Once the bets are placed, the dealer spins the rotor in one direction. Then the dealer launches a ball onto the rotor, typically in the opposite direction. The rotor has a plurality of pockets, wells or ball landings. The game outcomes for the primary Roulette-wheel game are based on which landing is the stopping place or receiver for the ball.

In one embodiment, the gaming device includes a game that is operable upon one or more wagers for an initial play and one or more subsequent plays. Each of the initial and subsequent plays involves a spin of a rotor. The rotor includes a plurality of symbols and a plurality of ball landings adjacent to the symbols. A wager can be placed on the possibility of any one of the symbols or sets of symbols will occur for the initial play. A triggering condition is associated with the rotor. If the triggering condition occurs or is fulfilled in the initial play, a determination of: (a) a certain quantity of ball landings that will be eliminated for the subsequent play; and (b) an identification of specific ball landings that will be eliminated for the subsequent play is made. Prior to the subsequent play, wagers placed in the initial play are resolved (i.e., winning wagers are paid and non-winning wagers are cleared). For the subsequent play, another wager can be placed on the possibility of any one of the symbols or sets of symbols will occur for the subsequent play. The subsequent play includes a lower quantity of ball landings than the initial play. In one embodiment, an indicator is operable to indicate information relating to the second quantity of the ball landings.

In one embodiment, one quantity of potential ball landings is available for the initial play. If a designated event occurs in the such play, a lower quantity of potential ball landings is available for one or more of the subsequent plays. In one embodiment, the number of ball landings is reduced from the initial play to the subsequent play after a designated event occurs in the initial play of the game.

In one embodiment, the gaming device includes a ball landing availability reducer operable to reduce the number of potential ball landings after a designated event occurs. The decrease in the number of potential ball landings causes an increase in the probability for any given remaining or available ball landings in one or more of the subsequent plays.

In one embodiment, the ball landing availability reducer includes at least one symbol designator that is operable to designate one of the symbols on the rotor. If the ball landings associated with the designated symbol is indicated in the initial play, the ball landing availability reducer eliminates such outcome for the upcoming subsequent play. The eliminated outcome reduces the number of total ball landings available in the subsequent play to increase the player's odds of winning in the second play.

In one embodiment, the gaming device eliminates a number of potential ball landings based on a number determined by a number determiner. The number determiner is coupled to an indicator which that is operable to indicate the determined number to the player during or after the first play.

The gaming device disclosed achieves a plurality of technical effects, including, but not limited to, a ball landing availability reducer and a number determiner associated with a reduced number of ball landings as described in detail below.

Additional features and advantages are described herein, and will be apparent from, the following Detailed Description and the figures.

BRIEF DESCRIPTION OF THE FIGURES

FIG. 18A is a front view of one embodiment of an award system for one embodiment of the game system.

FIG. 18B is a front view of one embodiment of an award system for one embodiment of the game system.

DETAILED DESCRIPTION

Rotor-Based Game System

Figure 1:
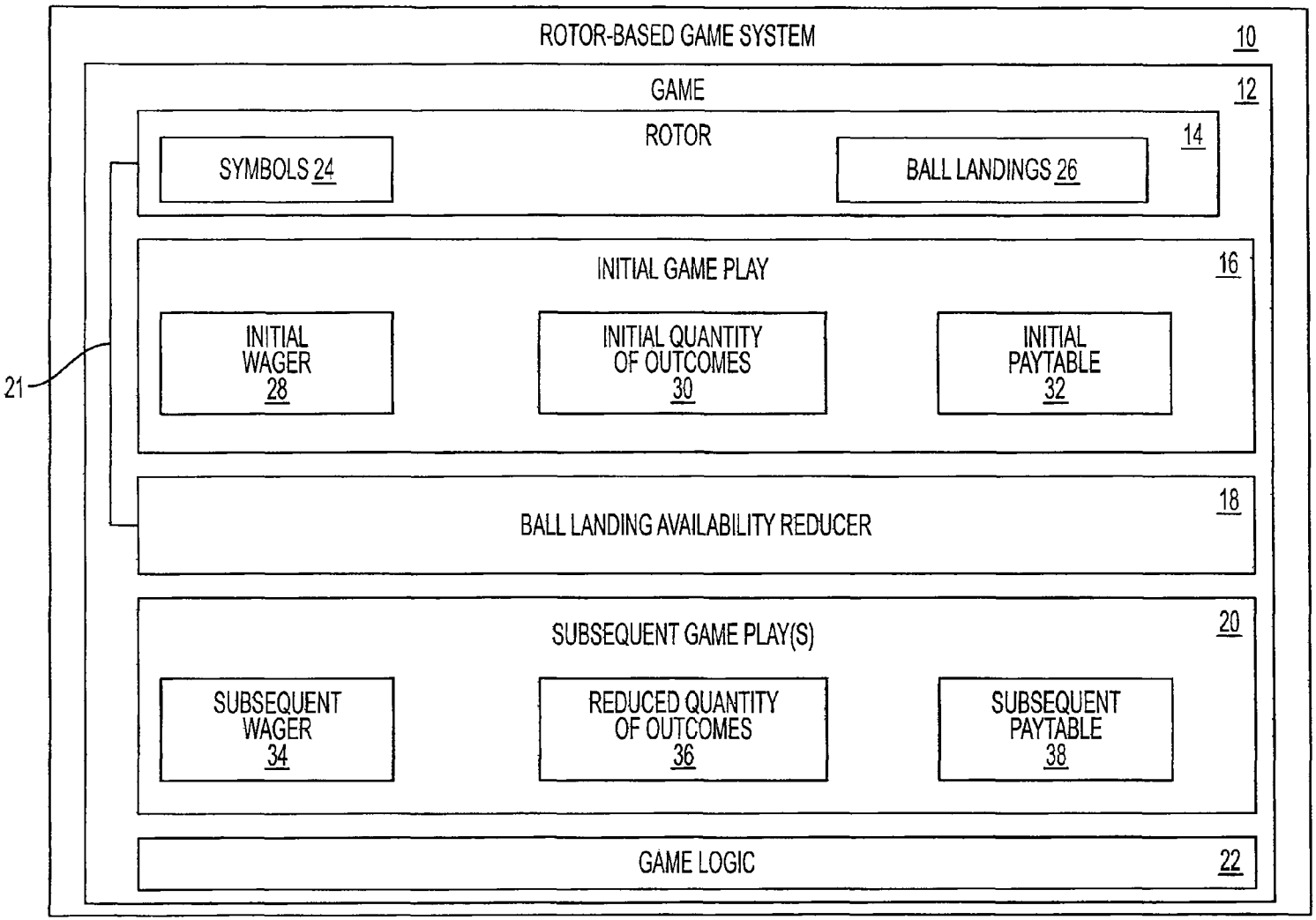
FIG. 1 is a schematic view of one embodiment of a rotor-based game system, wherein the game system includes a rotor-based game and a bail landing availability reducer.

Referring now to FIGS. 1 to 9, a rotor-based game system 10, in one embodiment, is operable for the play of a game 12 involving a rotor 14. One or more players can play the rotor-based game 12 at the same time, for example, on a gaming table or at different gaming devices. The game system 10 can be configured for the play of various types of Roulette-related games, including, but not limited to, American style Roulette, European style Roulette or any suitable variation of such styles based on the spin of a Roulette-wheel or a rotor.

Depending upon the embodiment, the rotor-based game system 10 can be implemented in a mechanical, electro-mechanical or virtual form, as described in greater detail below. In mechanical or electro-mechanical form, a human dealer can facilitate the operation of the rotor 14 while in all forms, a computerized dealer can facilitate the operation of the rotor 14. It should be appreciated that the dealer can be a human dealer, a human dealer operating in a casino, a feed or transmission of a video of a dealer operating in a live game, through a real-time video feed of a live casino game, a computerized dealer, a virtual dealer of a casino, a gaming device, a gaming establishment, or a gaming system provided through a data network such as the internet. Irrespective of the implementation of the rotor-based game system 10, in one embodiment described further below, the rotor-based game 12 includes the rotor 14, an initial or first game mode or play 16, a ball landing availability reducer 18 and a subsequent or second game mode or play 20 that operate in accordance with the game logic 22.

The rotor 14 includes a plurality of symbols 24 and a plurality of ball landings 26. The ball landings 26 are positioned adjacent to the symbols 24 on the rotor 14. In one embodiment, the symbols 24 are in the form of numerals, such as 1 to 36, and 0, with variations having additional symbols such as 00 or any other suitable symbol.

The initial play 16 includes a initial wager 28, which is placed by one or more players. The initial wager 28 is placed based on a starting quantity of potential game outcomes or ball landings 30. After a player places a initial wager 28 for the initial play 16, the initial play 16 causes at least one spin of the rotor 14 that results in at least one of the outcomes (i.e., one of the ball landings 26 and a corresponding symbol 24) in the starting quantity of potential game outcomes or ball landings 30. The initial wagers 28 are resolved based on the resulting game outcome in accordance with an initial paytable 32, which in one embodiment, corresponds to a paytable of conventional Roulette-related games.

Referring to FIG. 1, in one embodiment, the ball landing availability reducer 18 is operatively coupled to the rotor 14 through a coupler 21. The ball landing availability reducer 18 is operable to reduce the starting quantity of potential game outcomes 30 to a reduced quantity of game outcomes or ball landings 36. The reduced quantity of game outcomes 36 is implemented in the one or more subsequent plays 20 in accordance with the game logic 22. Depending on the embodiment, as will be described below in greater detail, the ball landing availability reducer 18 may take various suitable forms and may or may not be activated for each spin of the rotor 14 during the initial play 16.

In one embodiment, one or more subsequent plays 20 is operable after a triggering event occurs in the initial play 16. In one embodiment, the triggering event includes the indication of a symbol 24 after a spin of the rotor 14 if such symbol 24 aligns with a symbol designator 40 described below. In one embodiment, the triggering event is the rotor's indication of a designated symbol 24 after a spin of the rotor 14. In another embodiment, the triggering event is a secondary outcome by an indicator or other suitable device, as described below, associated with the rotor. In one embodiment, the results of the triggering event are displayed by indicators in the rotor, such as a display device associated with each ball landing as will be described in greater detail below. In another embodiment, the triggering event may also require a qualifying wager made by one of the players at the beginning of the initial play 16. It should be appreciated that the triggering event may be any suitable triggering event and could be based on a wager made in the initial or subsequent play or any other suitable factor.

In one embodiment, for each subsequent play 20 with a reduced quantity of potential outcomes, a player must place a subsequent wager 34 at the beginning of the subsequent play 20. The subsequent wager 34 can be any wager including, but not limited to, a repeat of the initial wager 28 or any other suitable wager that is less than or equal to the initial wager 28. In an alternate embodiment, the subsequent wager limit may be defined to be a multiple of the initial wager. In an alternate embodiment, the subsequent wager limit may be defined to be a fraction of the initial wager. The subsequent wager 34 will apply to the reduced quantity of potential game outcomes 36, if the subsequent play 20 is triggered (i.e., a designated triggering event occurs or is fulfilled in the initial play 16). After the player places the subsequent wager 34, the subsequent play 20 causes at least one spin of the rotor 14 which results in at least one of the outcomes (i.e., one of the ball landings 26 and a corresponding symbol 24) in the reduced quantity of potential game outcomes 36. The one or more subsequent wagers 34 are resolved based on the resulting outcome in accordance with a subsequent paytable 38, which in one embodiment, is a modification of the initial paytable 32. In one embodiment, the potential outcomes of the subsequent play 20 will occur more frequently, on average, than the potential outcomes of the initial play 16. For example, depending on how a player wagers for the subsequent play, the player could have a higher win to non-win ratio for the subsequent play 20 than the win to non-win ratio for the initial play 16.

The initial play 16, the ball landing availability reducer 18 and the subsequent play 20 are provided in addition to, or in replacement of, one or more of the conventional wagering opportunities in various types of Roulette-related games. In one embodiment, the game system 10 automatically starts the subsequent play 20 if a ball or other indicator lands on or adjacent to a designated symbol 24 (or symbol landing 26 associated with the symbol 24). In one embodiment, a player must place a designated type or amount of wager to qualify for the initiation of the subsequent play 20. This is sometimes referred to as a buy-a-pay or a buy-a-bonus proposition.

In one embodiment illustrated in FIG. 1, the game logic 22 defines the play of the rotor-based game 12. The game logic 22 includes, as described in further detail below, maximum wager limits, symbols 24 that can be wagered on, and awards based on the initial and subsequent wagers 28 and 34 and initial and subsequent paytables 32 and 38 in the game 12. More specifically, the game logic 22 enables one or more players to place wagers on which symbols 24 or set of symbols 24 will be indicated on the rotor 14 in each play 16 and 20 of the game 12. The rotor 14 is operable with an indicator or marker, such as a ball or other suitable marker, which moves relative to the spinning rotor and stops to indicate one of the symbols 24 on the rotor 14 after each spin. Upon the placement of a wager, a human or computer dealer spins the rotor 14. The dealer also spins, ejects or shoots the indicator on the rotor 14. When the indicator stops traveling, the indicator indicates one of the symbols 24 on the rotor 14. If the indicated symbol 24 corresponds to a winning outcome (i.e., matches an outcome wagered on by the player), the dealer provides an award to the player based on any wagers placed on that winning outcome.

Figure 2:
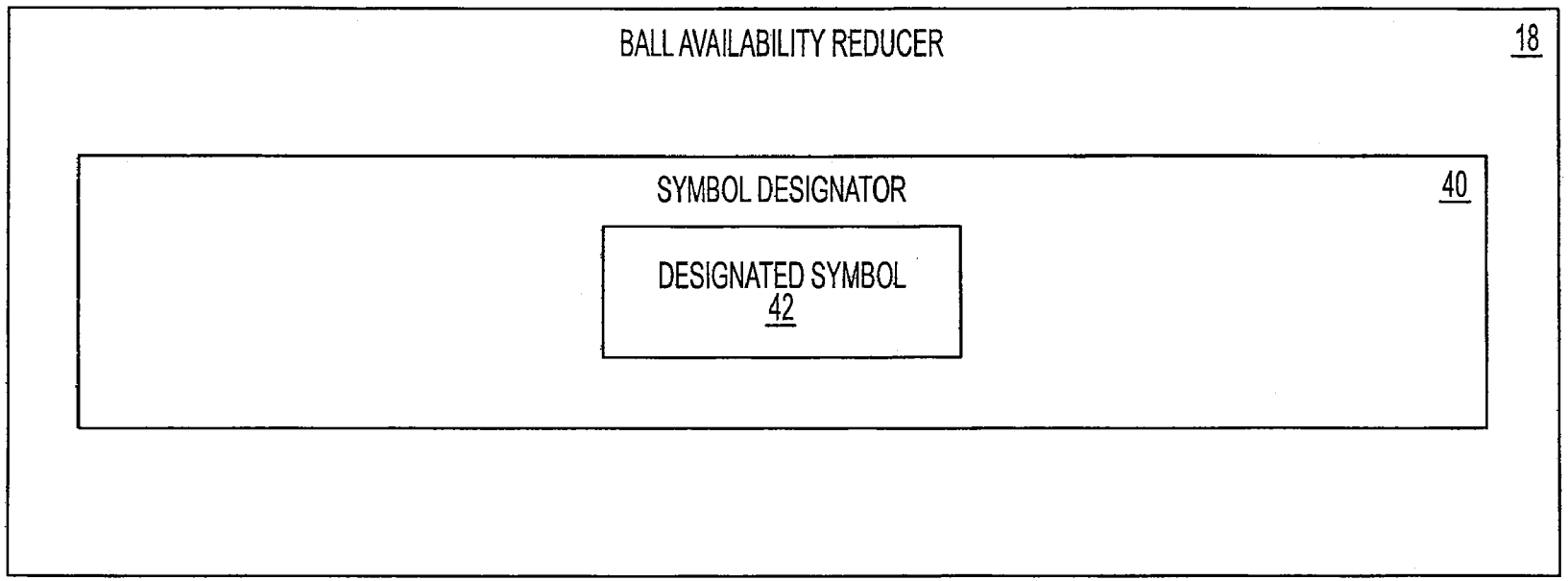
FIG. 2 is a schematic view of one embodiment of a rotor-based game system, wherein the game system includes one embodiment of the ball landing availability reducer.

Referring to FIGS. 1 and 2, in one embodiment, the ball landing availability reducer 18 includes a symbol designator 40. The symbol designator 40 is operable to designate one or more of the symbols 24 in the initial play 16 as a designated symbol 42. If the outcome associated with the designated symbol 42 occurs in the initial play 16, the ball landing availability reducer 18 is operable to reduce the number of potential game outcomes available for one or more subsequent plays 20 of the game 12. In one embodiment, the ball landing availability reducer 18 eliminates or deactivates the outcome associated with the designated symbol 42 from the subsequent play(s) 20. In another embodiment, the number of outcomes to be eliminated or deactivated is associated with each designated triggering event or outcome. In another embodiment, the ball landing availability reducer 18 relies upon a secondary outcome to determine how many of the potential outcomes and an identification of specific potential outcomes to be eliminated or deactivated. In this embodiment, the ball landing availability reducer 18 removes the eliminated or deactivated outcomes from the starting quantity of potential game outcomes 30 to form the reduced quantity of potential game outcomes 36.

Figure 3:
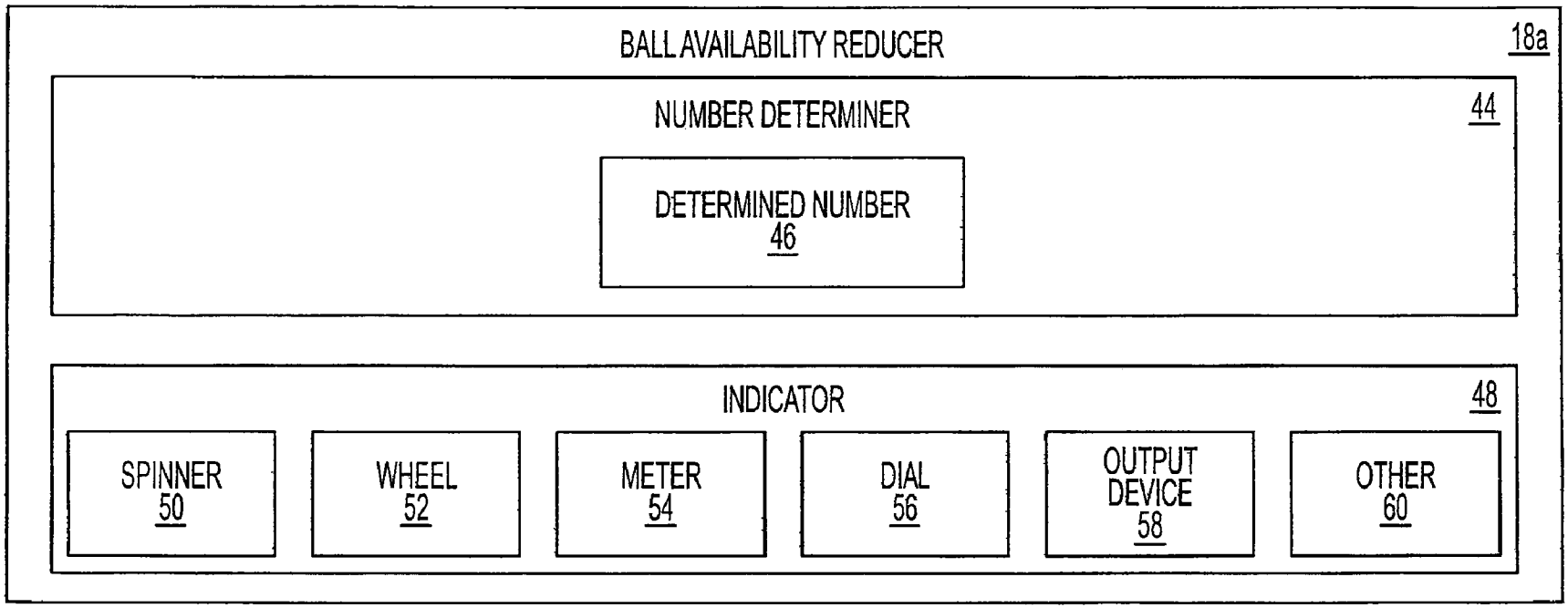
FIG. 3 is a schematic view of one embodiment of a rotor-based game system, wherein the game system includes one embodiment of the ball landing availability reducer.

Referring to FIG. 3, the ball landing availability reducer 18*a* includes a number or quantity determiner 44 and a quantity indicator 48 in one embodiment. The number determiner 44 is operable to determine a number or quantity 46. Depending upon the embodiment, the number determiner 44 can include a random number generator, a pseudo-random number generator or any program, system or apparatus operable to produce one number out of a pool of numbers. The determined number 46 represents the number of potential outcomes to be removed from the starting quantity of potential game outcomes 30 to form the reduced quantity of potential game outcomes 36 in the subsequent play 20. The determined number 46 is indicated by the quantity indicator 48 during the initial play 16. Depending upon the embodiment, the quantity indicator 48 can include any suitable device, including, but not limited to, a spinner 50, a Roulette-wheel 52, a meter 54, a dial 56, a visual output device, an audio output device, or an audiovisual device 58 and any other suitable device 60. In a virtual implementation of one embodiment, the rotor can morph into or be replaced by the quantity indicator 48. In another virtual implementation of one embodiment, the rotor can morph into or be replaced by a modified rotor which excludes each eliminated, deactivated or removed game outcome (i.e., ball landing and associated symbol).

Figure 4:
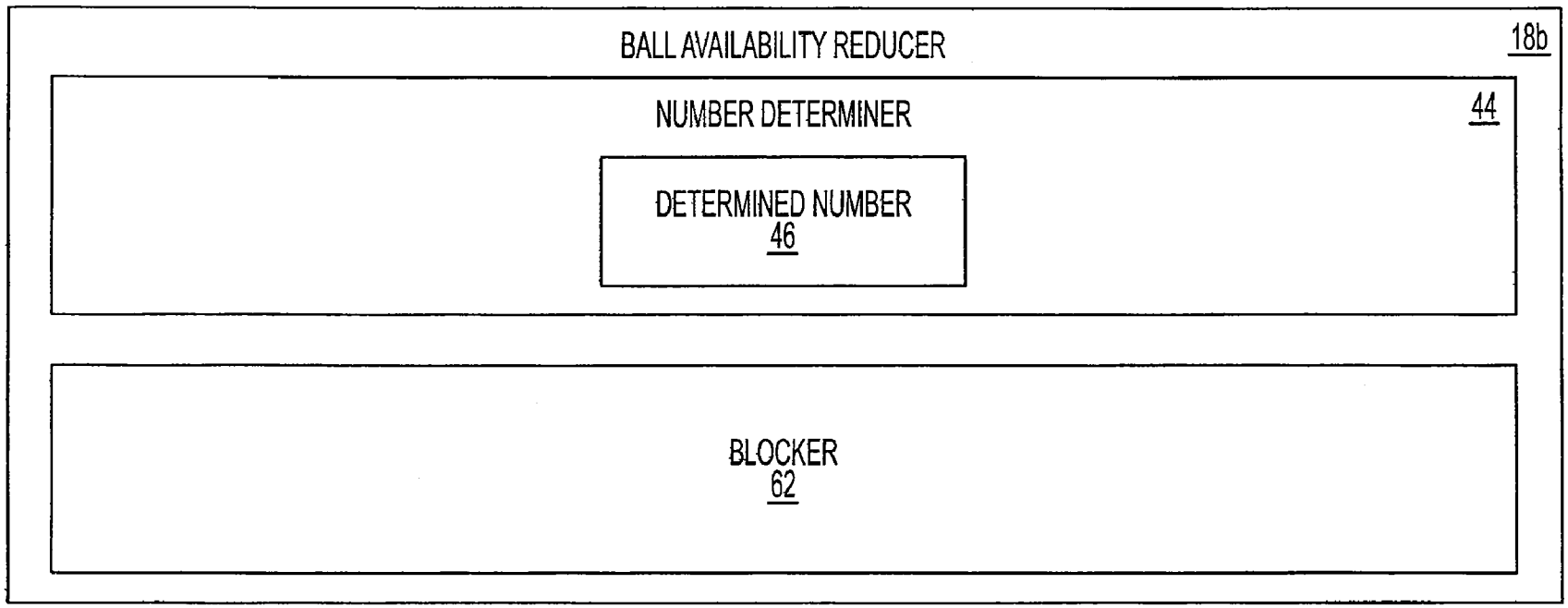
FIG. 4 is a schematic view of one embodiment of a rotor-based game system, wherein the game system includes one embodiment of the ball landing availability reducer.

As best illustrated in FIG. 4, the ball landing availability reducer 18*b* includes the number determiner 44 and a blocker 62 in one embodiment. The blocker 62 is operable in the subsequent play 20 to block, disable or prevent the occurrence of any eliminated game outcomes. In various embodiments, the blocker 62 includes different configurations, such as a physical insert or object, a magnetic mechanism or a pneumatic mechanism configured to obstruct or block one or more of the ball landings 26 of the rotor 14 to prevent the ball from landing on such blocked ball landing in the subsequent play 20. By blocking designated ball landings 26, the number of potential game outcomes is reduced for the subsequent play 20.

Figure 5:
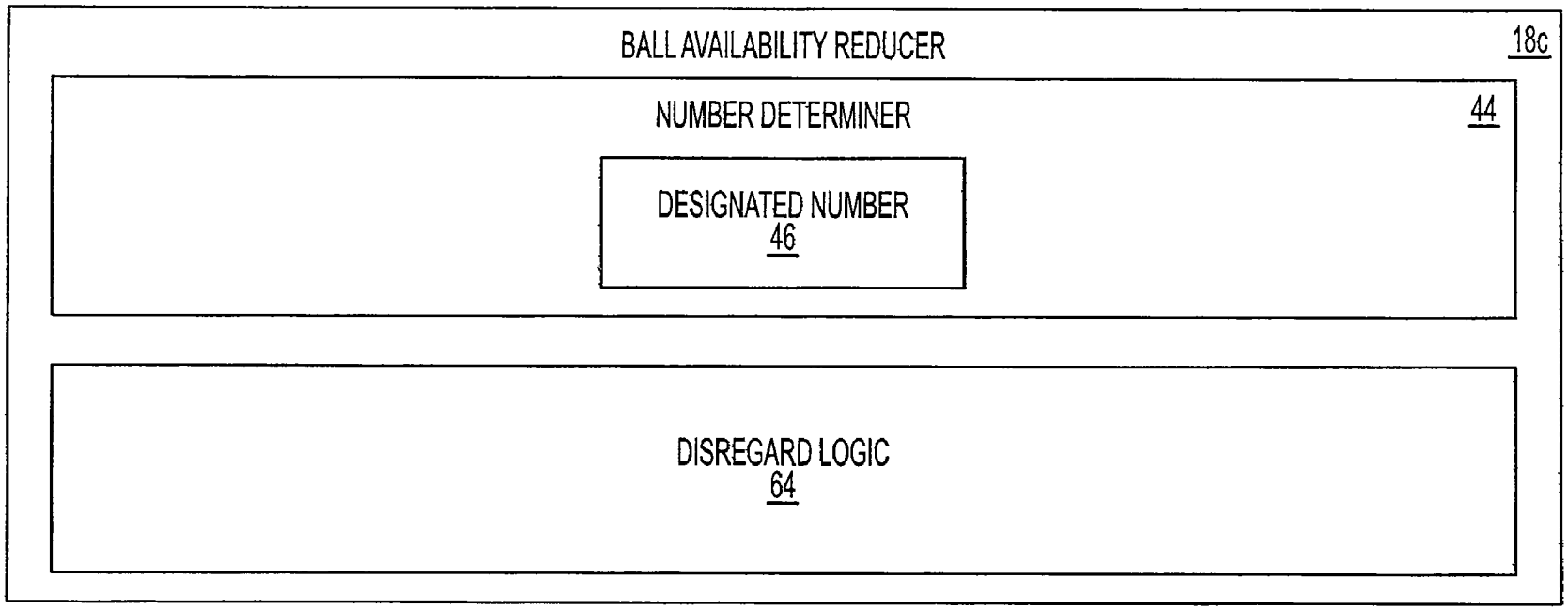
FIG. 5 is a schematic view of one embodiment of a rotor-based game system, wherein the game system includes one embodiment of the ball landing availability reducer.

As best illustrated in FIG. 5, the ball landing availability reducer 18*c* includes the number determiner 44 and a disregard logic 64 in one embodiment. For the subsequent play 20, the disregard logic 64 directs the dealer to disregard any deactivated or eliminated outcomes for a subsequent play 20. In contrast to the blocker 62 described above, the ball landings 26 do not need to be modified or manipulated in this embodiment. Instead, if the indicator lands on a ball landing 26 specified as eliminated and associated with the symbol "11" in a subsequent play, the dealer ignores or disregards such result and spins the rotor 14 again with any subsequent wagers 34 standing. That is, the subsequent wagers 34 are maintained for a third spin of the rotor 14. In one embodiment, the dealer removes the ball from the ball landing 26 and spins the ball and rotor 14 again for the third spin. In another embodiment, such deactivated or disabled ball landing 26 is configured to receive and hold a first ball so that another ball can be spun along with the rotor without the dealer having to remove the first ball from such deactivated ball landing 26. In another embodiment, if a ball lands on a ball landing specified as being eliminated, blocked or deactivated, in addition to an additional spin or a respin with all wagers and all blocked outcomes standing, an additional outcome can be eliminated, blocked or deactivated in a subsequent play.

In one embodiment, the ball landing availability reducer 18 includes any one of the embodiments described above. In another embodiment, the ball landing availability reducer 18 includes any suitable combination of such embodiments. In a further embodiment, the ball landing availability reducer 18 includes any suitable combination of one or more portions of such embodiments. For example, in one embodiment, the ball landing availability reducer 18 includes the symbol designator 40, the number determiner 44 and the quantity indicator 48. In this embodiment, the number determiner 44 determines how many (i.e., the determined number 46) of outcomes are deactivated or eliminated from the starting quantity of potential game outcomes 30. The quantity indicator 48 indicates the determined number or quantity 46. The symbol designator 40 designates which outcomes (i.e., designated symbols 42) are deactivated or eliminated from the starting quantity of potential game outcomes 30. In this embodiment, the number of designated symbols 42 is equal to the determined number 46 so that the determined number 46 of designated symbols 42 are deactivated or eliminated from the starting quantity of potential game outcomes 30 to produce the reduced quantity of potential game outcomes 36 for the subsequent play 20.

It should be appreciated that, in other embodiments, the ball landing availability reducer 18, the symbol designator 40, the number determiner 44, the quantity indicator 48, and the blocker 62 can be independent from, and operate independently with, one another. For example, after a designated triggering event occurs in the initial play 16, the number determiner 44 can determine how many ball landings will be eliminated or deactivated. This determination is independent from the identification of which specific ball landings will be eliminated or deactivated.

For example, in one embodiment, one or more symbol designators 40 are associated with and independently operable with the rotor 14 and the ball landing availability reducer 18. On a first spin of the rotor for the initial play 16, the ball or indicator lands on one of the ball landings 26. If the ball landing 26 aligns with one of the symbol designators 40 when the rotor stops spinning, the triggering event is fulfilled in the initial play 16. That is, one or more of the ball landings 26 will be eliminated, deactivated or removed from the rotor for one or more subsequent plays 20. In one embodiment, the ball landing 26 and the symbol 24 adjacent to such ball landing are eliminated, deactivated or removed from the rotor if that ball landing 26 aligns with one of the symbol designators 40.

In another embodiment, a plurality of ball landings 26 and the symbols 24 adjacent to such ball landings are eliminated, deactivated or removed from the rotor if the ball landing 26 aligns with one of the symbol designators 40. For example, in this embodiment, the ball landing 26 aligned with one of the symbol designators 40 and the symbol 24 adjacent to such ball landing aligned with one of the symbol designators 40 is eliminated, deactivated or removed from the rotor.

Figure 6:
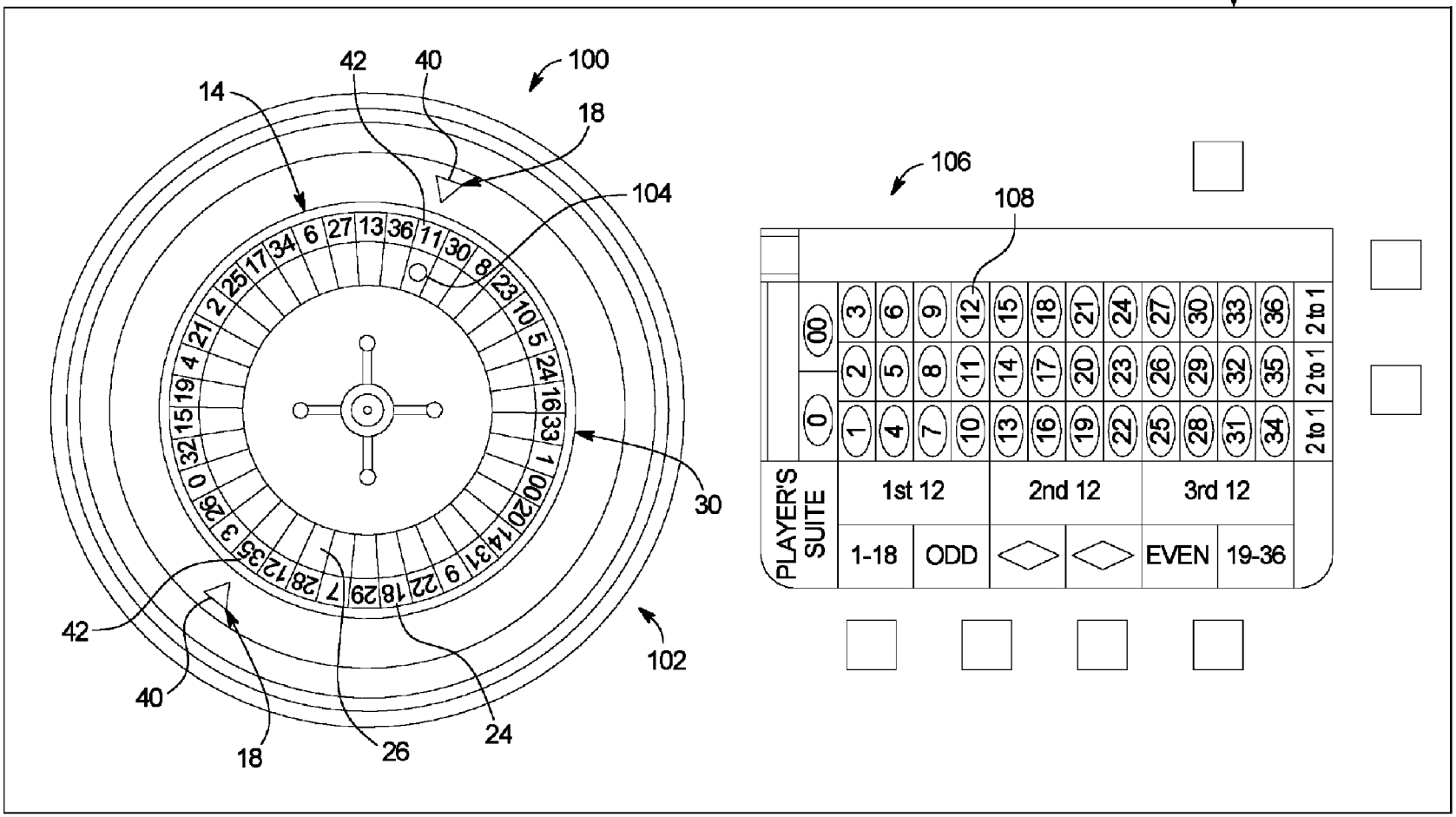
FIG. 6 is a top view of one embodiment of the game system, the game system shown during a first or initial play of the rotor-based game.
Figure 7:
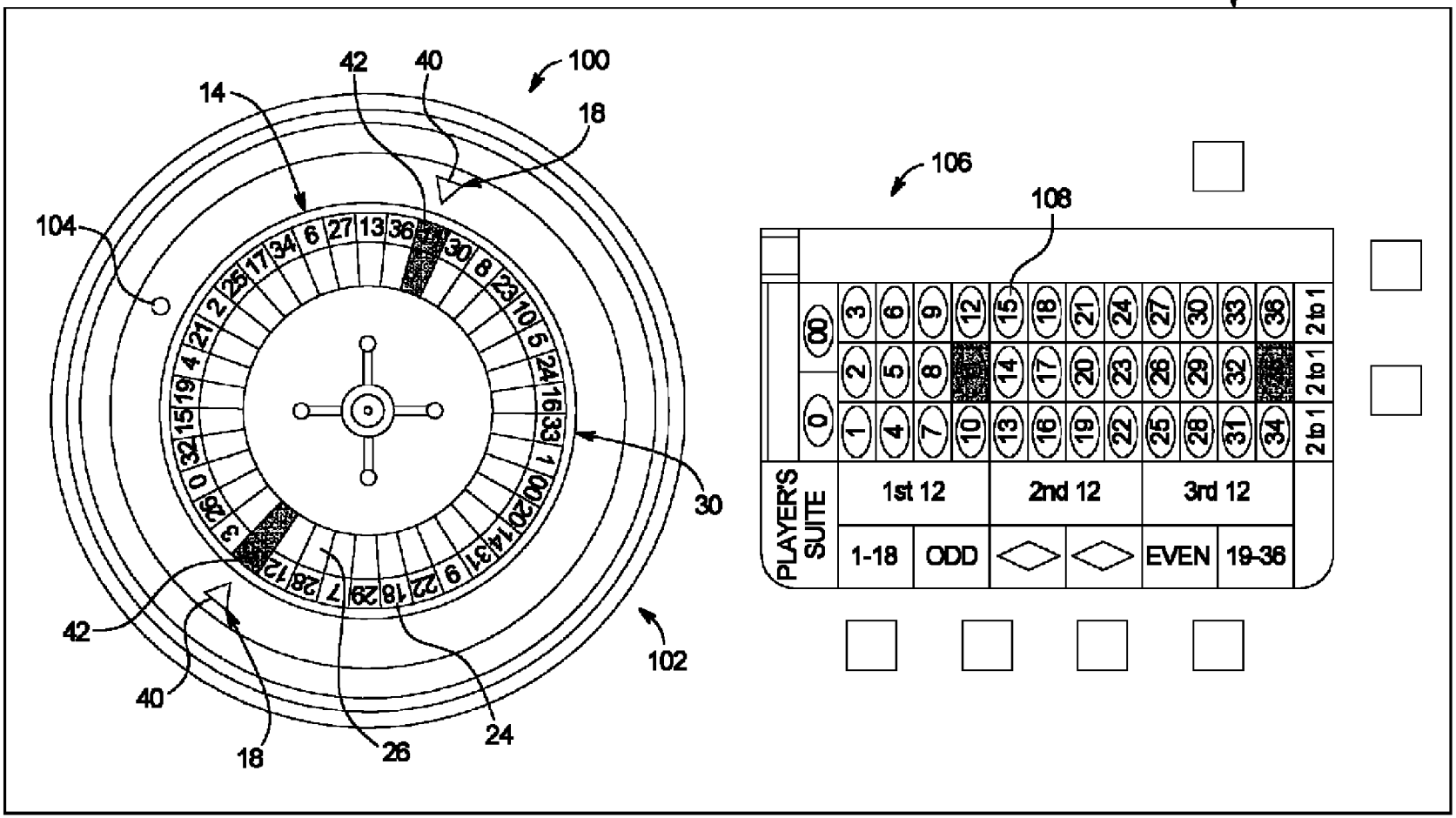
FIG. 7 is a top view of one embodiment of the game system, the game system shown during a second or subsequent play of the rotor-based game.

In one example illustrated in FIGS. 6 and 7, the rotor-based game 12 implements the initial play 16, the ball landing availability reducer 18 and the subsequent play 20 in accordance with the game logic 22. As illustrated in FIG. 6, the game 12 includes a Roulette-wheel assembly 100 having the rotor 14, a plurality of the symbols 24 and a plurality of the ball landings 26 adjacent to the symbols 24. The Roulette-wheel assembly 100 includes a support or bowl 102 that supports the rotor 14. In the initial play 16, the dealer spins the rotor 14 and the ball 104 as described above. The rotor 14 and ball 104 travel relative to the support 102.

As illustrated, the support 102 displays a symbol designator 40 of at least one ball landing availability reducer 18 adjacent to two symbols 24 of the rotor 14. Each symbol designator 40 is in the form of an arrow or pointer. The symbol designator 40 is operable to designate or indicate one of the symbols 24 of the rotor 14 as a designated symbol 42. In the example illustrated in FIG. 6, the symbol designators 40 point to the symbols "11" and "35." In one embodiment, the symbol "11" or the symbol "35" is a designated symbol 42 because the rotor stopped with symbols aligned with the trigger indicator. If the ball 104 had landed on the ball landing 26 adjacent to either of these symbols, a secondary round would be triggered.

In another embodiment, the designated symbol or designated symbols are selected by a secondary device (not shown). In one embodiment, this selection occurs before the ball lands. In one embodiment, this selection occurs after the ball has landed. In one embodiment, such designations are displayed by a secondary device. In one embodiment, the designated symbols are indicated on the rotor by a display device such as an LED or other lighting device adjacent to such designated symbols.

In another embodiment, one or more symbols on the rotor are permanently designated to be secondary play triggers. In one embodiment, players may wager on this to be the primary outcome similar to how players wager on standard symbol outcomes. If the outcome of the spin of a rotor results in the ball landing in a landing which has the permanent trigger designation, then the secondary play is triggered. In one embodiment, the player's original bets are made available to the player for the player to redistribute on the bet layout for the next secondary play spin after outcomes have been prevented or eliminated for such next spin.

In the illustrated embodiment, the rotor 14 has a plurality of the symbols 24 in the form of numerals. The numerals on the rotor 14 can include 1 to 36, 0, 00 and possibly 000. As illustrated, the rotor 14 also includes a plurality of ball landings 26 adjacent to the symbols 24. In this embodiment, the symbols 24 are represented by numerals, but the symbols 24 may be displayed as alphanumeric characters or any other suitable character or image. The symbols 24 may be associated with one or more colors, such as red, black, or green, or associated with any other suitable characteristics. It should be appreciated that the rotor 14, the symbols 24 and ball landings 26 may be displayed in any suitable format and in any suitable order in the game 12.

Continuing with reference to FIG. 6, the game 12 also includes at least one wagering or betting layout 106. The wagering or betting layout 106 is sometimes referred to as a wagering station. In this embodiment, the wagering layout 106 includes a plurality of wagering regions 108. In this embodiment, the wagering regions 108 constitute a template of a grid of numbers and betting options. For each initial play 16 and subsequent play 20 of the game 12, the game logic 22 enables one or more players to place initial wagers 28 on at least one wagering region 108 of the wagering layout 106 during the initial play 16. The game 12 indicates any placed wagers on the one or more wagering regions 108 with a suitable marker, such as at least one chip or token having a designated or desired denomination. Each player can control the risk and potential award levels by selecting one or more of the wagering regions 108 and a wager denomination, such as one dollar.

Examples of the wagering regions 108 include inside bets or wagers 28 and outside bets or wagers 28.

Inside bets 28 include a single bet or wager in which each player can place the single bet to cover between one and six numbers. Examples of inside bets include:

| Inside Bet | Bet Description |
|---|---|
| Straight Bet: | Place a chip on one symbol on the wagering layout (e.g., 0, 00 (if available), 1, 12 or 23). |
| Split Bet: | Place a chip between two adjacent numbers on the wagering layout (e.g., 14 and 15). |
| Trio Bet: | Place a chip at an edge of a row to bet on the three numbers along a row on the wagering layout (e.g., 7, 8 and 9). |
| Corner Bet: | Place a chip on the corner of four adjacent numbers on The wagering layout (e.g., 22, 23, 25, and 26). |
| Four Number Bet: | Place a chip on an edge of the wagering layout between two adjacent rows of numbers containing 0, 1, 2, and 3. |
| Five Number Bet: | Place a chip on an edge of the wagering layout between two adjacent rows of numbers containing 0, 00, 1, 2, and 3. |
| Six Number Bet: | Place a chip on an edge of the betting layout between two adjacent rows of numbers (e.g., 16, 17, 18, 19, 20, and 21). |

Outside bets 28 include a single initial bet or wager 28 in which each player can place a single bet to cover an entire category of numbers. Outside bets include even money bets and two to one money bets. Examples of even money bets include:

| Even Money Bet | Bet Description |
|---|---|
| Even: | Any even valued number (e.g., 2, 4, 6, etc.) excluding 0 and 00. |
| Odd: | Any odd valued number (e.g., 1, 3, 5, etc.) excluding 0 and 00. |
| Red: | Any red number. |
| Black: | Any black number. |
| Low (1-18): | Any number 18 or lower, excluding 0 and 00. |
| High (19-36): | Any number 19 or greater, excluding 0 and 00. |

Two to one money bets include a dozens bet, wherein a player can place a single initial wager 28 on three different sets of table rows to bet on, and a column bet, wherein a player can place a single wager on a column of numbers in the betting layout. Examples of dozens bets include:

| Dozens Bet | Bet Description |
|---|---|
| 1st 12: | Any number 1 through 12. |
| $2^{nd}$ 12: | Any number 13 through 24. |
| $3^{rd}$ 12: | Any number 25 through 36. |

Examples of column bets include:

| Column Bets | Bet Description |
|---|---|
| $1^{st}$ Column: | Any number of 1, 4, 7, 10, 13, 16, 19, 22, 25, 28, 31, and 34. |
| $2^{nd}$ Column: | Any number of 2, 5, 8, 11, 14, 17, 20, 23, 26, 29, 32 and 35. |
| $3^{rd}$ Column: | Any number of 3, 6, 9, 12, 15, 18, 21, 24, 27, 30, 33, and 36. |

In one embodiment, the game logic 22 limits the initial wager amount 28 that players can place on the symbols 24. For example, in one embodiment, the minimum betting limits and maximum betting limits are listed in the initial or subsequent pay table 32 and 38 and displayed to the players. If the minimum table bet is larger than a single chip or token, then a player can place single chip bets as long as the total of all bets meets the minimum betting limit. For example, if a minimum betting limit is $5, the player can place five $1 wagers to meet the minimum betting limit.

In one embodiment, a maximum bet limit is associated with each type of bet, as well as an overall betting limit for each spin of the rotor 14. For example, one maximum bet limit is associated with the inside wagers 28 and another maximum bet limit is associated with the outside wagers 28. The limit for a bet on an individual number or symbol 24 is a fraction of the overall maximum betting limit. For example, in one embodiment, the maximum bet limit for single number bets is one-twentieth of the table limit and the maximum bet limit for multi-number bets is one-twentieth of the table limit for every number included in a player position. In one embodiment, the maximum bet limit associated with the initial wagers 28 is a predetermined fixed amount determined by the game logic 22. In one embodiment, the maximum bet limit associated with the subsequent wagers 34 in each of the subsequent plays 20 is equal to the amount of the initial wager 28 in the initial play 16. In another embodiment, as determined by the game logic 22, a first maximum bet limit is associated with the inside wagers and a second maximum bet limit is associated with the outside wagers.

The following example table describes the maximum bet, in one embodiment, for each bet opportunity.

| Bet Opportunity | Maximum Bet |
|---|---|
| Straight bet (one number) | 1/20 of maximum table limit |
| Split bet (two numbers) | 2/20 of maximum table limit |
| Trio bet (three numbers) | 3/20 of maximum table limit |
| Corner bet (four numbers) | 4/20 of maximum table limit |
| Six numbers | 6/20 of maximum table limit |
| Column bets (twelve numbers) | 12/20 of maximum table limit |
| Dozens (1-12, 13-24, or 25-36) | 12/20 of maximum table limit |
| Red, Black, Odd or Even, | 18/20 of maximum table limit |
| Low (1-18) and High (19-36) | 18/20 of maximum table limit |

For the initial play 16 of this example, thirty-eight starting quantity of potential game outcomes 30 are possible and wagering is conducted based on the initial paytable 32. In this example, the starting quantity of potential game outcomes 30 includes the symbols or numbers 1 to 36, 0 and 00. Upon the placement of one or more initial wagers 28, the dealer spins the rotor 14 and ejects the ball 104 as described above for the initial play 16. When the ball 104 stops spinning, the stopped ball 104 indicates an outcome of the rotor spin (i.e., one of the symbols 24 and the associated ball landing 26 on the rotor 14) for the initial play 16. If the indicated outcome corresponds to a winning outcome (i.e., matches an outcome wagered on by the player), the dealer provides an award to the player based on the placed initial wagers 28 in accordance with the initial paytable 32, as described above in reference to FIG. 1.

In one embodiment (such as the mechanical or electromechanical embodiments described below), the rotor 14 is coupled to an alignment assembly (not shown). The alignment assembly includes a gear assembly or stopper or ratchet mechanism or flipper mechanism which operates so that the rotor can only stop in certain, discrete positions relative to the symbol designators such that the game symbols 24 will be in alignment with the symbol designators 40 when the rotor stops. The rotor 14 may also be coupled to a variable friction assembly (not shown), which may be part of the alignment assembly. The variable friction assembly includes a stopper or other friction producing structure which slows or stops the spinning motion of the rotor 14. The variable friction assembly reduces the amount of time between the indication of one of the symbols 24 and the stopping of the rotor 14. Accordingly, when the rotor 14 stops spinning, each symbol designator 40 corresponds to one of the game symbols 24. In one embodiment, a ball landing detector device generates a signal upon a ball landing in a landing which results in the activation of the variable friction assembly.

If the ball 104 lands next to a symbol 24 designated by the symbol designator 40, a triggering event occurs as described above. In one embodiment, upon the occurrence of the triggering event, the system 10 deactivates or eliminates such designated symbol from the quantity of potential game outcomes or ball landings available for one or more subsequent plays 20 as described above.

In one embodiment, the triggering event is the indication of a certain symbol 24, after a spin of the rotor 14, by the ball 104 and one of the symbol designators 40. As described above, in one embodiment, the such indicated symbol 42 is removed from the quantity of potential outcomes for the subsequent play(s) 20. In another embodiment, one or more of the symbols 24 on the rotor are associated with a triggering condition that causes the subsequent play 20 to commence if such symbol(s) 24 are indicated by the ball 104.

If the ball landing availability reducer 18 is inactive (e.g., if the symbol designators 40 do not align with an indicated symbol 24 after the spin of the rotor 14), the next spin of the rotor 14 is another initial play 16. This initial play 16 requires another initial wager 28.

If the ball landing availability reducer 18 is active (e.g., if the indicated symbol aligns with one of the symbol designators 40 after the spin of the rotor 14), the next spin of the rotor 14 is a subsequent play 20 with a reduced quantity of potential ball landings or outcomes. For the subsequent play 20, the player places a subsequent wager 34 as described above.

As best illustrated in FIG. 6, the ball 104 landed on the ball landing 26 associated with the symbol "11." In one embodiment, the symbol "11" is eliminated or deactivated for the subsequent play 20. In another embodiment, one or more of the symbols 42 designated by the symbol designator 40 is eliminated or deactivated for the subsequent play 20. As illustrated, the symbols "11" and "35" are indicated as designated symbols 42 and as a result, are eliminated or deactivated for the subsequent play 20. In one embodiment, the ball landing availability reducer 18 deactivates or eliminates the symbols "11" and "35" for the subsequent play 20. That is, the symbols "11" and "35" are removed from or deactivated in the wagering layout 106 and rotor 14 for the subsequent play 20.

It should be appreciated that any suitable number of symbol designators 40 and any suitable number of designated symbols 42 can be included in this embodiment. Additionally, the alignment of one indicated symbol 24 (i.e., the symbol 24 indicated by the ball 104) with one of the symbol designators 40 can cause the system 10 to designate and eliminate: (a) a randomly selected one of the designated symbols 42, (b) the indicated symbol 24, or (c) one, a plurality of or each designated symbol 42 indicated by the symbol designators 40.

In this example, the alignment of indicated symbol "11" with one of the symbol designators 40 causes the system 10 to designate and eliminate both symbols "11" and "35" indicated by the symbol designators 40. As shown in FIG. 7, the deactivated or eliminated outcomes "11" and "35" are indicated on the wagering layout 106 as marked or illuminated wagering regions 108 and on the rotor 14 as marked or illuminated symbols. In one embodiment, each wagering region 108, symbol 24 and/or ball landing 26 that corresponds to a designated symbol 42 is deactivated, eliminated or removed from the game 12 prior to a first spin of the rotor 14 in the subsequent play 20. It should be appreciated that the elimination of the outcomes on the rotor and/or on the wagering layout may be indicated or marked in any suitable manner, such as with a physical blocker as described above or through illumination or shading. In one embodiment described above, the dealer disregards any eliminated outcomes and there is no need to mark or indicate the eliminated outcomes on the rotor, though eliminated outcomes may be marked on the wagering layout or identified and displayed using suitable markers other means.

By deactivating or eliminating the symbols or numbers "11" and "35" for the subsequent play 20, players have a distinct advantage of betting upon and selecting one of the remaining thirty-six potential outcomes in the game 12 and have a possible advantage for wagering upon certain bets which cover two or more outcomes. For example, the designated numbers "11" and "35" are each BLACK, ODD and listed in the second column of the wagering layout 106.

During the subsequent play 20, based on the designated numbers of "11" and "35," players have an advantage to place subsequent wagers 34 on RED, EVEN, the first column and the third column game outcomes. Subsequent wagers 34 on specific symbols or individual numbers 24 or sets of symbols or numbers which do not include the symbols "11" and "35" would also provide the player with a higher win probability. That is, the symbols 24 corresponding to RED, EVEN, the first column and the third column have a greater chance of occurring in the reduced quantity of potential game outcomes 36 of the subsequent play 20 as compared to the starting quantity of potential game outcomes 30 of the initial play 16. For example, in the starting quantity of potential game outcomes 30 of the initial play 16 shown in FIG. 6, the odds that a spin of the rotor 14 will result in a RED outcome is 18/38. With the symbols "11" and "35" being eliminated for the subsequent play 20, the odds that a spin of the rotor will result in a RED outcome is increased to 18/36 in FIG. 7.

Prior to beginning the subsequent play 20, the dealer resolves the initial wagers 28 for the initial play 16 based on the initial paytable 32. Once the dealer resolves the initial wagers 28, the dealer deactivates or eliminates the initial game outcomes corresponding to the symbols "11" and "35" for the subsequent play 20. The dealer deactivates the symbols "11" and "35" from the game 12 prior to the first spin of the rotor 14 in the subsequent play 20.

In accordance with the game logic 22, prior to the first spin in the subsequent play 20, the dealer enables the players to place subsequent wagers 34 on the first spin in the subsequent play 20. In one embodiment, the dealer limits the subsequent wagers to an amount no greater than the amount of the initial wager 28 wagered on the previous spin which initiated the subsequent play 20. In one embodiment of a multiplayer game 12, the dealer prevents new players from joining the game 12 while in the subsequent play 20.

In the illustrated embodiment of FIGS. 6 and 7, the dealer ends the subsequent play 20 when a spin of the rotor 14 results in the indicated symbol (i.e., as indicated by the ball 104) not aligning with one of the symbol designators 40. In another embodiment, the dealer continues the subsequent play 20 for a predetermined or randomly determined number of spins of the rotor 14. When the subsequent play 20 ends, the dealer resolves any subsequent wagers 34 based on the subsequent paytable 38.

In one embodiment, if the ball 104 indicates a symbol 24 and that symbol 24 aligns with one of the symbol designators 40, that specific symbols 24 to be eliminated or deactivated for the subsequent play 20 are determined either (1) randomly or (2) based on an association with the indicated symbol. In one embodiment, at least one other symbol 24 is eliminated or deactivated based on an association with the indicated symbol 24. In one embodiment, the association includes being the same color or being in the same set or group of symbols. For example, if symbol "11" is deactivated or eliminated for the subsequent play, at least one other symbol 24 having the same color (e.g., RED) or being in the same group (e.g., 1 to 18, first column, or ODD) as symbol "11" is also deactivated or eliminated for the subsequent play.

In one embodiment, the symbols 24 that are to be eliminated or deactivated are selected based on their impact if the player were to make the same wager (in amount and the specific symbols 24 or sets of symbols 24). For example, if a player wagered on BLACK in the initial play 16, one or more of the RED symbols could be eliminated or deactivated so that if the player makes the same wager (i.e., rebets the player's exact prior wager), the eliminated symbols positively affect the player's wager for the subsequent play.

In one embodiment, the system 10 enables the player to accept or reject the symbols 24 to be eliminated or deactivated. The symbols 24 to be eliminated or deactivated can be provided to the player in the form of an offer. If the player accepts the offered symbols 24, then those symbols 24 are eliminated or deactivated for the subsequent play. However, if the player rejects those offered symbols 24, the system 10 provides the player with another symbol or set of symbols 24 to be eliminated or deactivated. In one such embodiment, the system enables the player to accept or reject an offered symbol or set of symbols a predetermined number of times, such as four, for a designated triggering event. For the fourth offer, in this embodiment, the system 10 forces the player to accept the offered symbol or set of symbols. For example, if the player rejects an offered symbol for a third time, the system 10 automatically makes the fourth offered symbol the final offer, and causes the fourth offered symbol to be eliminated or deactivated for the subsequent play.

Figure 8:
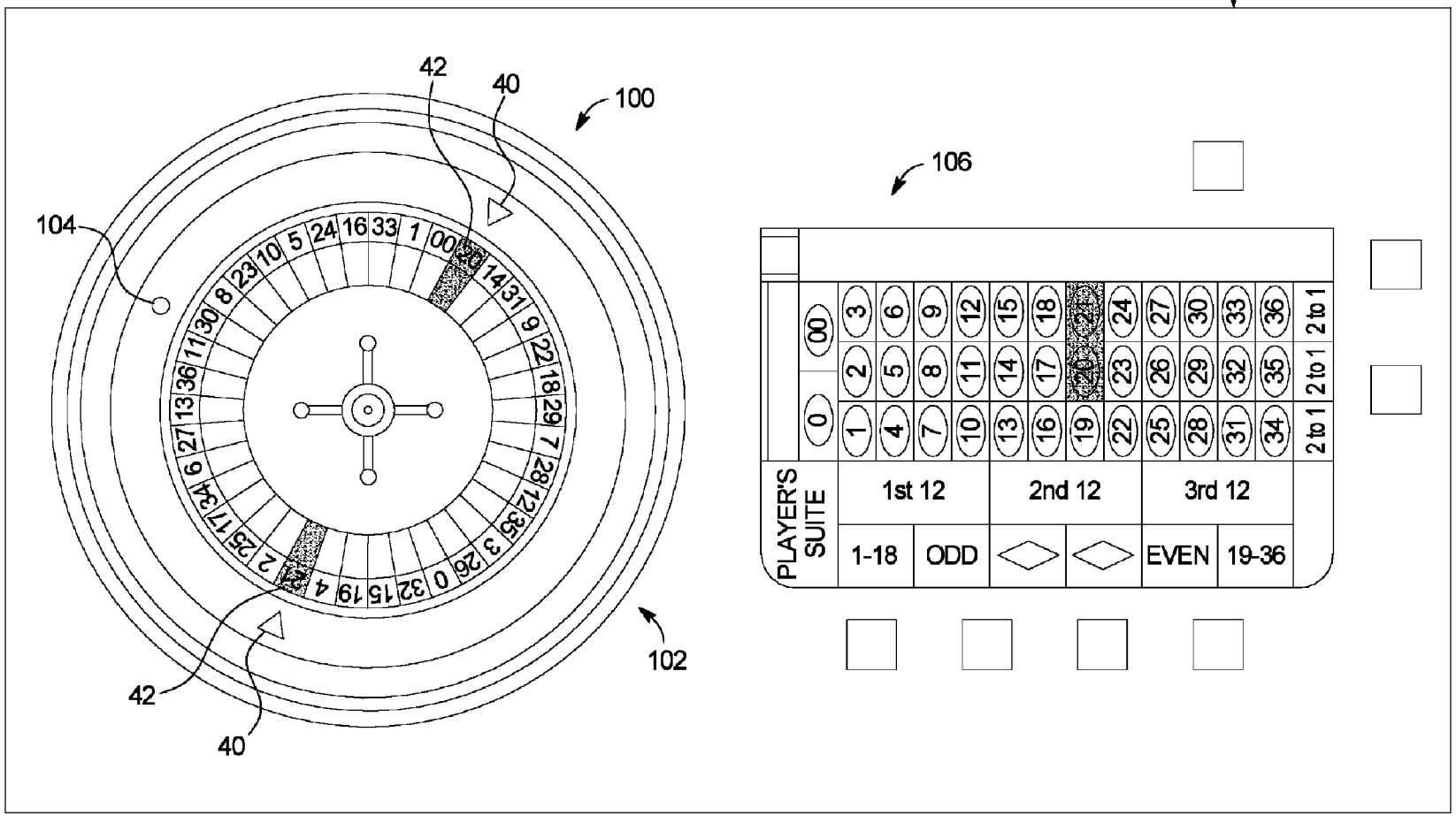
FIG. 8 is a top view of one embodiment of the game system, the game system shown during a second or subsequent play of the rotor-based game.

In one example illustrated in FIG. 8, the subsequent play 20 results in the designation of a designated number 42. That is, the symbol designator 40 indicates such designated number 42 in the subsequent play 20. The dealer then replaces the numbers 42 identified in a first spin of the rotor 14 with the numbers identified in a second spin of the rotor 14. In the illustrated example, the numbers "11" and "35" which were deactivated for the first spin of the rotor 14 (as shown in FIG. 7) are rejoined with the reduced quantity of potential game outcomes 36 for the subsequent play 20. The numbers "20" and "21" which were identified in the second spin of the rotor 14 (shown in FIG. 8) are removed from the reduced quantity of potential game outcomes 36 for the next spin of the rotor 14 in the subsequent play 20.

Figure 9:
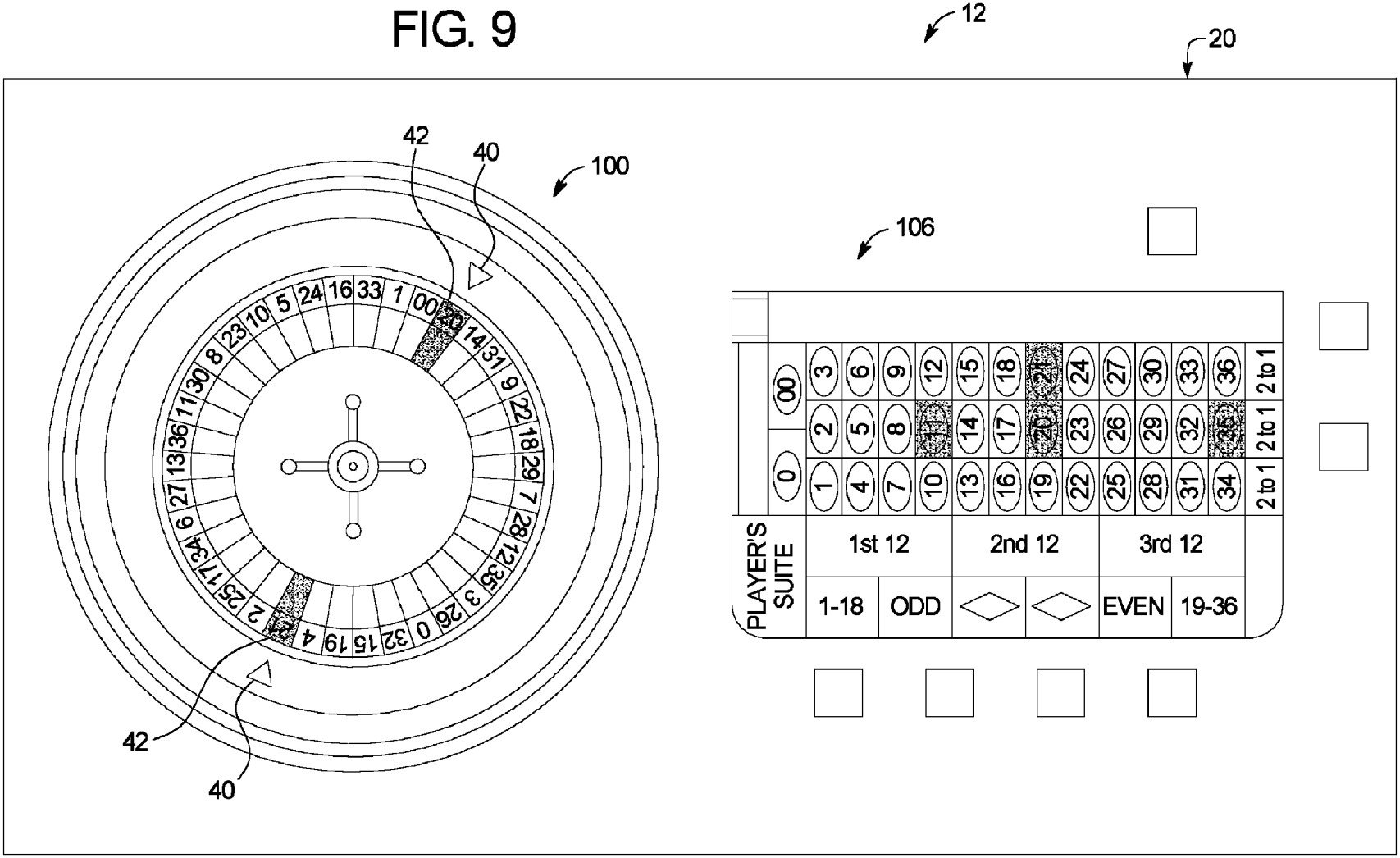
FIG. 9 is a top view of one embodiment of the game system, the game system shown during a second or subsequent play of the rotor-based game.

In another such embodiment illustrated in FIG. 9, the numbers 42 identified in a first spin of the rotor 14 may be added to the numbers 42 identified in a second spin of the rotor 14. That is, the dealer removes the numbers "11" and "35" identified in the first spin of the rotor 14 (and shown deactivated in FIG. 7) and the numbers "20" and "21" identified in the second spin of the rotor 14 (shown in FIG. 9) for the next spin of the rotor 14 in the subsequent play 20.

In another embodiment of the game 12, a designated game outcome or symbol 24 may disable one of the symbol designators 40 and/or one of the designated numbers 42. For example, a duplicated or repeat identification of number 24 by one of the symbol designators 40 may place that symbol designator in a disabled state. In one such embodiment, the disabled symbol designator 40 and/or designated number 42 remains in the disabled state until a spin of the rotor 14 results in an end of the subsequent play 20. When the subsequent play 20 ends, any symbol designator 40 and/or any designated number 42 that is in a disabled state is thus reactivated for the next spin of the rotor 14 in the initial play 16. By disabling the symbol designator 40 and/or the designated numbers 42, the dealer and/or the game implementer can control the length of the subsequent play 20.

In one embodiment, the game logic 22 enables one, each or all of the players to select which symbols 24 are to be eliminated from a subsequent play 20. In another embodiment, the game logic 22 enables one, each or all of the player to select a characteristic or pattern associated with the identification of symbols 24 wherein the identified symbols 42 can be re-identified until the player is satisfied with the identified symbols 42.

In one embodiment, the rotor includes at least one triggering symbol and a ball landing adjacent to the triggering symbol. The triggering symbol and adjacent ball landing constitute an additional game outcome that, in this embodiment, is not included on the rotor 14 described above. If the ball or indicator lands in the ball landing and the ball landing subsequently stops adjacent to the triggering symbol, one or more subsequent plays 20 are initiated. For the subsequent play(s) 20, a ball landing availability reducer 18 as described above can determine how many of the symbols or ball landings are deactivated, eliminated or removed from the subsequent play 20. The ball landing availability reducer 18 or another suitable device associated with the reducer 18 can also determine which of the symbols or ball landings to deactivate, eliminate or remove for the subsequent play(s) 20. In one embodiment, the number of the symbols or ball landings that are deactivated, and which symbols and/or ball landings that are activated are randomly determined, predetermined, player determined or dealer determined. For example, prior to the initiation of the subsequent play(s) 20, an output device, such as the number determiner and indicator described above or any other suitable device(s), determines how many and which of the symbols and ball landings to deactivate, eliminate or remove for the subsequent play(s) 20.

In another embodiment, the triggering event is an additional or secondary wager made by one of the players. In this embodiment, a player places an additional wager on the wagering layout 106 to qualify for the subsequent play 20. For example, the player places a wager on the wagering layout in an attempt to bet on the ball 104 landing on any select symbol 24 which will be designated by the symbol designators 40 after a spin of the rotor 14. If the player guesses correctly, the subsequent play 20 commences and one or all of the indicated symbols 42 designated by the symbol designators 40 are removed from the initial quantity potential game outcomes 30 to produce a reduced quantity of potential game outcomes 36 for the subsequent play 20.

In one embodiment, a player can end the player's gaming session while one or more subsequent plays 20 are available and resume the one or more subsequent plays 20 in a later gaming session. In one such embodiment, the game system 10 identifies the player through a suitable player identification device, such as a password, pin number or through a suitable player tracking system. Upon verification of the player's identity, the game system 10 enables the player to end one game session, where the player's progress is stored in association with the game system 10, and resume that gaming session at a later time.

Mechanical and Electro-Mechanical Embodiments

Figure 10:
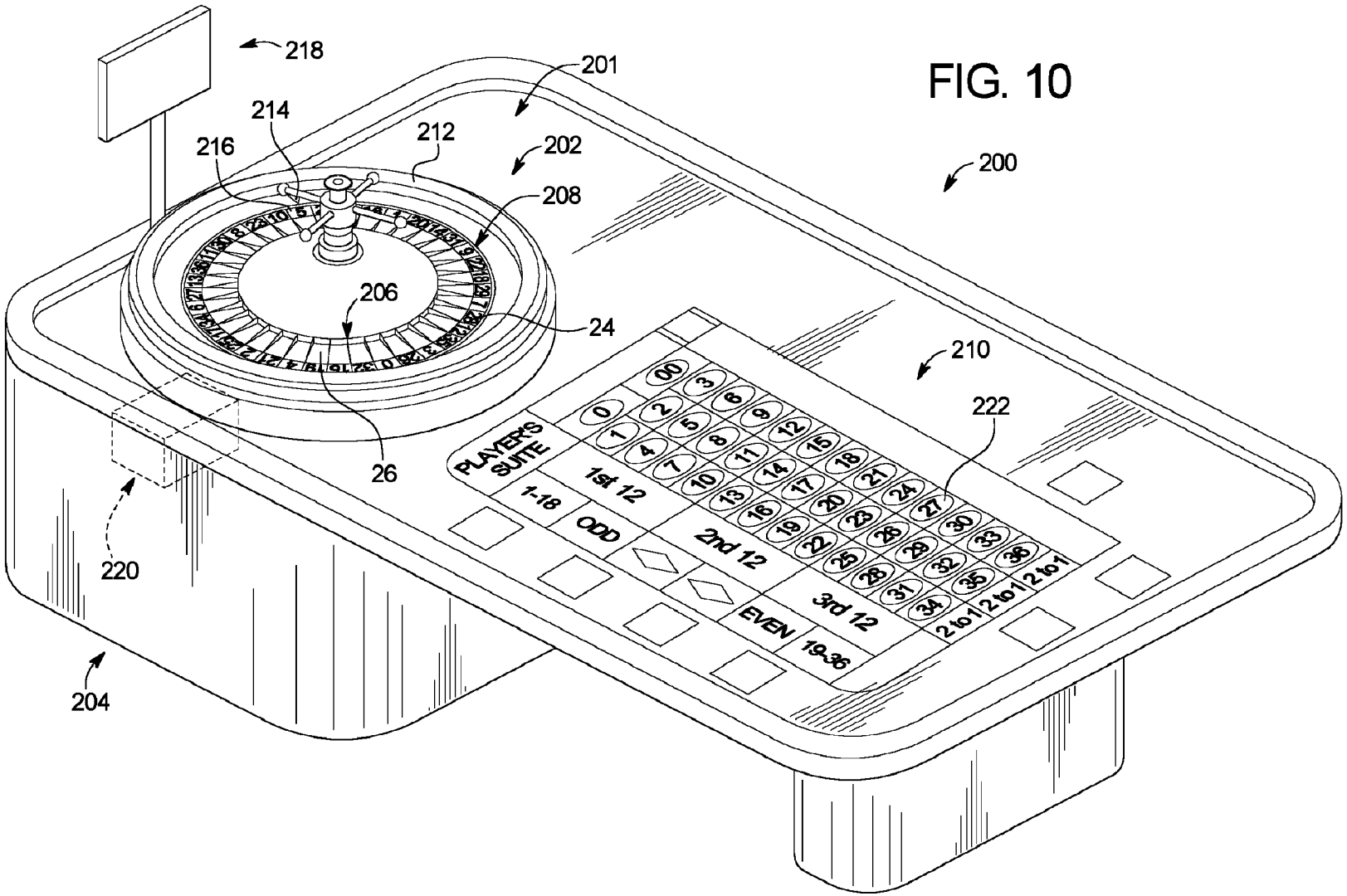
FIG. 10 is a perspective view of one embodiment of a game system.
Figure 11:
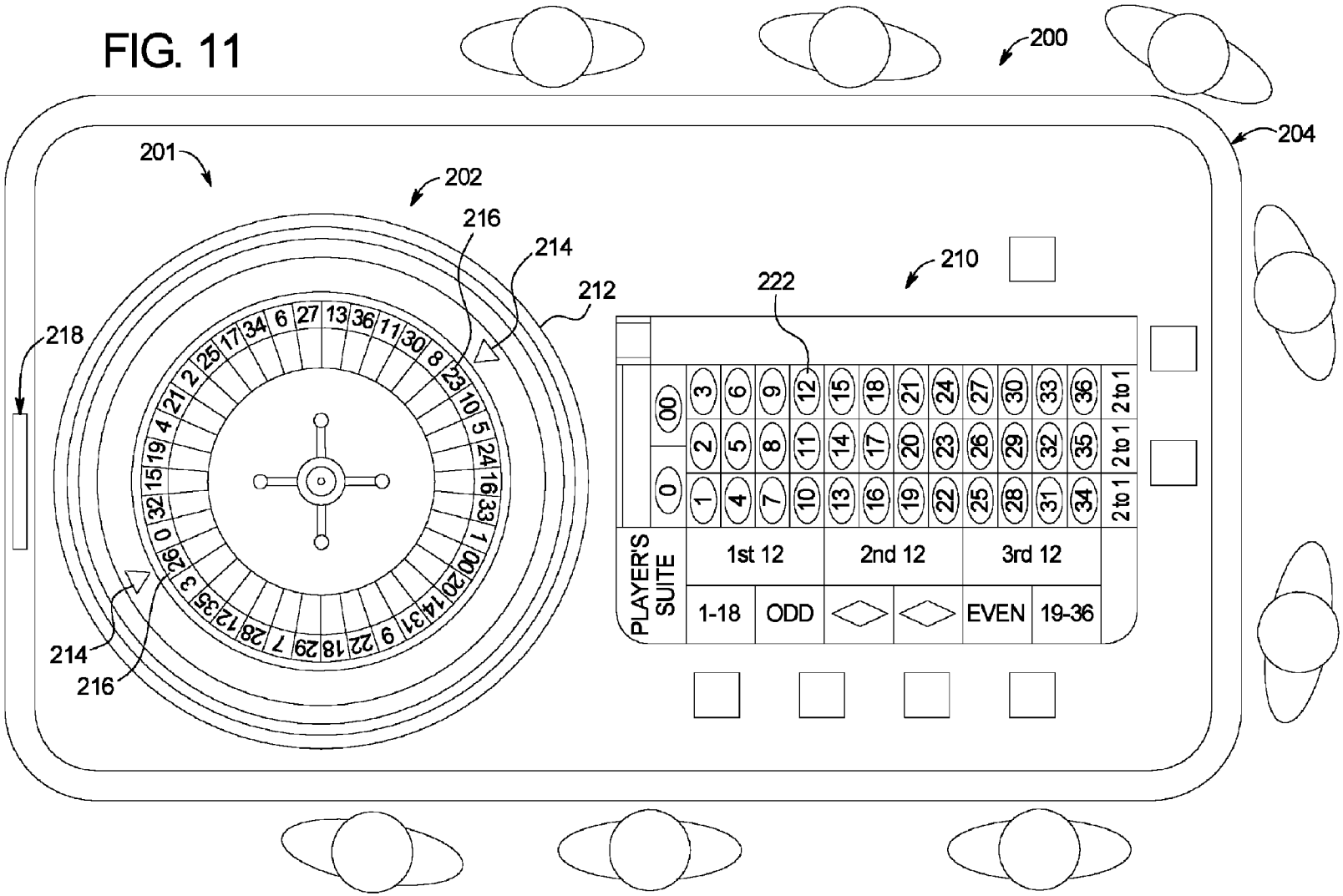
FIG. 11 is a top view of the game system of FIG. 10 shown during a first or initial play of the rotor-based game.
Figure 12:
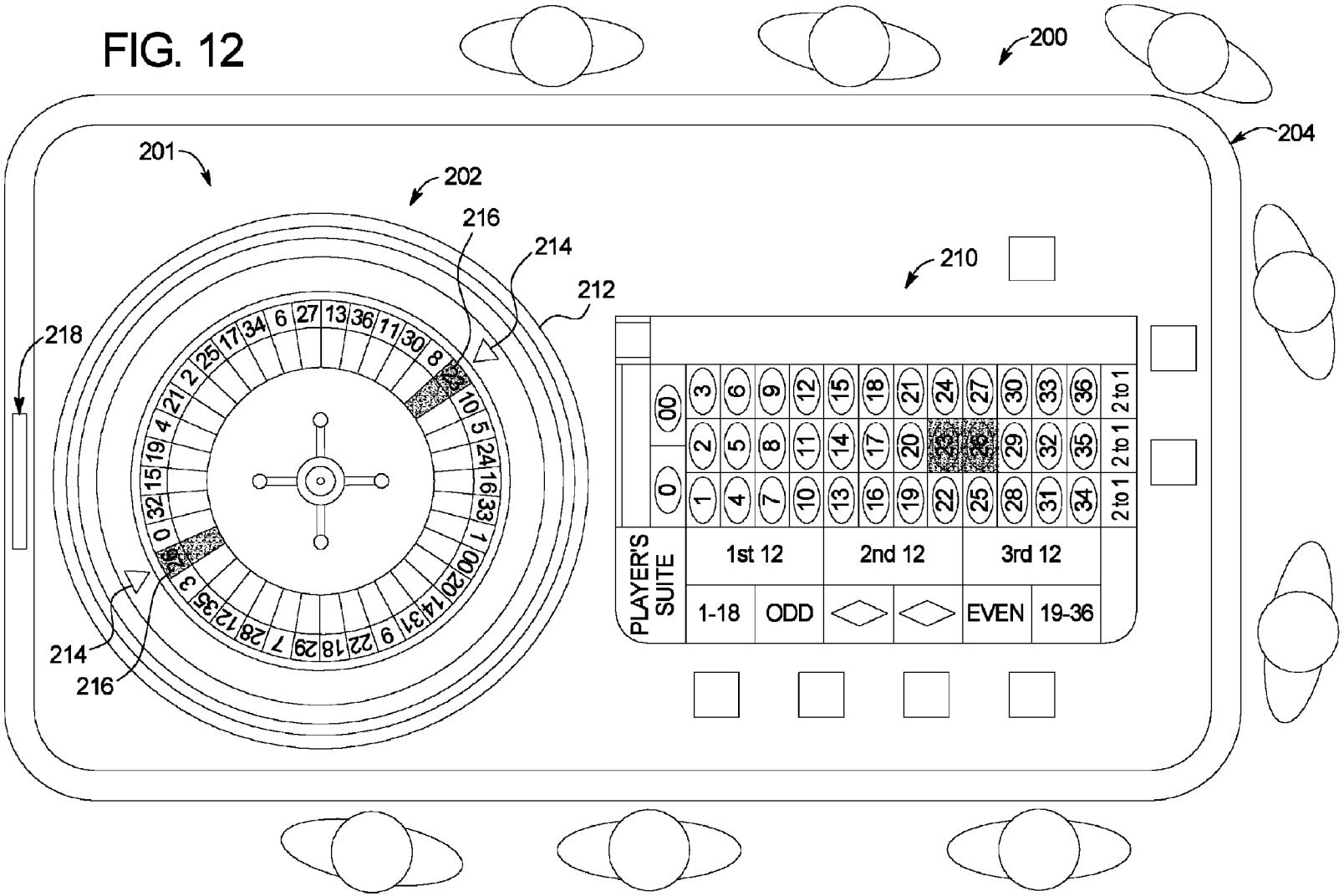
FIG. 12 is a top view of the game system of FIG. 10 shown during a second or subsequent play of the rotor-based game.

Referring to FIGS. 10, 11 and 12, one embodiment of the rotor-based game system 10 is embodied in a gaming device 200 in a mechanical form. The gaming device 200 includes a Roulette-wheel assembly 201 having a rotor 202. The Roulette-wheel assembly 201 is supported by support structure 204 in the form of a gaming table or other suitable support. In one embodiment, the rotor 202 includes: (a) an inner circular section 206 which carries a series of game landings 26 and (b) an outer circular section 208 which encircles the inner circular section 206 and which includes a plurality of game symbols 24. In one embodiment, each game landing 26 is aligned with a game symbol 24. Because, in one such embodiment, the inner circular section 206 and outer circular section 208 are formed as part of the same rotor 202, the sections 206 and 208 do not move relative to one another. One or more players can wager on which game symbol 24 and game landing 26 will be indicated on each spin of the rotor 202 via a wagering layout 210.

The Roulette-wheel assembly 202 also includes a rotor support or bowl 212. The rotor support 212 is supported by the support structure 204 and operatively supports the rotor 202 so that the rotor 202 rotates relative to the rotor support 212 in operation. In this embodiment, the rotor support 212 includes a symbol designator 214 that is operable to designate one of the symbols 24 as a designated symbol 216.

In one embodiment, the rotor 202 includes one or more detectors or landing sensors (not shown), which are operable to automatically sense whether the ball has landed in a game landing 26. The landing sensors can include any suitable sensing apparatus which generates a signal when the ball lands in a landing, including, but not limited to, a light sensor, a motion detector and a pressure sensor.

The landing of a ball on a game landing 26 results in a game outcome associated with the bets placed on the wagering layout 210. In this embodiment, the wagering layout 210 includes a template that specifies a grid of numbers and betting options. The numbers in the grid correspond to the numbers in the rotor 202. The players place their betting markers or chips on desired locations on the wagering layout 210 in the manner described above, where each said location corresponds to one or more specific numbers and, whose corresponding payout is based upon the count of numbers covered by such location.

As illustrated, an indicator 218 is operatively coupled to the rotor 202. The indicator 218 is operable to indicate a determined number of outcomes or a designated symbol associated with the outcomes. The indicator 218 is described in greater detail below with reference to FIG. 16.

A chip router 220 illustrated in FIG. 10 may be located underneath the wagering station 210 to direct chips or tokens from the top of the wagering station 210 to a designated location or player. The chip router 220 is described in greater detail below with reference to FIG. 19.

In this embodiment, the wagering station 210 is accessible by a plurality of players simultaneously. As shown in FIGS. 10 and 11, the players may stand or sit adjacent to the rotor 202 and/or the wagering station 210. Players place wagers on various wagering areas associated with the wagering station 210. A human dealer controls the operation of the rotor 202 for the operation of the system 10 described above. It should be appreciated that the wagering options, the operation of the rotor and the outcome elimination can be facilitated by a human or computerized dealer in accordance with the game logic 22 as described above with reference to FIG. 1.

As illustrated in FIGS. 10, 11 and 12, the wagering layout 210 includes a plurality of wagering regions 222. In this embodiment, the wagering regions 222 constitute a template of a grid of numbers and betting options. To play the rotor-based game, one or more players place wagers on at least one wagering region 222 of the wagering layout 210. The wagering layout 210 indicates any placed wagers on the one or more wagering regions 222 with a suitable marker, such as at least one chip or token having a designated or desired denomination. In one embodiment, for each play 16 and 20, each player can control the risk and potential award levels by selecting one or more of the wagering regions 222 and a wager denomination.

Referring to FIGS. 1, 10 and 11, the dealer initiates a initial play 16 of the gaming device 200 after the placement of one or more initial wagers on the wagering layout 210. In the initial play, the starting quantity of potential game outcomes 30 are possible and wagering is conducted based on the initial paytable 32. The wagering layout 210 includes at least one wagering region 222 for each possible outcome in the starting quantity of outcomes 30. As illustrated, the starting quantity of outcomes 30 includes numbers ranging from 1 to 36, 0 and 00. Upon the placement of one or more initial wagers 28, the dealer spins the rotor 202 and the indicator or ball 104 as described above for the initial play 16. When the ball 104 stops traveling, the ball 104 identifies or indicates an outcome of the rotor spin (i.e., one of the symbols 24 and the associated ball landing 26 on the rotor 14) for the initial play 16. If the indicated outcome corresponds to a winning outcome (i.e., matches an outcome wagered on by the player), the dealer provides an award to the player based on the placed initial wagers 28 in accordance with the initial paytable 32, as described above in reference to FIG. 1.

The initial play 16 of FIGS. 10 and 11 continues until a suitable triggering event occurs in the initial play 16. Upon the occurrence of the triggering event, the subsequent play 20 of FIG. 12 begins. As illustrated, the triggering event includes an indicated ball landing or outcome (i.e., the ball landing 26 that the ball 104 landed on in the initial play 16) aligning with one of the symbol designators 214. In the example illustrated in FIG. 11, the identified or designated symbol 216 is symbol "23." As best illustrated in FIG. 12, the identified symbol 216 is deactivated or eliminated from the starting quantity of potential game outcomes displayed by the rotor 202. That is, the quantity of potential game outcomes is reduced to include the numbers ranging from 1 to 22, 24 to 36, 0 and 00 for the subsequent play 20 shown in FIG. 12. The symbol "23" is deactivated or eliminated from the rotor 202 and the wagering layout 210 for the subsequent play 20. In one embodiment, each symbol designator 214 identifies which symbols will be deactivated or eliminated from the starting quantity of potential game outcomes if the subsequent play 20 is activated or initiated. In this embodiment, the symbols identified by the symbol designators 214 in FIG. 11 (e.g., symbols "23" and "26") would be eliminated or deactivated for the subsequent play.

Referring to FIGS. 10 and 11, in one embodiment, the subsequent play 20 is triggered upon the indication of a symbol 24 after a spin of the rotor 202 if such symbol 24 aligns with one of the symbol designators 214 depicted on the support 212. As described above, the identified symbol 216 is removed from play for the subsequent play 20. In another embodiment, one of the symbols 24 and ball landings 26 on the rotor 202 are associated with a triggering symbol that causes the subsequent play 20 to commence.

The dealer determines whether the subsequent play is activated or not during a spin of the rotor in the initial play. If the subsequent play is not activated, or if the symbol designators 214 do not designate a certain symbol 24 after the spin of the rotor 202, the next spin of the rotor 202 is part of the initial play 16 illustrated in FIG. 11. As illustrated, the starting quantity of potential game outcomes includes numbers ranging from 1 to 36, 0 and 00.

If the subsequent play is activated, each symbol designator 214 identifies one of the symbols 24 as a designated symbol 216. As described above, either or both of the designated symbols 216 can be eliminated or deactivated depending upon the embodiment. As illustrated in FIG. 12, the symbols "23" and "26" correspond to the identified symbols 216 and the dealer removes, eliminates or blocks those potential symbols for subsequent spins of the subsequent play 20. As shown in FIG. 12, the dealer eliminates the wagering regions 222 associated with the deactivated or eliminated symbols "23" and "26" from the wagering layout 210 in subsequent spins of the rotor 204 during the subsequent play 20.

In the example illustrated in FIG. 12, the dealer has indicated the deactivated or eliminated symbols "23" and "26" as marked or illuminated wagering regions 108 on the wagering layout 106. The dealer has indicated the deactivated or eliminated symbols "23" and "26" as marked or illuminated symbols on the rotor 14. In one embodiment, each wagering region 222, symbol 24 and/or ball landing 26 that corresponds to a designated symbol 216 is disabled, eliminated or removed from the game prior to a first spin of the rotor 202 in the subsequent play 20. It should be appreciated that the dealer may indicate these deactivated or eliminated symbols or outcomes in any suitable manner. In one embodiment, the dealer disregards any deactivated or eliminated symbols or outcomes in subsequent spins and does not mark or indicate the deactivated or eliminated symbols or outcomes. For example, if the indicator lands on the ball landing 26 associated with the symbol "23" in a second spin of the subsequent play, the dealer spins the rotor 202 again with all subsequent wagers standing. In another embodiment, the dealer provides one or more players an award based on the subsequent pay table relative to the total player wagers.

By eliminating the symbols "23" and "26" from the subsequent play 20, players have a higher probability of obtaining the remaining thirty-six potential symbols or outcomes in the subsequent play 20. For example, the symbols "23" and "26" are each listed in the second column of the wagering layout 210. If the symbols "23" and "26" are eliminated or deactivated during the subsequent play 20, players have a higher probability of winning by placing subsequent wagers on the first column and the third column game outcomes. Subsequent wagers on specific symbols 24 or individual numbers or sets of symbols or numbers which do not include the symbols "23" and "26" would have a higher probability of occurring in the subsequent play than in the initial play. That is, the symbols 24 corresponding to the first column and the third column have a greater chance of occurring in the remaining thirty-six potential game outcomes of the subsequent play 20 as compared to the initial thirty-eight potential game outcomes of the initial play 16. For example, in the initial play 16 shown in FIG. 11, the odds that a spin of the rotor 14 will result in a first column outcome is 12/38. With the symbols "23" and "26" being eliminated for the subsequent play 20, the odds that a spin of the rotor will result in a first column outcome is increased to 12/36 in FIG. 12.

Referring back to FIG. 11, the one or more designated symbols 216 were designated as the result of the spin in the initial play 16. The next spin of the rotor 202, as illustrated in FIG. 12, is deemed part of the subsequent play 20. Prior to beginning the subsequent play 20, the dealer resolves the initial wagers for the initial play 16 based on the initial paytable. Once the dealer resolves the initial wagers, the dealer eliminates the initial game outcomes corresponding to the designated symbols 216 from the game. The dealer eliminates the designated symbols 216 from the game prior to the first spin of the rotor 202 in the subsequent play 20. In accordance with the game logic 22, prior to the first spin in the subsequent play 20, the dealer enables players to place subsequent wagers on the first spin in the subsequent play 20. In one embodiment, the subsequent wagers are limited to an amount no greater than the amount of the initial wager wagered on the previous spin which initiated the designated numbers 216. In one embodiment of a multiplayer game, the dealer prevents new players from joining the game while in the subsequent play 20.

In the illustrated embodiment of FIGS. 11 and 12, the subsequent play 20 ends when a spin of the rotor 14 results in no identification of any symbols by the symbol designators 214. In another embodiment, the subsequent play 20 continues for a predetermined or randomly determined number of spins of the rotor 202 after such event occurs. When the subsequent play 20 ends, the dealer resolves any subsequent wagers based on the subsequent paytable as described above.

Figure 13:
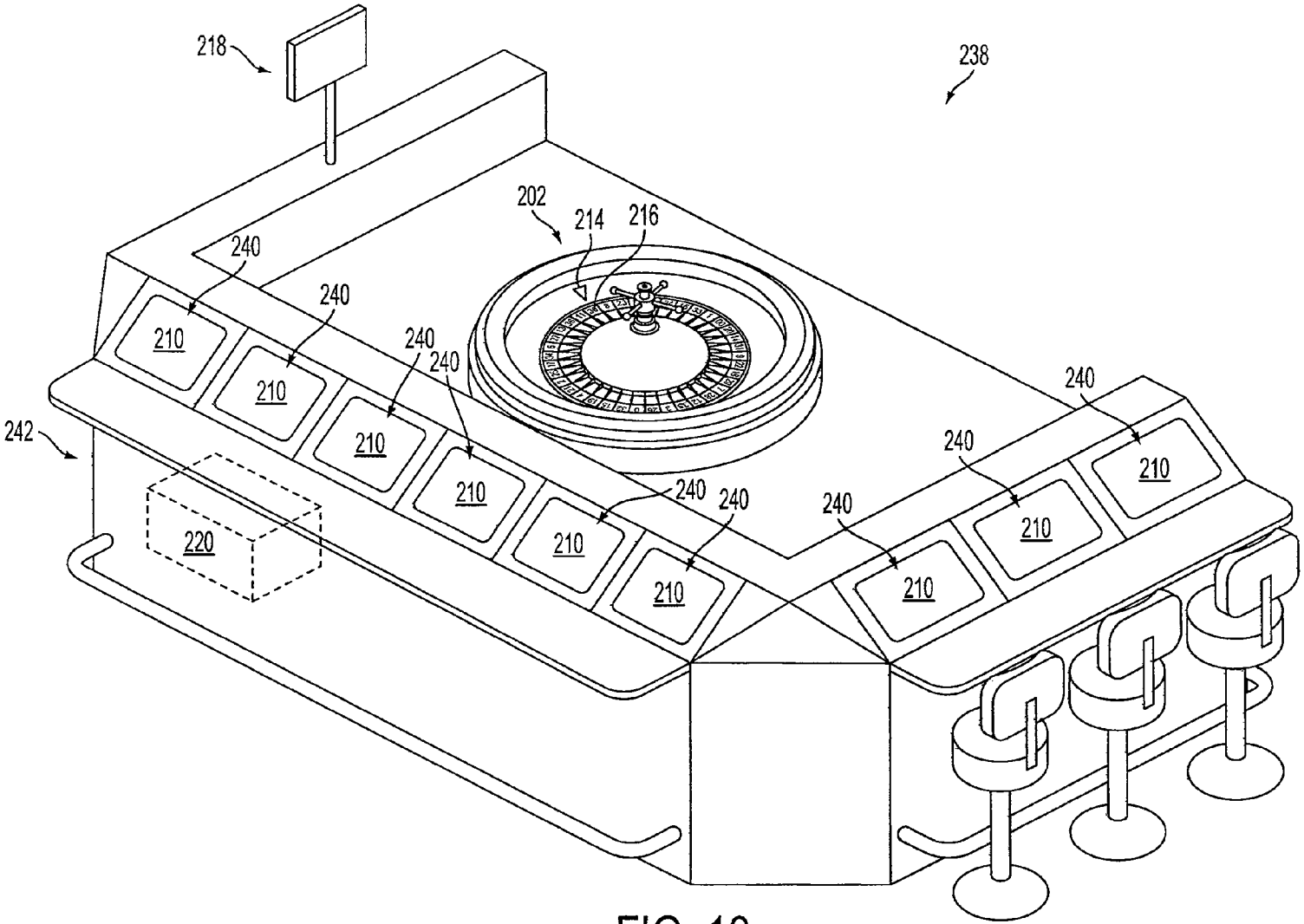
FIG. 13 is a perspective view of one embodiment of a game system.
Figure 14:
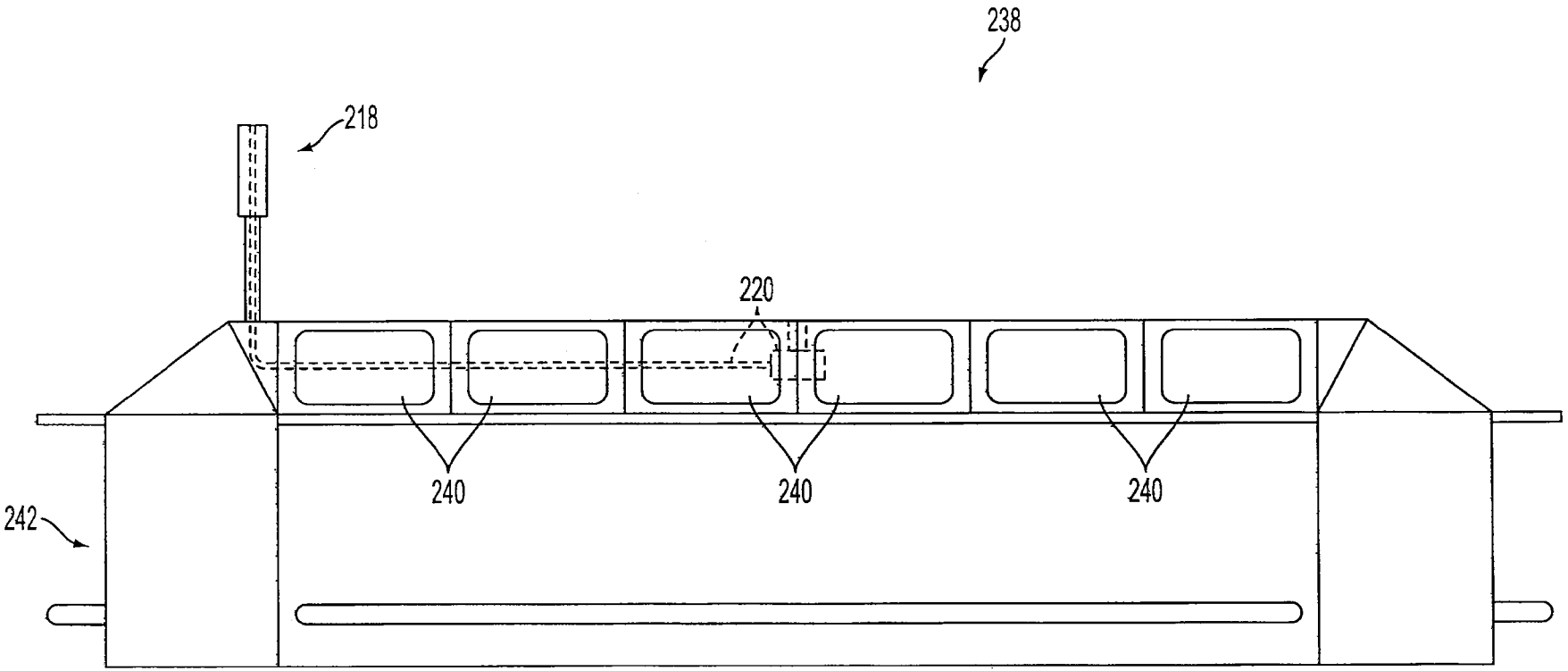
FIG. 14 is a side elevation and diagrammatic view of the game system of FIG. 13.

In another embodiment illustrated in FIGS. 13 and 14, the game system 10 is embodied in an electromechanical gaming device 238. The gaming device 238 includes the mechanical rotor 202 described above and a plurality of display devices 240 that, when activated, display the a computer-generation of the game 12 and wager layout 210 described above. The plurality of display devices 240 are supported by a support structure 242, which may enable one or more players to view and operate the display devices 240. Each graphical wagering station or layout displays the game 12 and enables a player to select desired numbers 24 and betting combinations for their wagers. In one embodiment, both a standard table layout and computer-generated wagering stations can share the same rotor 202. In each such embodiment, after the players have placed their bets, a croupier or dealer operates the rotor 202 to implement the system 10 described above.

Figure 15:
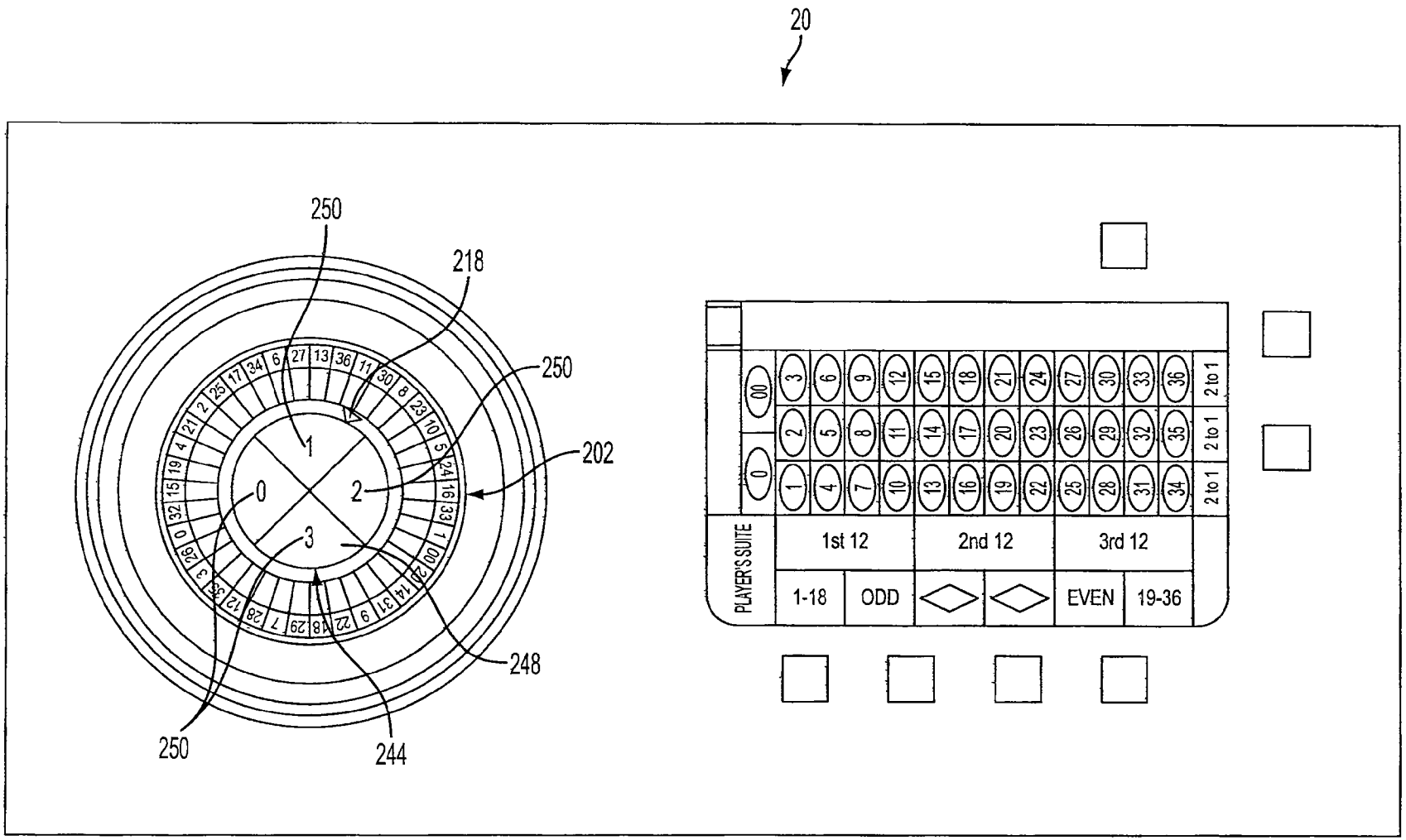
FIG. 15 is a top view of one embodiment of the game system showing a one embodiment of a number determiner and an indicator.

Referring to FIG. 15, in one embodiment, the gaming device 200*a* includes the rotor 202, number determiner 244 and indicator 218 mentioned above. In this embodiment, the rotor 202 is coupled to the number determiner 244 so that, when the rotor 202 spins, the number determiner 244 also spins. The number determiner 244 is operable to determine a number 246. As illustrated, the number determiner 244 is a spinner separated into a plurality of different segments 248. Each segment 248 includes a plurality of numbers 250, such as numbers "0", "1", "2", and "3". In one embodiment, the size, quantity or another suitable characteristic of the segments 248 indicates the likelihood of the numbers 250 associated with those segments 248 to be indicated. The numbers 250 represent the number of potential outcomes to be removed from the starting quantity of potential game outcomes in the initial play to form the reduced quantity of potential game outcomes in the subsequent play.

In this embodiment, the indicator 218 is in the form of a pointer or arrow. The indicator 218 indicates which of the numbers 250 is selected or designated as the designated number 246. As the rotor 202 spins in a first direction, the number determiner 244 spins in the opposite direction. When the rotor 202 stops, the number determiner 244 also stops. The indicator 218 determines or identifies the number 246, in this example, when the number determiner 244 stops spinning. In this embodiment, the number determiner 244 determines how many potential game outcomes are to be removed from the starting quantity of potential game outcomes. In this example, the system 10 will decrease the number of potential outcomes for the subsequent play by one. Depending upon the embodiment, the potential game outcomes can be removed from the starting quantity of potential game outcomes through a random determination, dealer determination, player determination, based on wager amount or based on any other suitable factor. The identified number 246 is indicated by the indicator 218 during the initial play 16.

In another embodiment, the number determiner 244 indicates the number of potential game outcomes to be removed from the starting quantity of potential game outcomes. The indicated number can range from 1 to N numbers. In this embodiment, the indicated number is determined and indicated after an independent triggering event, as described above, occurs or is fulfilled in the initial play 16. In one embodiment, the number determiner device is also the display device for this number. For example, a pegged wheel with flipper, such as is used for Money Wheel games, could be used. A wheel with number values within each section is spun with an arbitrary amount of number values indicated by a human dealer or by a suitable mechanical or electro-mechanical device. The number to be eliminated is indicated by a sole flipper mechanism on the edge of the wheel which indicates a section of the wheel which, in turn, indicates the number indicated on such section.

It should be appreciated that numerous methods or devices may be employed to select outcomes to be disabled or eliminated once the number of outcomes to be disabled or eliminated has been specified. In one embodiment, for a given number K of outcomes to be disabled or eliminated, such outcomes can be the K−1 neighbors of the outcome in which the ball last landed. In another embodiment, for each possible number K of outcomes to be disabled, there can be defined a pattern of outcomes to be disabled or eliminated relative to a first outcome to disabled or eliminated. In one embodiment, such first outcome can be defined to be the outcome in which the ball last landed. In another embodiment, the first outcome can be defined to be that outcome which aligns with a special mark or indicator adjacent to the rotor. In another embodiment, N indicators adjacent to the rotor may be present, where N is greater than or equal to K, where K of these indicators are illuminated or otherwise signal that the outcomes adjacent to such lighted indicators are the outcomes to be disabled or eliminated in the subsequent spin.

Figure 16:
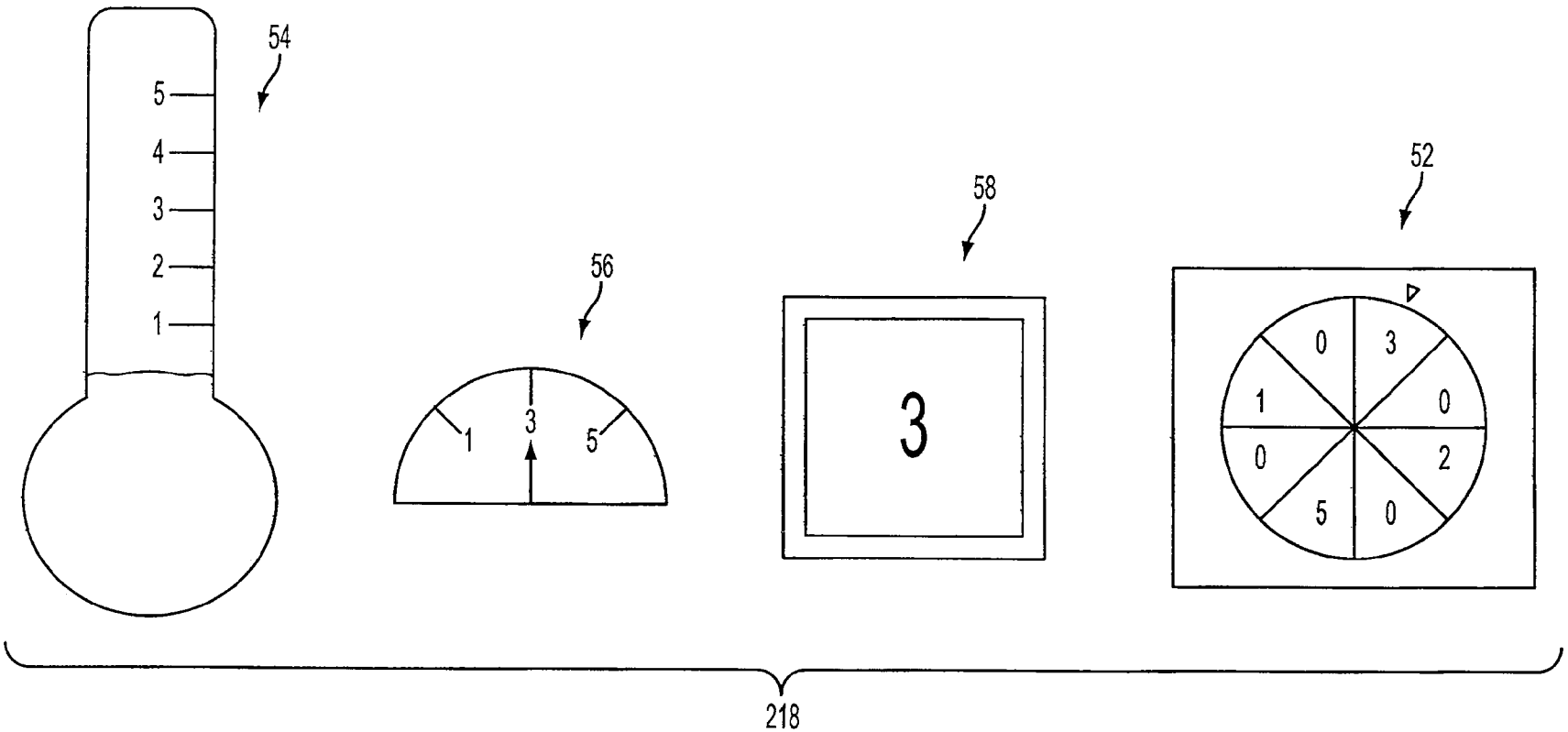
FIG. 16 is a front view of different example indicators for one embodiment of the game system.

As best illustrated in FIG. 16, different examples of indicators 218 include a spinner 52, a meter 54, a dial 56, and a visual output device 58, such as a light-emitting device (LED) or liquid crystal display (LCD). As illustrated, the different example indicators 218 are operable to indicate the determined number 46 determined by the number determiner 244. In one embodiment, the indicator 218 includes any other suitable device.

Figure 17:
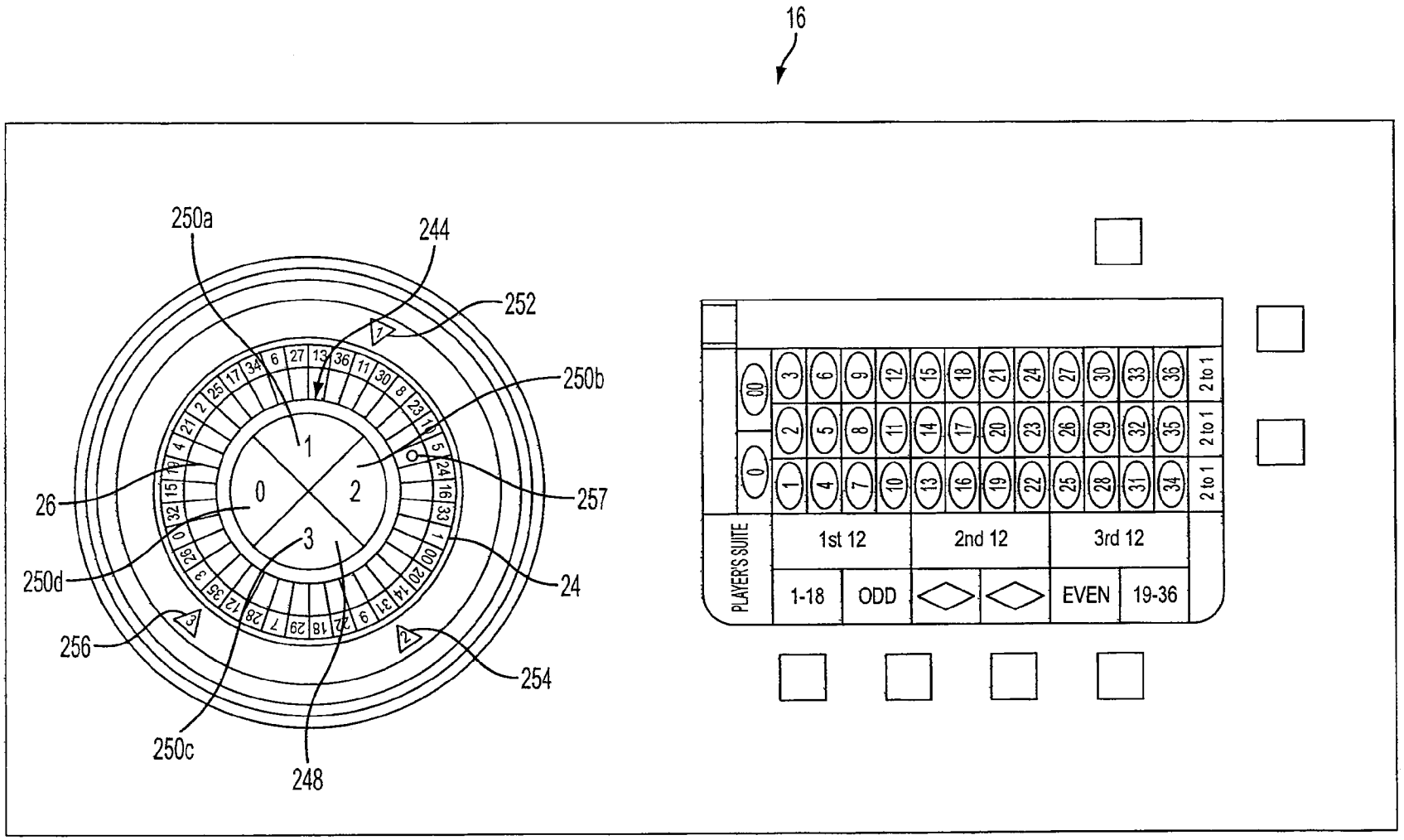
FIG. 17 is a top view of one embodiment of the game system showing a one embodiment of a number determiner and an indicator.

As best illustrated in FIG. 17, in an alternative embodiment, the number determiner 244 includes a plurality of numbers 250*a*, 250*b*, 250*c* and 250*d*. The number determiner 244 is associated with a plurality of pointers or markers 252, 254 and 256. One of the numbers 250*a*, 250*b*, 250*c* and 250*d* is indicated when an indicator or ball 257 indicates one of the ball landings 26 and symbols 24. The indicated number, which is 250*b* in this example, determines how many outcomes to be eliminated from the game. In this example, the indicated number 250*b* is associated with the numeral "2", which indicates that two outcomes are eliminated for the subsequent play of the game. Depending upon the embodiment, the two outcomes can be selected in any suitable manner. For example, in one embodiment, two of the symbols 24 are randomly determined to be eliminated for the subsequent play of the game. In another embodiment, a first pointer 252 is associated with a first number 250*a* (e.g., 1), a second pointer 254 is associated with a second number 250*b* (e.g., 2), and a third pointer 256 is associated with a third number 250*c* (e.g., 3). When the first number 250*a* (e.g., 1) is identified by the number determiner 244, the symbol 24 indicated by the first pointer 252 is deactivated or eliminated for the subsequent play of the game. Similarly, when the second number 250*b* (e.g., 2) is identified by the number determiner 244, the two symbols 24 indicated by the first and second pointers 252 and 254 are deactivated or eliminated for the subsequent play of the game. When the third number 250*c* (e.g., 3) is identified by the number determiner 244, the three symbols 24 indicated by the first, second and third pointers 252, 254 and 256 are deactivated or eliminated for the subsequent play of the game. Depending on the embodiment, which of the identified number of outcomes can be deactivated or eliminated for the subsequent play of the game through a dealer determination, a player determination, based on wager amount or based on any other suitable factor. In another embodiment, the triggering events remain the same between the initial and subsequent plays 16 and 20. In one alternative embodiment, a plurality of pointers are associated with the same symbol. As shown in FIG. 17, the ball or indicator 257 has landed adjacent to the symbol "5" after the rotor 202 and the number determiner 244 stop spinning. The ball or indicator 257 is adjacent to and corresponds to the number 250*b* of the number determiner 244, which indicates the numeral "2". As described above, if the second number 250*b* (e.g., 2) is determined by the number determiner 244, the two symbols 24 indicated by the first and second pointers 252 and 254 are deactivated or eliminated for the subsequent play of the game. In the illustrated example, the symbols "11" and "31" are deactivated or eliminated for the subsequent play of the game 12.

In an alternative embodiment, each of the pointers 252, 254, and 256 are randomly associated with one of the symbols 24. In another alternative embodiment, each of the pointers 252, 254 and 256 are player selectable so that if the determined number 246 is "2" the player can determine which of the two pointers 252, 254 and 256 will be used to deactivate or eliminate two of the symbols 24 for the subsequent play of the game 12.

Referring to FIGS. 18A and 18B, the gaming devices 200, 200*a* and 238 can include an opportunity for the player to place a side wager or an additional wager to activate an award system 258 and 258*a*.

As best illustrated in FIG. 18A, the gaming devices 200, 200*a* and 238 each include an award system 258. The award system 258 includes a consecutive outcome tracker 259 which tracks the number of consecutive outcomes wagered on by a player. If a number of consecutive game outcomes occur in the first and second plays 16 and 20 of the game 12, one of the award modifiers or award increasers 277 modifies an award provided to the player. In one embodiment, the award system 258 requires an additional wager for a player to qualify for the award increasers 277. In one such embodiment, a first award increaser 277 (2×) modifies the additional wager upon the first occurrence of the certain game outcome and a second award increaser 277 (12×) modifies the additional wager upon a second consecutive occurrence of the certain game outcome. As additional consecutive game outcomes are generated in the game 12, the award increaser 277 elevates in a ladder-fashion until the player reaches a maximum award increaser 277 (25,000×). Upon reaching the maximum award increaser 277 (25,000×), the player's additional wager is modified by the maximum award increaser and the additional wager is returned to the player. If a consecutive game outcome does not occur, in one embodiment, the dealer collects the additional wager made by the player.

As best illustrated in FIG. 18B, the gaming devices 200, 200*a* and 238 each include an award system 258*a*. The award system 258*a* includes a consecutive eliminated outcome tracker 259*a* which tracks a total number of consecutive outcomes eliminated or deactivated for the subsequent plays 20 of the gaming devices. In this embodiment, the total number is associated with one of a plurality of awards 277*a*, such as award modifiers or award multipliers. In one embodiment, the award system 258*a* requires an additional wager or side wager for a player to qualify for the awards 277*a*. As initial and additional consecutive game outcomes are eliminated or deactivated for the subsequent plays 20 of the game 12, the total number of consecutive eliminated outcomes increases. For example, when the number of consecutive eliminated outcomes reaches exactly five, the player receives a reward equal to 2× the corresponding side bet. If, on the next spin, the player triggers another subsequent round which deactivates or eliminates three outcomes, then the consecutive eliminate outcome count will grow from five to eight, and the player will receive an additional award relative to the secondary paytable which, in this example, is 5× the corresponding side bet. As the total number increases, the award 277*a* elevates in a ladder-fashion until the player reaches a terminating condition, such as a spin of the rotor which results in the indication of a non-designated symbol or reaching a maximum award 277*a* (25,000×). Upon reaching the maximum award increaser 277*a* (25,000×), the player's additional wager is modified by the maximum award increaser 277*a* and the additional wager is returned to the player. Upon the occurrence of the terminating conditions, if a consecutive game outcome does not occur, in one embodiment, the dealer collects the additional wager made by the player.

In one embodiment, the player may receive an award for his side wager relative only to the furthest that the side wager was able to progress on the kind of ladder shown on FIG. 18B. Therefore, the side bet wager results in an award only if the wager has progressed to a threshold high enough to warrant an award and only when the sequence terminates. In one embodiment, the wager may be returned to the player if such wager has resulted in an award to the player.

It should be appreciated that the awards 277 and 277*a* may include fixed awards, multipliers, awards based on the side wager, progressive awards or any other suitable award. For example, in one embodiment, the player is provided a fixed award based on the side wager if a triggering event occurs in the initial or subsequent plays. In another embodiment, the player is provided with an award relative to the side wager based upon the number of outcomes eliminated or deactivated in one or more subsequent plays. In another embodiment, the side bet is part of a sequence proposition whereby the side bet is advanced along an advancement indicator with one advancement for every consecutive subsequent play which resulted in one or more outcomes being eliminated or deactivated. In one such embodiment, the side bet is advanced along the advancement indicator with the side bet being advanced one step for each eliminated or deactivated outcome. For these sequence propositions, different payout schedules can be defined including, but not limited to paying the player for each advancement, paying the player only when the side wager crosses specific award thresholds, and offering a pay schedule which may or may not increase the amount of the award relative to extent of the progression. In one embodiment, the sequence may have a maximum step at which the player receives a top-level award (e.g., such as 25,000× in FIGS. 18A and 18B) and the corresponding side bet is returned to the player. In another embodiment, a progressive award is provided to the player if the side bet is of a sufficient size and advances to a certain level. In another embodiment, the sequence continues until a termination condition (i.e., when the sequence requirements are no longer met). In one such embodiment, the side bet continues to advance along the advancement indicator and the player continues to win awards for as long as the sequence requirements are met. In this embodiment, the sequence continues for each spin that results in one or more outcomes being eliminated or deactivated.

In one embodiment, the award system 258 and 258*a* enables the player to start a new side wager while one or more side wagers are active and advancing along the advancement indicator. In one embodiment, a chip transporter or conveyor assembly 260 can control the side bet advancement as described below.

Figure 19:
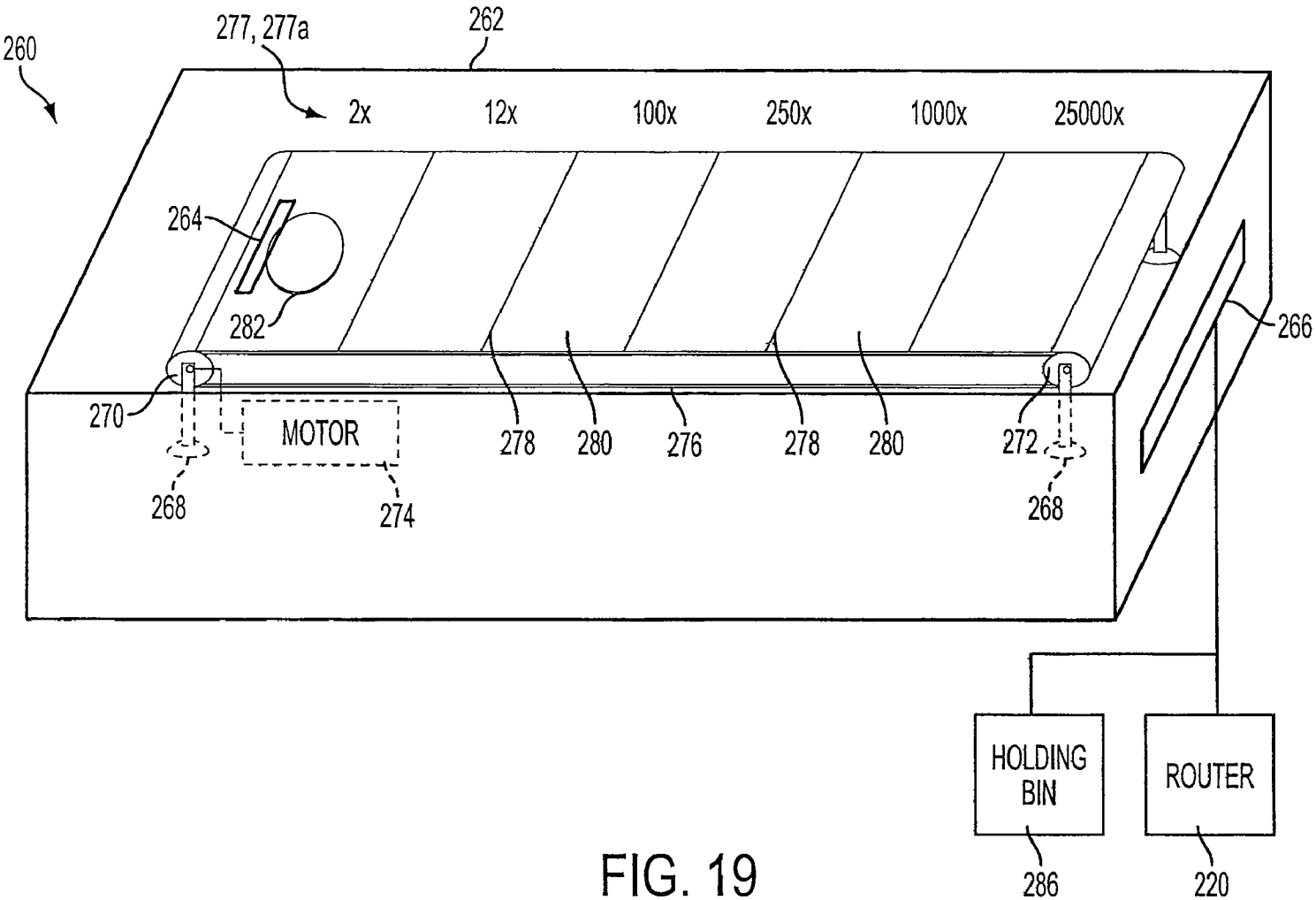
FIG. 19 is a perspective view of one embodiment of a chip transporter for one embodiment of the game system.

Referring to FIG. 19, in one embodiment, gaming devices 200, 200*a* and 238 each include a chip transporter or conveyor assembly 260 that may be implemented in either mechanical or electro-mechanical form. The chip transporter 260 operates to track the number of consecutive outcomes produced in the subsequent play 20. The chip transporter 260 cooperatively functions with the award system 258 so that as the chip transporter 260 tracks consecutive outcomes, a player qualifies for one or more of the award increasers 277 shown in FIG. 18.

In one embodiment, the chip transporter 260 includes a lockable cover or casing 262, which may be a substantially clear plastic material or other substantially see-through material. The casing 262 has a chip receiving slot or input 264 and a chip chute or output 266.

The chip transporter 260 includes a frame 268. The frame 268 is attached to a support structure of each gaming device. The frame 268 supports at least two rotatably mounted rollers 270 and 272. The rollers 270 and 272 are coupled to a motor 274, which is operable to cause the rollers 270 and 272 to rotate in the same direction. A transporting or conveyor track 276 is endless and movably supported by the rollers 270 and 272 so that as the rollers 270 and 272 rotate, the transporting track 276 moves in the direction of rotation of the rollers 270 and 272. In one embodiment, the motor 274 is configured to cause the rotation of the rollers 270 and 272 after a dealer or player input (e.g., through a suitable input device). In another embodiment, the motor 274 is configured to cause the rotation of the rollers 270 and 272 automatically after one of the landing sensors described above sense whether the ball has landed in a certain game landing of the rotor 202.

The transporting track 276 includes a plurality of dividers or dividing members 278 that separate different portions 280 of the transporting track 276. In one embodiment, the dividing members 278 are integral to the track 276. In one embodiment, the dividing members 278 are retaining walls fixedly secured to the track 276 via fasteners, adhesive, bonding or any other suitable securing member. Each separate portion 280 of the transporting track 276 corresponds an award increaser 277. As illustrated, the leftmost portion 280 of the track 276 corresponds to a first award increaser (e.g., the award increaser of the lowest amount, such as 2×) and the rightmost portion 280 of the track 276 corresponds to a second award increaser (e.g., the award increaser of the highest amount, such as 25,000×). This configuration enables a player to place a side wager on whether the subsequent play 20 will continue for a plurality of consecutive outcomes.

In one embodiment, the award increasers 277 are displayed adjacent to the transporting track 276 so that as the track 276 moves, the separate portions 280 thereof correspond to one of the award increasers 277. For example, if a chip 282 is located at the leftmost portion 280 of the track 276, the chip 282 represents a player qualification for a first award increaser 277, such as an award increaser having a value of 2×. When the track 276 moves about the rollers 270 and 272, the track moves the chip 282 next to a second award increaser 277, such as an award increaser having a value of 12×. In this manner, the conveyor 260 indicates an award escalator or ladder, wherein a player qualifies for escalating award increasers 277.

In operation of the gaming devices 200, **200*a* and 238 described above, at the start of the subsequent play 20, the dealer or the player places the chip 282 into the chip input 264. The chip 282 is received through the chip input 264 and constitutes a player wager on the chance of the next spin continuing the chain of consecutive designated outcomes, such as consecutive wins. The chip input 264 is configured to direct the chip 282 to the leftmost portion 280 of the track 276. As described above, the leftmost portion 280 of the track 276 corresponds to a first award increaser 277. As illustrated, the first award increaser 277** has a value of 2× and is the lowest award increaser available to the player. It should be appreciated that chips associated with different players may be represented with different colors or a designated marker or other indicator associated with each player may be used instead of chips.

When the chip 282 advances next to one of the award increasers 277, the dealer provides the player with an award based on that award increaser 277. For example, when the chip 282 advances to the first award increaser 277, the dealer provides the player with an award including any wager on the consecutive outcome modified by the first award increaser 277 (2×).

After an indication of a second designated outcome that continues the chain of consecutive designated outcomes, the motor 274 causes the rollers 270 and 272 to rotate. The rotation of the rollers 270 and 272 causes the track 276 to move. The movement of the track 276 causes the chip 282 to advance next to a second award increaser 277. As illustrated in FIGS. 18 and 19, the second award increaser 277 has a value of 12×. When the chip 282 advances to the second award increaser 277, the dealer provides an award to the player including any wager on the consecutive outcome modified by the second award increaser 277 (e.g., 12×). As long as the player avoids a termination condition, the chip 282 continues to advance to different award increasers 277 after successive designated outcomes in which the dealer continues to provide awards to a player based on the award increasers 277.

As the chip 282 advances to different award increasers 277, the chip 282 moves toward the chip output 266. In one embodiment, when all award increasers 277 are obtained (i.e., when the chip 282 is advanced to the highest award indicator 277), the chip 282 is advanced to the chip output 266 and dumped into a router 220. In another embodiment, when a termination event occurs, such as a non-winning event or the indication of a certain symbol 24 in the game, any chips 282 positioned on the track 276 are automatically advanced to the chip output 266 and dumped into the router 220.

In one embodiment, the chip 282 is advanced to a plurality of award increasers 277 in the same spin of the rotor. For example, the indication of two certain symbols 24 in the game results in the track 276 advancing the chip 282 by two award increasers 277 (e.g., from 2× to 100×).

As illustrated in FIG. 19, the router 220 is positioned adjacent to the chip output 266 to receive the dumped chips. The router 220 is operable to route chips, tokens or betting markers to individual players at respective wagering stations. In one embodiment, the router 220 includes a delivery tube or chute (not shown) or another suitable delivery mechanism associated with each wagering station to effect the routing.

In one embodiment, chips 282 are dumped from the chip output 266 into a holding bin 286 instead of the router 220. In this embodiment, the chips 282 are not returned to the players. In another embodiment, the chips 282 are dumped into the router 220 which directs the chip to the holding bin 286 instead of to one of the wagering stations.

In another embodiment of the award system 259, the dealer enables the player to place a new side wager during an existing side wager. This is similar to placing a come bet in craps wherein a player is able to make a wager as an active wager already in progress. For example, a player may make a $2 wager on a certain game event. If the next spin produces such game event, such as one or more certain symbols 24, the player's $2 wager advances to one of the award increasers 277 according to the game logic. The dealer enables the player to place a new side wager in any amount in accordance with table wager limits. The result of the new wager is only affected by subsequent spins irrespective of the fact that the prior spin designated the certain game event.

Figure 20:
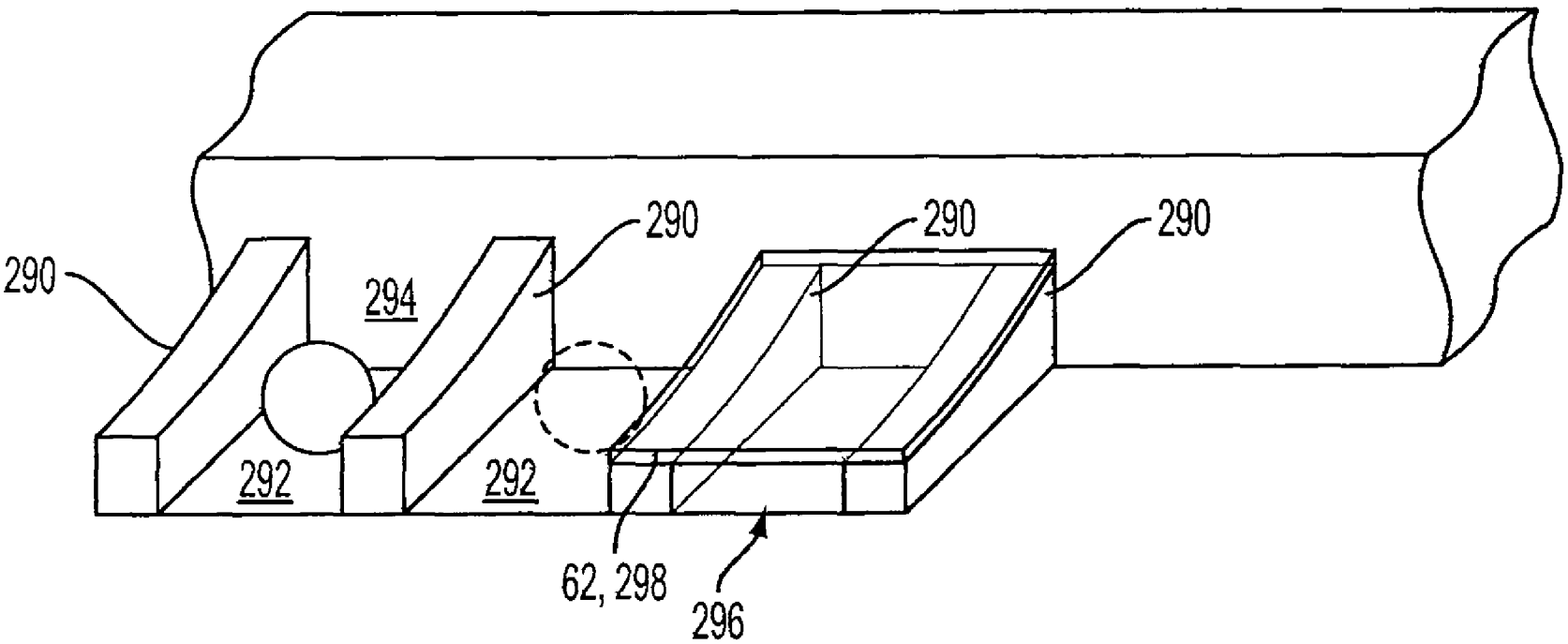
FIG. 20 is an enlarged perspective view of a plurality of landings of one embodiment of the game system, wherein one of the landings is blocked with one embodiment of a blocker.

In different embodiments described below, the ball landings 26, the ball or indicator, and other game elements can be modified or included within each gaming device 200, 200*a* and 238 so to indicate which game outcomes are activated or deactivated for the initial play 16 and the subsequent play 20 of the game 12. Accordingly, the gaming devices are structured to deactivate a determined number of outcomes from a plurality of active outcomes or to activate a determined number of outcomes from a plurality of inactive outcomes. As best illustrated in FIG. 20, each ball landing 26 includes a plurality of dividers or sidewalls 290. Each game landing 26 also has a floor 292 and a back 294. The back 294, floor 292 and sidewalls 290 define a pocket or space 296 for each ball landing 26. In one embodiment, the blocker 62 includes a cover 298 having a configuration that substantially covers or blocks a top area of the pocket or space 296. In one embodiment, the cover 298 is telescopically received in one of the sidewalls 290 of the ball landing 26 and extends across the space 296 to substantially cover the space 296 when the ball landing 26 and the associated symbol 24 are deactivated or eliminated from the game. The cover 298 substantially blocks the space 296 so that the indicator is blocked from landing in the covered ball landing 26. In one embodiment, the cover 298 has a convex or dome shape to direct the ball away from the cover 298.

Figure 21:
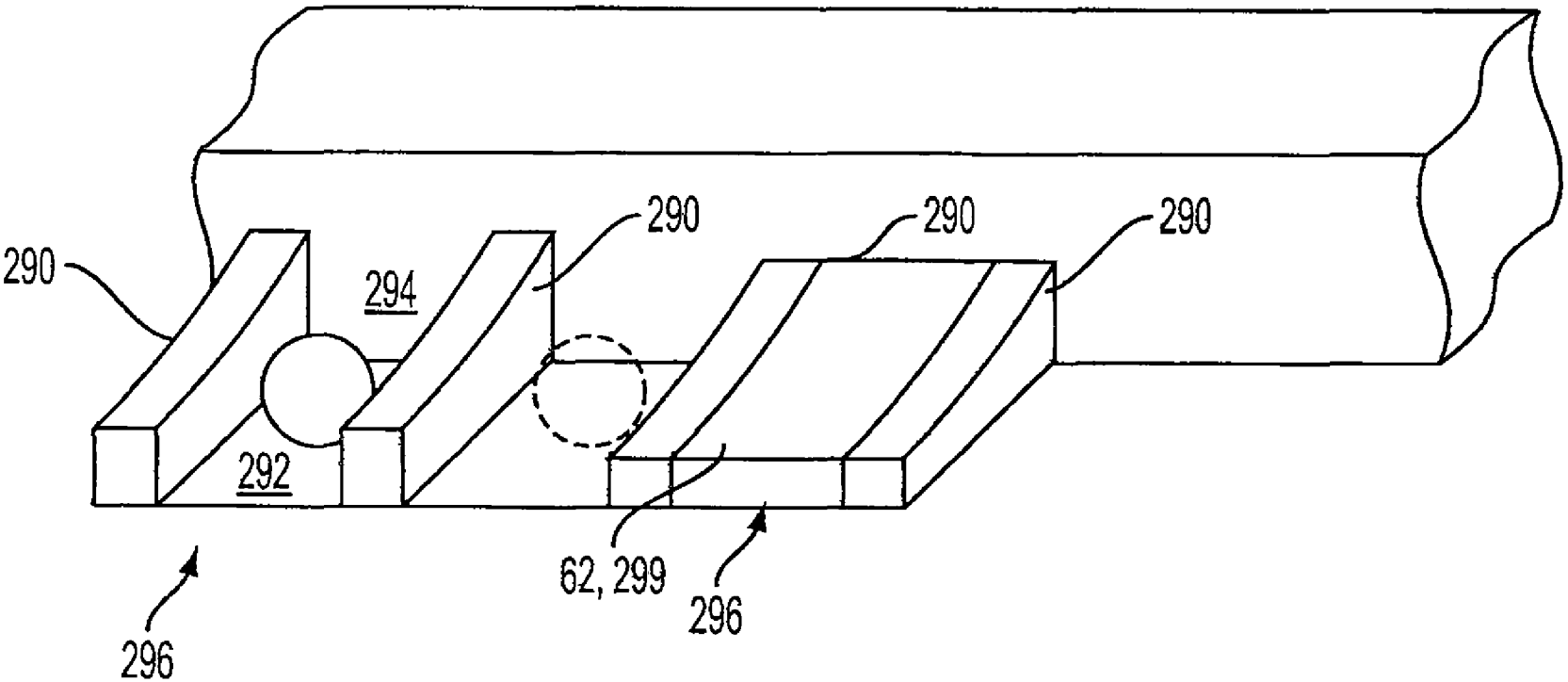
FIG. 21 is an enlarged perspective view of a plurality of landings of one embodiment of the game system, wherein one of the landings is blocked with one embodiment of a blocker.
Figure 22:
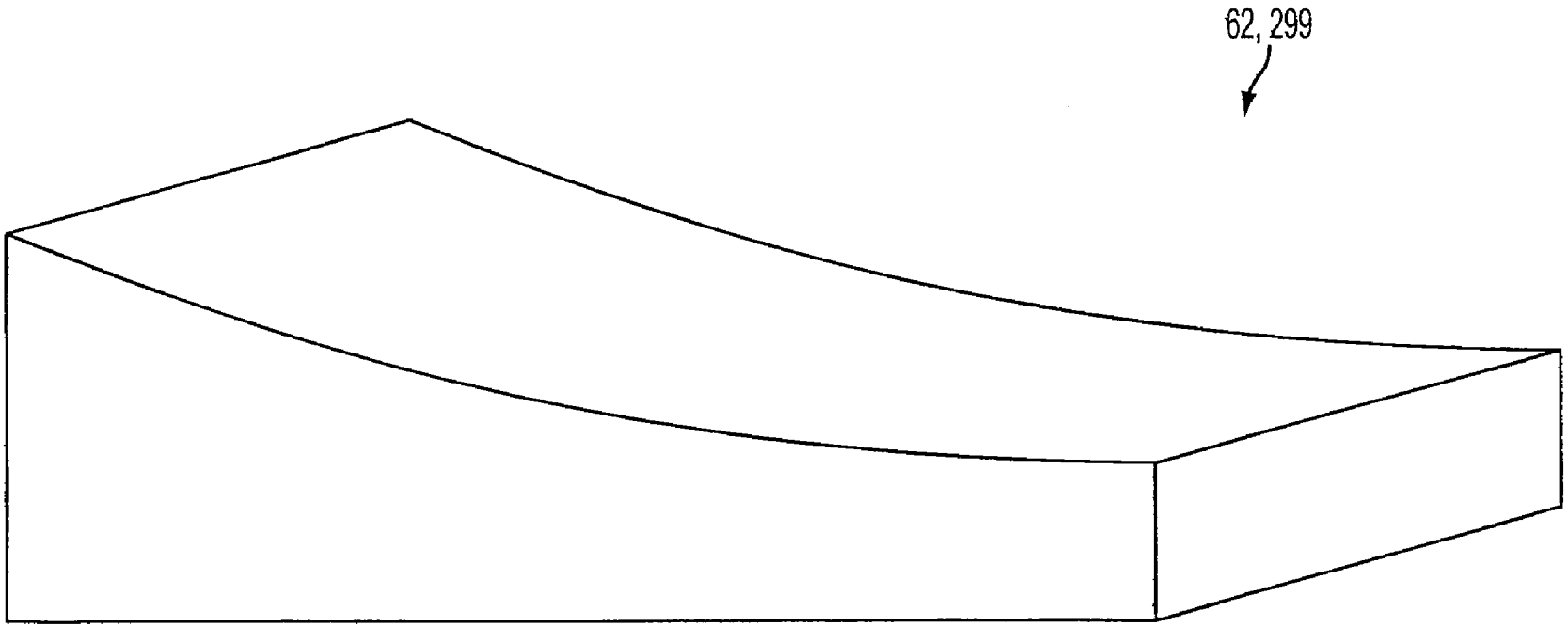
FIG. 22 is a an enlarged perspective view of one embodiment of the blocker shown in FIG. 21.

As best illustrated in FIGS. 21 and 22, the blocker 62 includes a blocking member 299. In this embodiment, the blocking member 299 is shaped as a wedge or other suitable volumetric shape. The blocking member 299 has a configuration that substantially fills or blocks the pocket or space 296. In one embodiment, the blocking member 299 is frictionally received between the sidewalls 290 and extends to the floor 292 and the back 294 of the ball landing 26. The blocking member 299 substantially fills the space 296 when the ball landing 26 and the adjacent symbol 24 are deactivated or eliminated for the subsequent play 20.

In another embodiment (not shown), the blocker 62 includes an elevator or elevating device. The elevator or elevating device includes a motor and an elevatable floor. The elevator or elevating device is configured to elevate the floor to substantially fill or block the pocket or space. In one embodiment, the elevator or elevating device extends into and substantially fills the space when the ball landing 26 and the associated symbol 24 are deactivated or eliminated from the game.

In another embodiment, at least one of the ball landings 26 have physical characteristics which are distinguished from the physical characteristics of at least one other of the ball landings 26. These characteristics can include, but are not limited to, surface characteristics, structural characteristics and material characteristics.

In one embodiment, at least one ball landing 26 has a selected magnetic characteristic or a degree of magnetism. In this embodiment, the indicator is constructed of steel or metal. The strength of the magnetism of such ball landing 26 affects the likelihood that such ball will land on such ball landing 26.

In another embodiment, the Roulette-wheel assembly 201 includes an air pressure or pneumatic device which directs variable air currents into one or more ball landing 26 when designated events occur, such as when a ball landing 26 is deactivated or eliminated from the game. These air currents strike the ball, thereby affecting the likelihood that the ball will stop in a certain one of the ball landings 26 versus another one of the ball landings 26.

Figure 23:
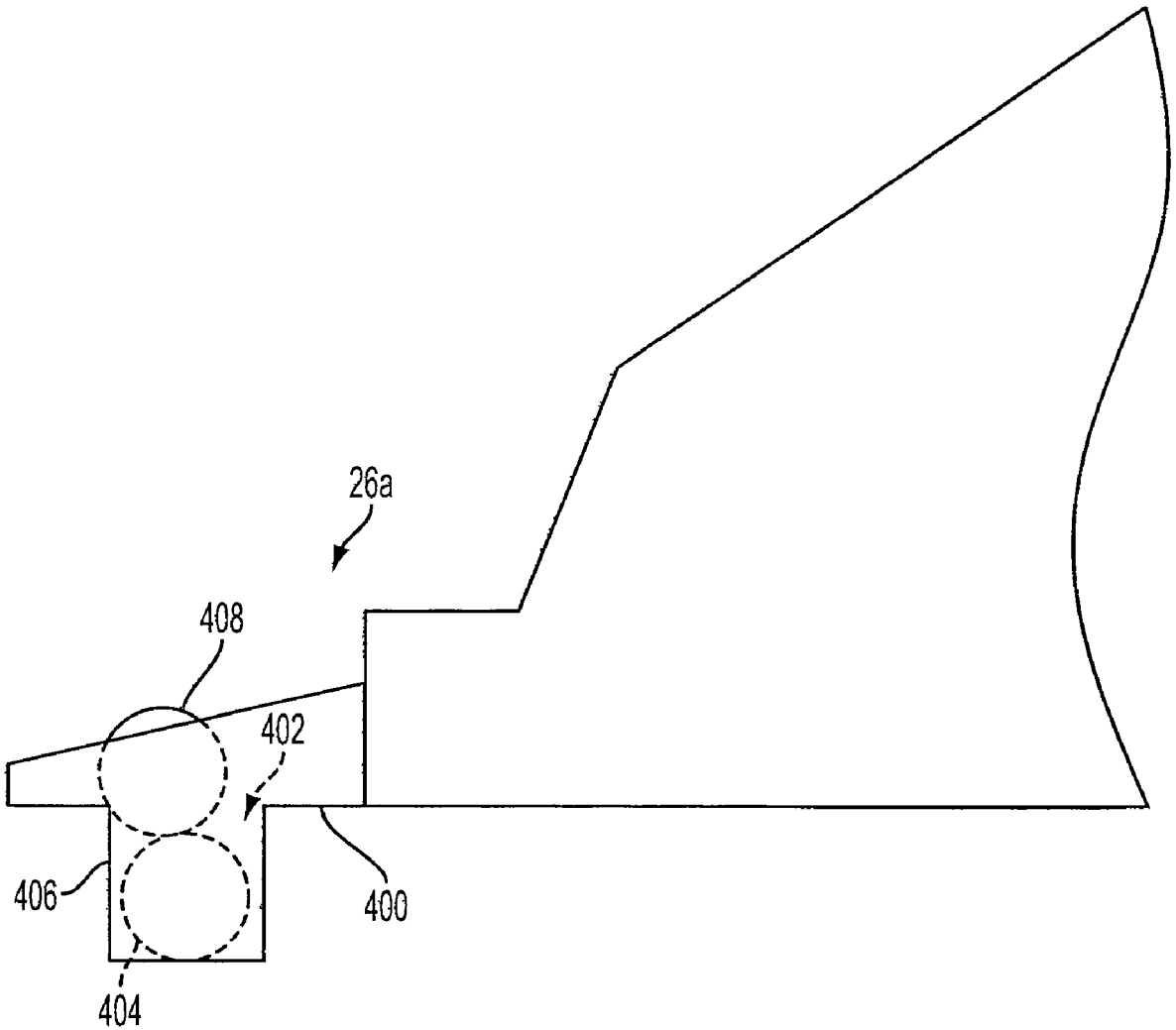
FIG. 23 is a side elevation view of a ball landing having a ball holder in one embodiment of the game system.

In one embodiment illustrated in FIG. 23, the ball landing 26*a* of rotor 202 has a floor 400 which defines an opening 402. In one embodiment, the opening 400 is exposed throughout the initial play 16 and any subsequent play 20. The slot or opening 400 is greater in size than the ball 404. Accordingly, when the first ball 404 stops in the ball landing 26*a*, the ball 404 falls or drops through the opening 402 in to the ball holder 406. In this embodiment, the ball holder 406 is sized to hold slightly more than the volume of a single ball 404. In operation, if the first ball 404 lands in ball landing 26*a*, the ball will drop through the opening 402. The ball holder 406 holds the dropped ball 404 in place for retrieval by the dealer. If, before the dealer retrieves the ball 404, another ball 408 lands in the ball landing 26, the ball 408 will drop partially through the opening 402. The presence of the ball 404 in the ball holder 406 keeps the ball 408 visible to the players while relatively significantly reducing the ability of the first ball to interfere with a second ball landing in the same landing. Accordingly, the visibility of ball 408 functions as an indicator that two balls have landed and stopped within the ball landing 26*a*. The opening 402 assists the dealer in disregarding certain ball landing outcomes as described above.

Figure 24:
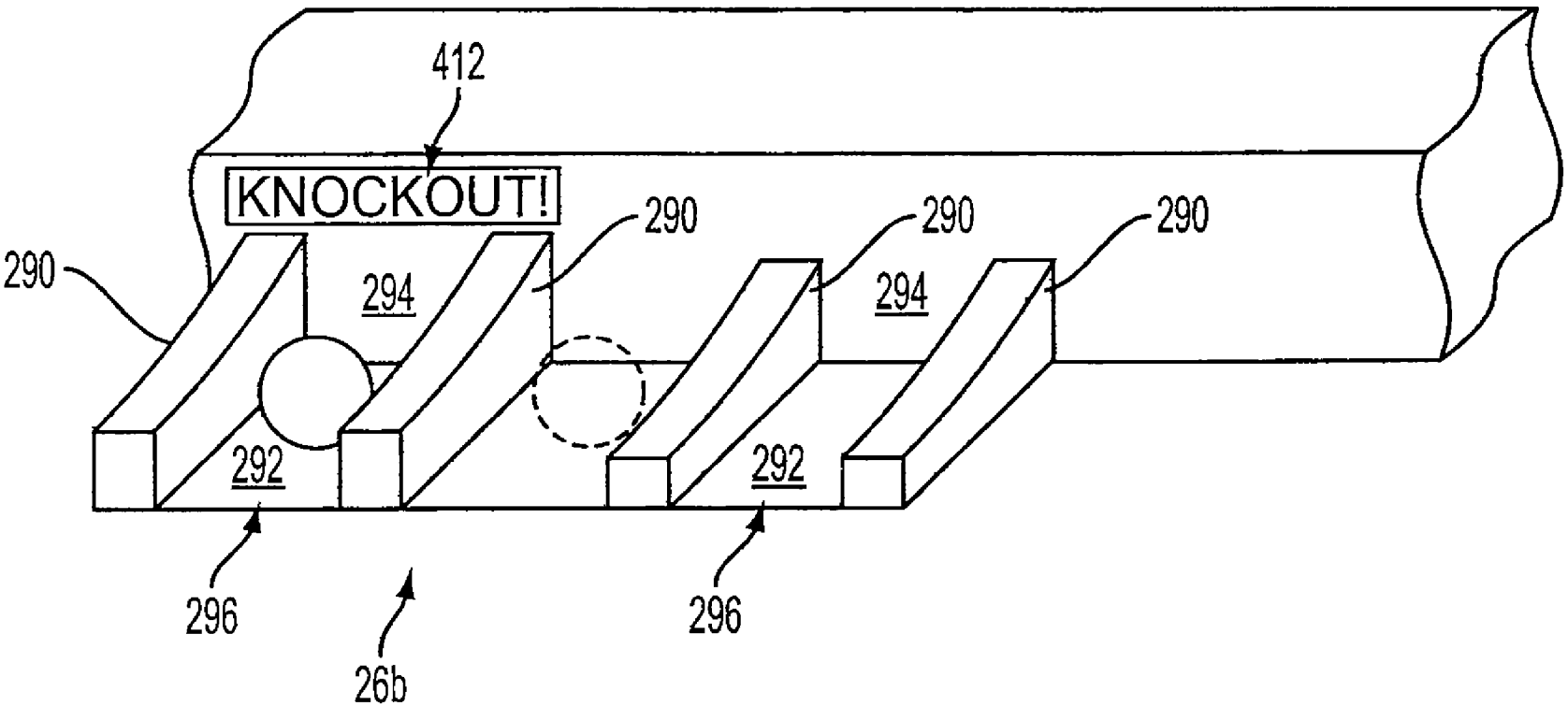
FIG. 24 is an enlarged perspective view of a plurality of bail landings of one embodiment of the game system, wherein one of the bail landings includes a display.

In one embodiment illustrated in FIG. 24, the ball landing 26*b* of rotor 202 includes a display device or indicator 412 which indicates: (a) if that ball landing is specified as a designated landing for an outcome elimination, (b) if that ball landing is associated with a designated symbol, or (c) if that ball landing has been deactivated or eliminated in the course of a initial play 16, a subsequent play 20 or a sequence of plays 16 and 20. In this example, the indicator 412 states "KNOCKOUT!" indicating that the ball landing has been deactivated or eliminated from the subsequent play 20 of the game.

Figure 25:
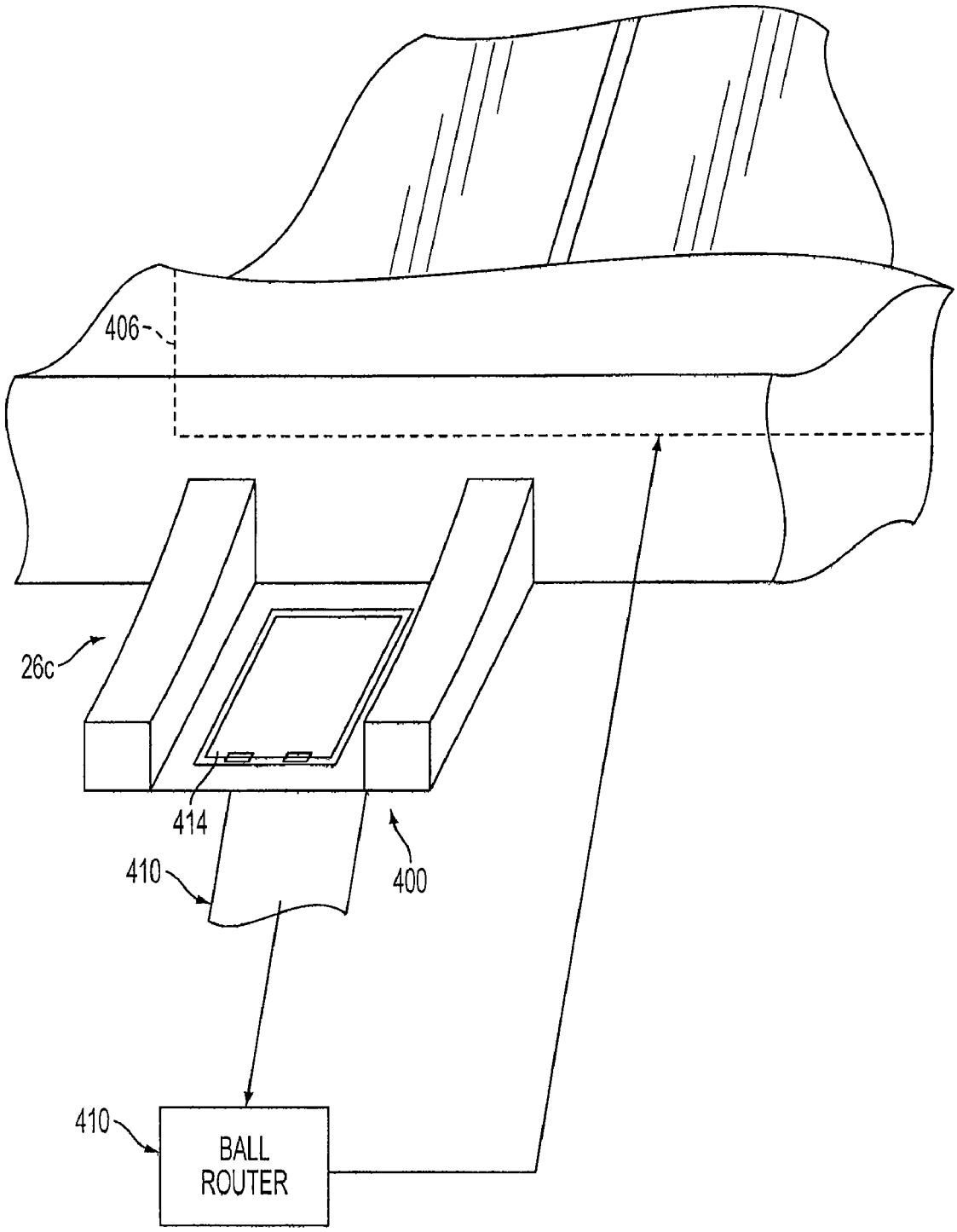
FIG. 25 is an enlarged perspective view of a ball landing having a closed floor door in one embodiment of the game system.
Figure 26:
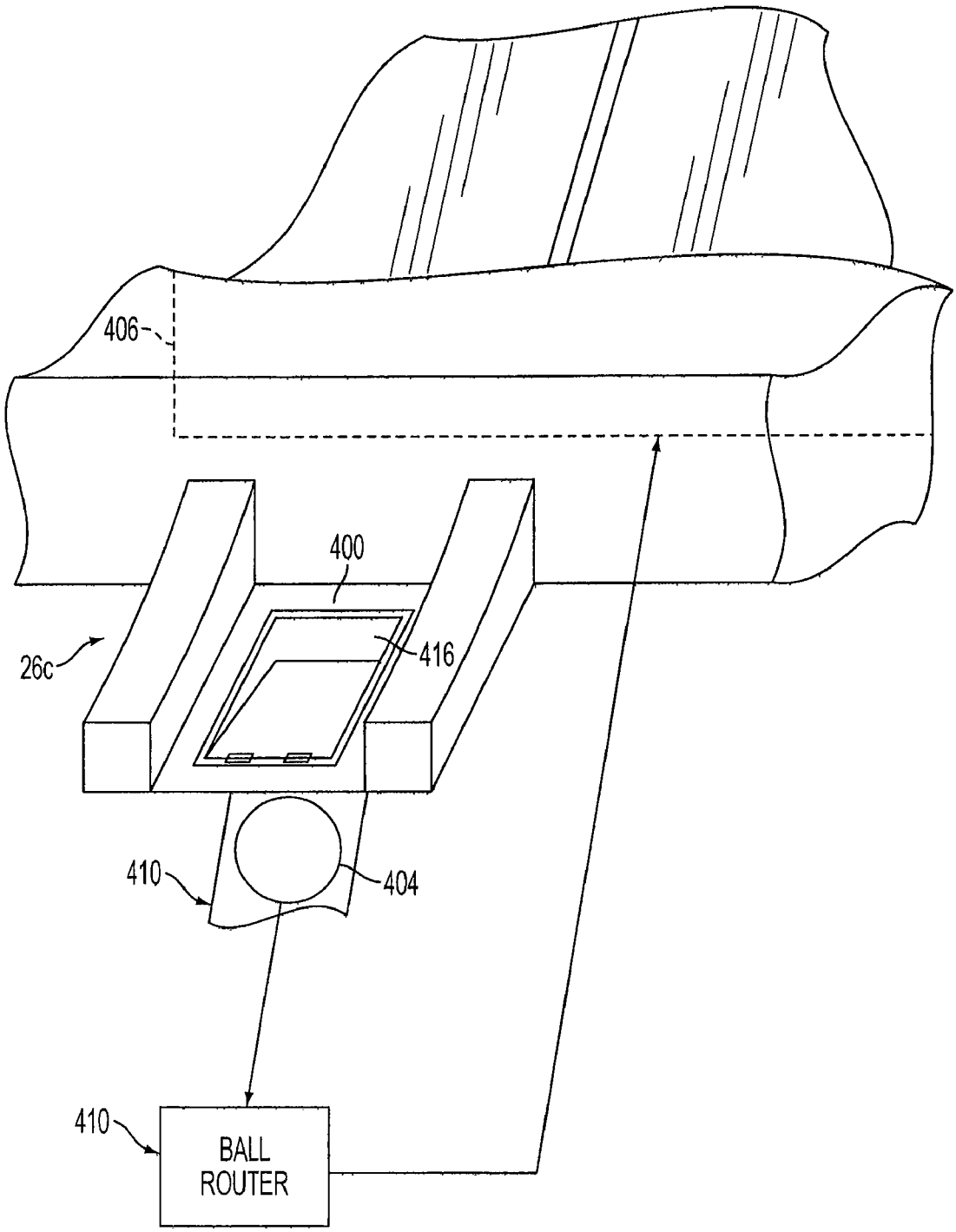
FIG. 26 is an enlarged perspective view of a ball landing having an open floor door in one embodiment of the game system.

In one embodiment illustrated in FIGS. 25 and 26, the floor 400 of the ball landing 26*c* has a door 414. In the closed position illustrated in FIG. 25, the door 414 provides a relatively flat surface for the landing 26*c*. In the open position illustrated in FIG. 26, the door 414 reveals an opening 416. If there is a ball in the landing 26*c*, the opening of the door 414 will cause such ball to drop through the opening 416. As illustrated, when the ball 404 lands in the ball landing 26*c*, a ball router 410 routes that ball 404 to a ball holder 406 where the ball 404 can be retrieved by the dealer. The ball router 410 assists the dealer in disregarding certain ball landing outcomes as described above.

Figure 27:
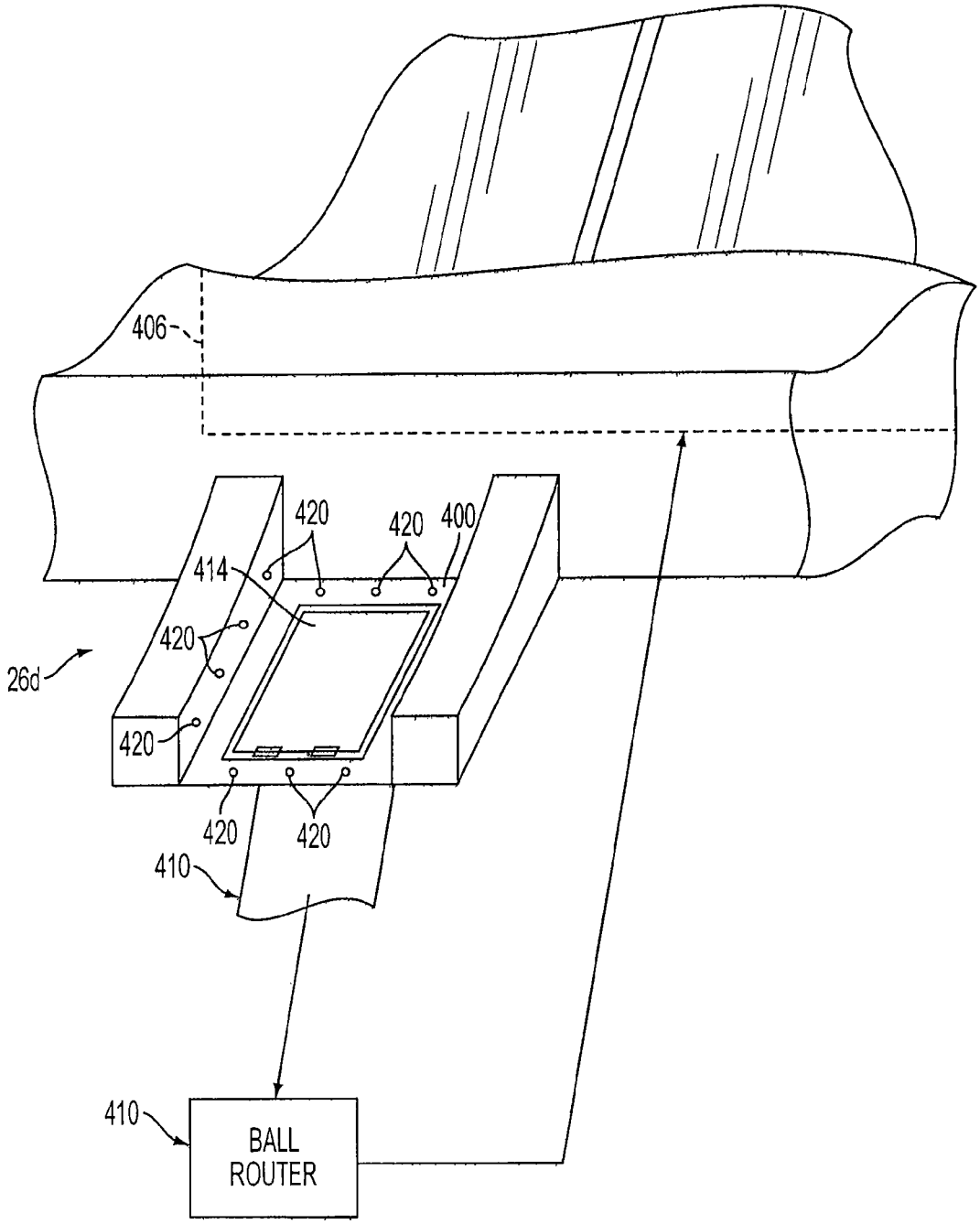
FIG. 27 is an enlarged perspective view of a bail landing having a plurality of indicators in one embodiment of the gaming device.

In one embodiment illustrated in FIG. 27, the ball landing 26*d* is the same as ball landing 26*c* except it has a plurality of indicators 420. The indicators 420, which are operatively coupled to the landing sensors (not shown), visually indicate if the ball landing has been deactivated or activated in the course of the initial play or subsequent play. In one example, each indicator 410 includes a suitable light source such as a light emitting diode (LED), and the illumination of the illuminated indicators 420 indicates whether the ball landing has been deactivated or eliminated from the game.

Figure 28:
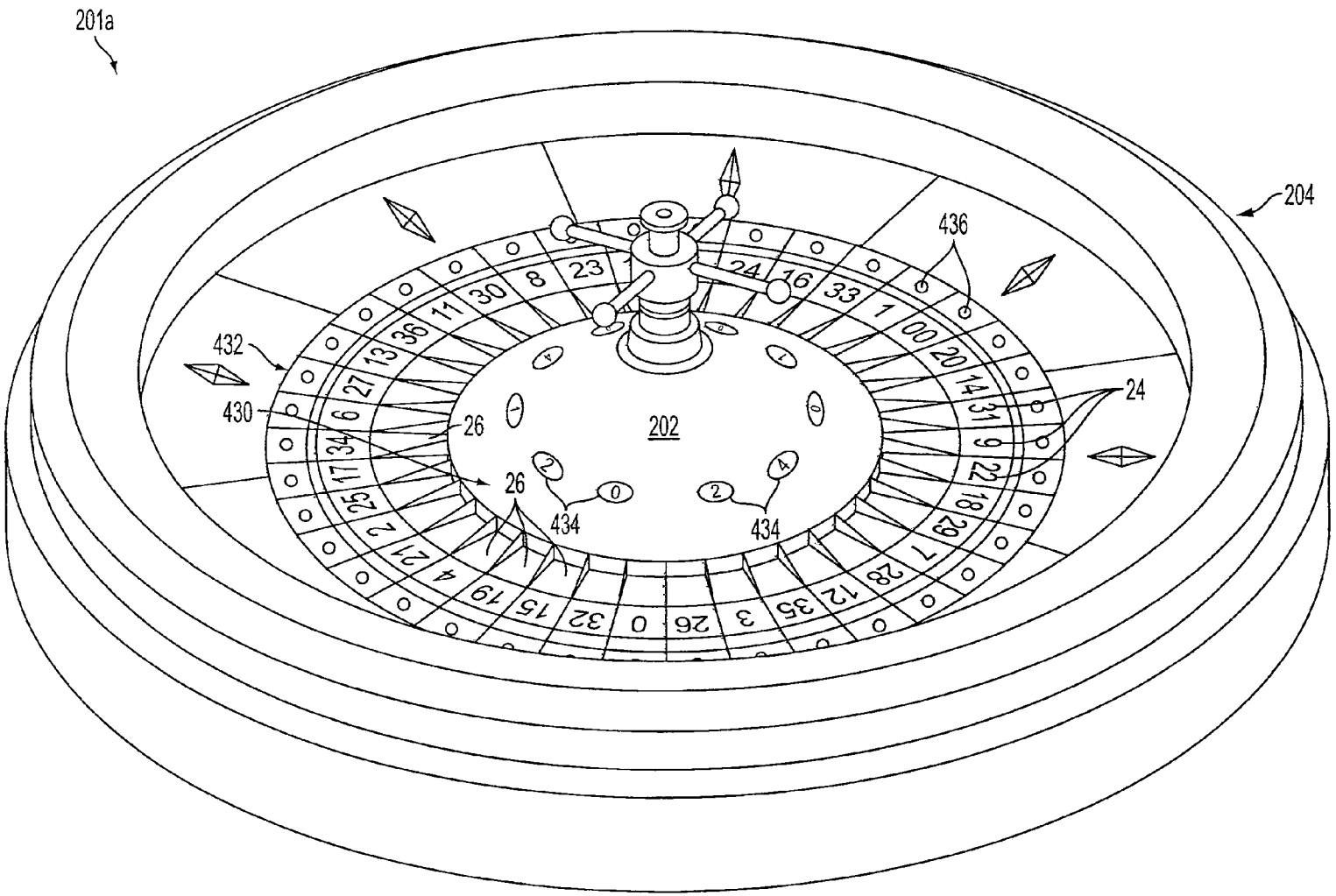
FIG. 28 is a top perspective view of one embodiment of a number determiner and indicator incorporated into one embodiment of the rotor.

In one embodiment illustrated in FIG. 28, the rotor 202*a* of the each gaming device 200, 200*a* and 238 includes a number determiner 430 and an indicator 432 incorporated into the rotor 12. Number determiner 430 includes a plurality of light sources 434 controlled by a processor. Each light source 434 is associated with a number, as illustrated in FIG. 28. When a ball lands in a ball landing 26 or when any other triggering event occurs for the subsequent play 20, the light sources 434 are sequentially illuminated for a period of time. A processor causes only one of the light sources 434 to be illuminated after the period of time elapses. The final illuminated light source 434 corresponds to the number associated with that light source which, in turn, corresponds to a randomly determined or predetermined number. This determined number is the number of outcomes to be deactivated or eliminated for the subsequent play 20 described above.

With continued reference to FIG. 28, the indicator 432 includes a ring of light sources 436 controlled by a processor. The light sources 436 encircle the symbols 24 of the rotor 202*a*. Each light source 436 is adjacent to and aligned with a game symbol 24. In this embodiment, the rotor 202*a* is coupled to an alignment assembly (not shown). The alignment assembly includes a gear assembly or stopper which keeps the game symbols 24 in alignment with the light sources 436. The rotor 202*a* may also be coupled to a friction assembly (not shown), which may be part of the alignment assembly. The friction assembly includes a stopper or other friction producing structure which slows or stops the spinning motion of the rotor. The friction assembly reduces the amount of time between the indication of one of the symbols 24 and the stopping of the rotor 202*a*. Accordingly, when the rotor 202*a* stops spinning, each game symbol 24 corresponds to one of the light sources 436. When a triggering event occurs in the initial game, the processor causes the determined number of light sources 436 to illuminate. In one embodiment, all of the light sources 436 sequentially illuminate on and off so as to simulate a chase pattern. Eventually, the chase simulation terminates and the determined number of the light sources 436 remains illuminated. The illuminated light source 436 functions as an indicator for the game symbol 24 adjacent to such illuminated light source 436. The indicator indicators whether the game symbol 24 is active or deactivated for the subsequent play 20.

Figure 29:
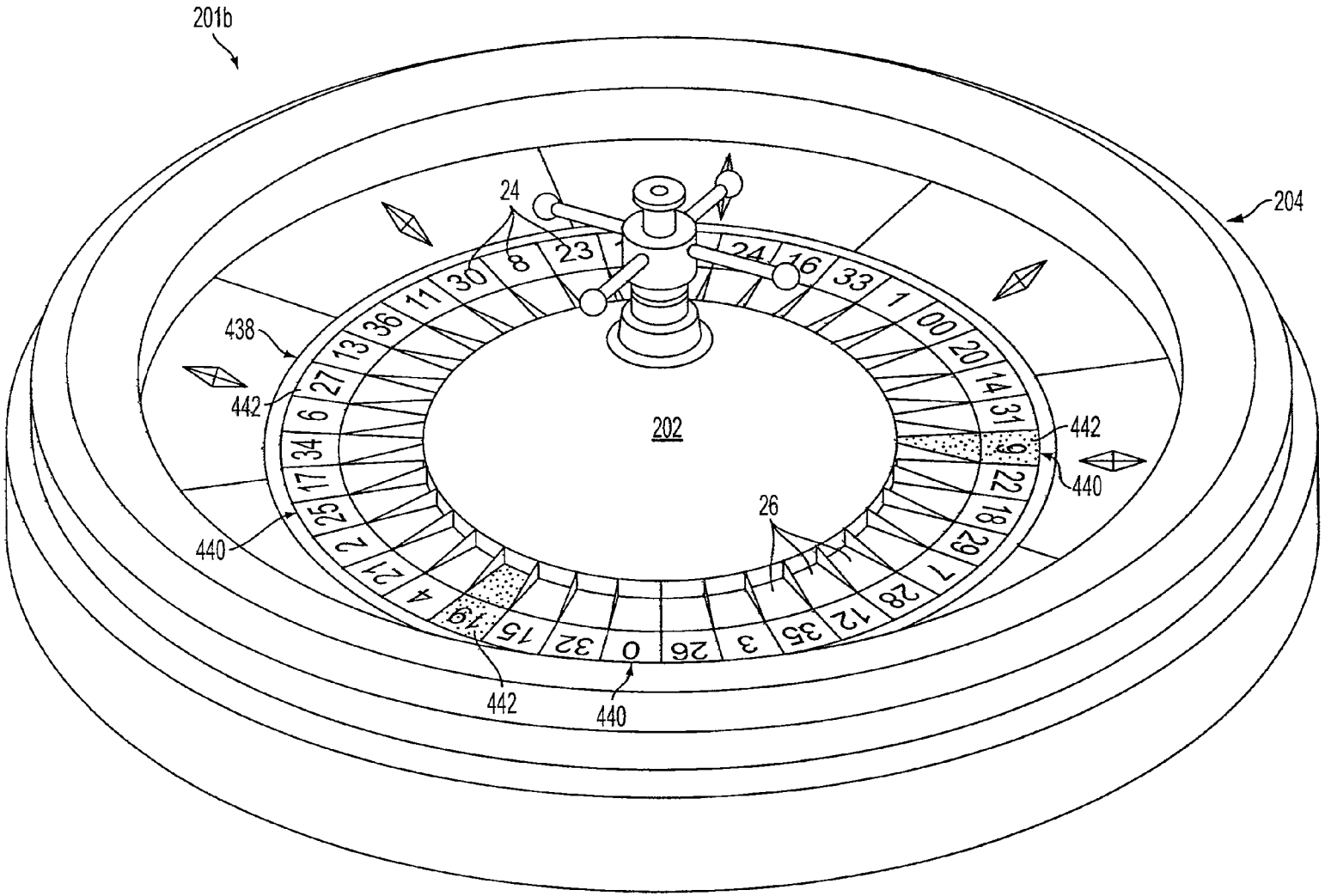
FIG. 29 is a top perspective view of one embodiment of the rotor including a plurality of light sources.

In another embodiment illustrated in FIG. 29, the rotor 202*b* of each gaming device 200, 200*a* and 238 includes an indicator 438 that includes a plurality of light sources under control of the processor. There is a light source mounted within or underneath each ball landing 26, each game symbol 24 and/or each landing-symbol set 440 (i.e., including one ball landing 26 and the associated game symbol 24). Accordingly, the processor is operable to selectively select, indicate and eliminate or deactivate different game symbols 24 and ball landings 26. In one example illustrated in FIG. 29, the processor causes landing-symbol sets 440 to be illuminated during operation of the initial play 16. This backlighting or illumination of sets 440 identifies sets 440 as specials sets associated with special outcomes, such as active outcomes. In one example, the landing of a ball on any landing of a set 440 may result in the activation or deactivation of one or more of the sets 440 associated with the illuminated numeral 442 in such set. It should be appreciated that the outcome reducing functionality (e.g., through the activation and deactivation of landing sets 440) and outcomes in this embodiment can be implemented entirely through the illumination process of the indicator 438. Furthermore, the selection, indication, elimination or deactivation functionality can be modified by reprogramming the processor to highlight different symbols or landings. An additional advantage of this arrangement is to facilitate the game operator in controlling or managing the expected long-term profitability of the game by the increase or reduction of the frequency and extent of such bonus lighting.

In one embodiment, referring back to FIG. 26, the ball 404 can be have different characteristics for representing the deactivation or activation of certain game outcomes. For example, in one embodiment, different balls may have different sizes. In one such embodiment, the ball landings 26 may also have different sizes. That is, when a certain ball is used for play of the game 12, such as an oversized ball, that ball will fit into only a select number of the ball landings 26. Thus, in this embodiment, the number of potential outcomes are reduced because the ball does not fit into (i.e., cannot be received by) all of the ball landings 26. Alternatively, the ball may have other characteristics, such as color, which determine active and deactivated landings. For example, in one embodiment, a plurality of different colored balls are used in accordance with a plurality of matching colored ball landings. If a green ball, for example, lands in a green landing, the subsequent play could begin, wherein each green landing would be eliminated or deactivated in the subsequent play.

In one embodiment, the rotor 202 is coupled to a bonus device. In one embodiment, the landing of a ball on a ball landing (not shown) triggers the operation of the bonus device (not shown). Once activated, the bonus device produces or determines one or more bonus outcomes or subsequent outcomes. The bonus device also includes at least one visual aid or output device, such as the indicator 218 illustrated in FIG. 11. The indicator 218 or another suitable visual output device visually indicates or displays the subsequent outcome determined by the bonus device. For example, the rotor 202 includes at least one additional symbol and ball landing adjacent to the symbol as described above.

It should be appreciated that the bonus device can include any suitable apparatus which is operable to determine a subsequent outcome, including, but not limited to, a mechanical outcome generating device, an electro-mechanical outcome generating device, a pseudo-random outcome generating device, and a computer. In one embodiment, the bonus device includes a bonus rotor or secondary rotor (not shown) associated with the Roulette-wheel assembly. In one embodiment, the secondary rotor includes a circular landing section adjacent to a circular symbol section. The landing section includes a series of landings for the ball in play, and the symbol section includes a series of symbols that correspond to the landings. In one example, when a ball lands on a designated landing, such as a ball landing or a secondary landing, the dealer spins the secondary rotor, and the ball eventually comes to rest in the landing section of the secondary rotor. The landing of the ball on one of the landings on the secondary rotor determines the secondary outcome for the players.

Electronic Embodiments

In one embodiment, the rotors 14, 202, 202*a*, 202*b*, the initial game play 16, the ball landing availability reducers 18, 18*a*, 18*b*, 18*c* and 18, the symbol designator 40, the number determiner 44, the indicators 48, 218 and the subsequent play 20 of the rotor-based game system 10, game 12, and gaming devices 200, 200*a* and 238 described above (collectively referred to as "rotor-based game elements") have a video, simulated, animated or virtual form, where such elements are formed by computerized graphical representations of actual physical objects. It should be appreciated that some or all of the components, structure, functionality and other elements of the rotor-based game system 10, game 12, and gaming devices 200, 200*a* and 238 described above have a video, simulated, animated or virtual form. In one such embodiment, the rotor-based game elements may be implemented in various configurations for gaming machines or gaming devices, including, but not limited to: (1) a dedicated gaming machine or gaming device, wherein the computerized instructions for controlling any games (which are provided by the gaming machine or gaming device) are provided with the gaming machine or gaming device prior to delivery to a gaming establishment; and (2) a changeable gaming machine or gaming device, where the computerized instructions for controlling any games (which are provided by the gaming machine or gaming device) are downloadable to the gaming machine or gaming device through a data network, such as the Internet, when the gaming machine or gaming device is in a gaming establishment. In one embodiment, the computerized instructions (i.e., computer readable versions of the rotor-based game elements) are stored in a web server central server, central controller or remote host. In one embodiment, the computerized instructions for controlling any games are executed by the central server, central controller or remote host. In such a "thin client" embodiment, the central server remotely controls any games (or other suitable interfaces) and the gaming device is utilized to display such games (or suitable interfaces) and receive one or more inputs or commands from a player. In another embodiment, the computerized instructions for controlling any games are communicated from the central server, central controller or remote host to a gaming device local processor and memory devices. In such a "thick client" embodiment, the gaming device local processor executes the communicated computerized instructions to control any games (or other suitable interfaces) provided to a player.

In one embodiment, one or more gaming devices in a game system may be thin client gaming devices and one or more gaming devices in the game system may be thick client gaming devices. In another embodiment, certain functions of the gaming device are implemented in a thin client environment and certain other functions of the gaming device are implemented in a thick client environment. In one such embodiment, computerized instructions for controlling any primary games are communicated from the central server to the gaming device in a thick client configuration and computerized instructions for controlling any secondary games or bonus functions are executed by a central server in a thin client configuration.

Figure 30:
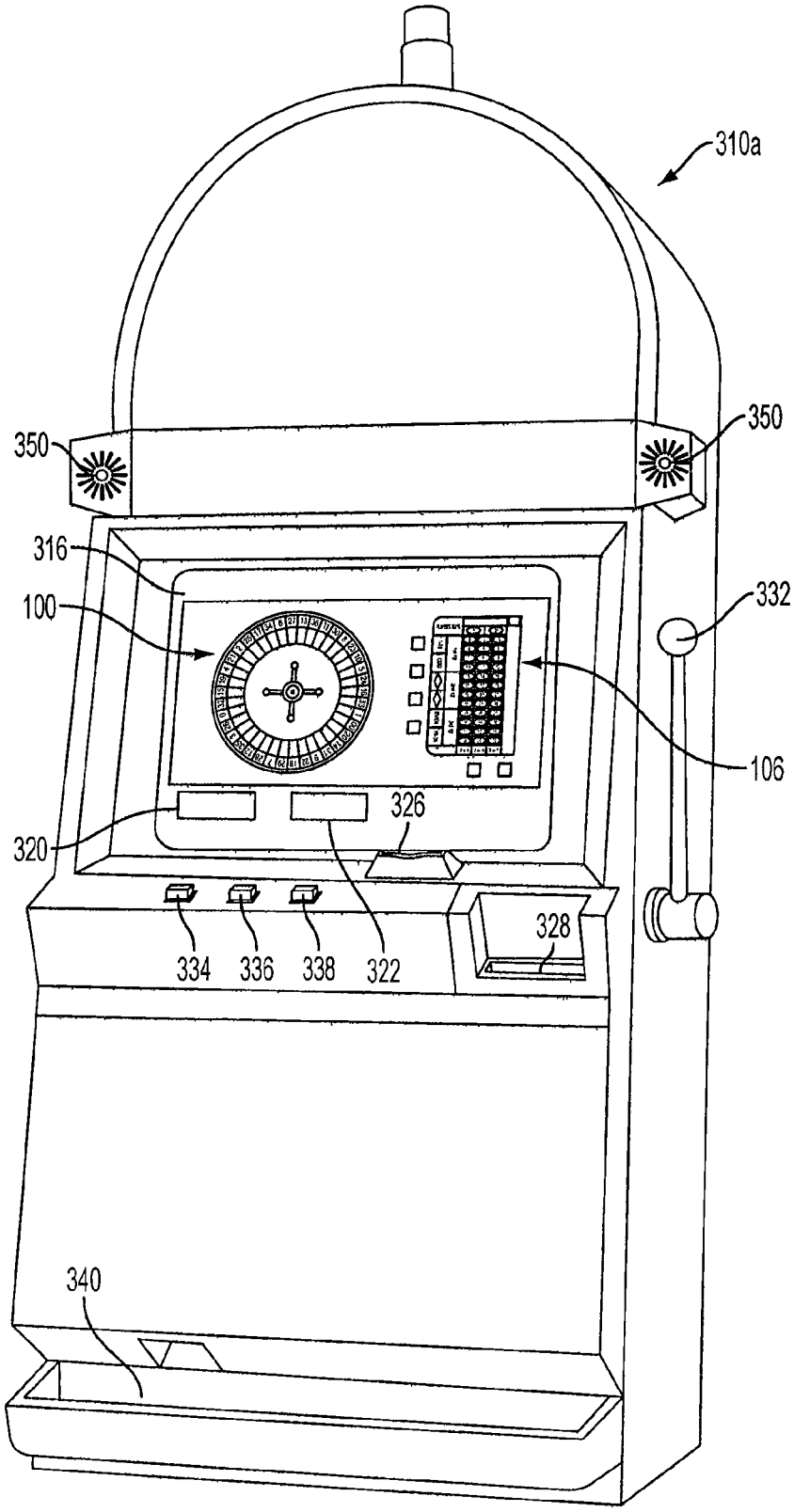
FIG. 30 is a front perspective view of one embodiment of a game system.
Figure 31:
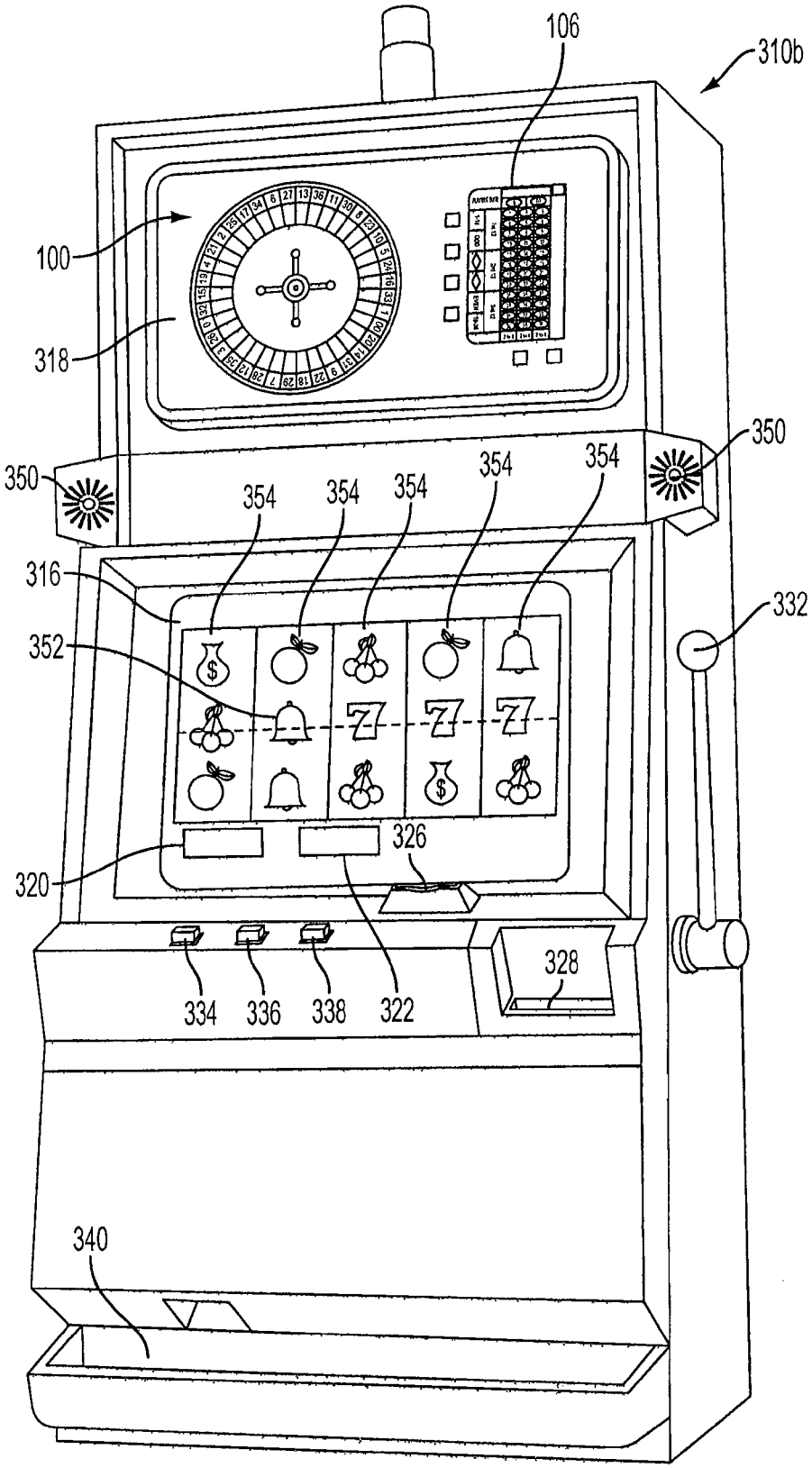
FIG. 31 is a front perspective view of another embodiment of a game system.

Two example alternative embodiments of a gaming device which implements the rotor-based game elements are illustrated in FIGS. 30 and 31 as gaming device 310*a* and gaming device 310*b*, respectively. Gaming device 310*a* and/or gaming device 310*b* are generally referred to herein as gaming device 310.

In the embodiments illustrated in FIGS. 30 and 31, gaming device 310 has a support structure, housing or cabinet which provides support for a plurality of displays, inputs, controls and other features of a conventional gaming machine. It is configured so that a player can operate it while standing or sitting. The gaming device may be positioned on a base or stand or can be configured as a pub-style table-top game (not shown) which a player can operate preferably while sitting. As illustrated by the different configurations shown in FIGS. 30 and 31, the gaming device may have varying cabinet and display configurations.

Figure 32:
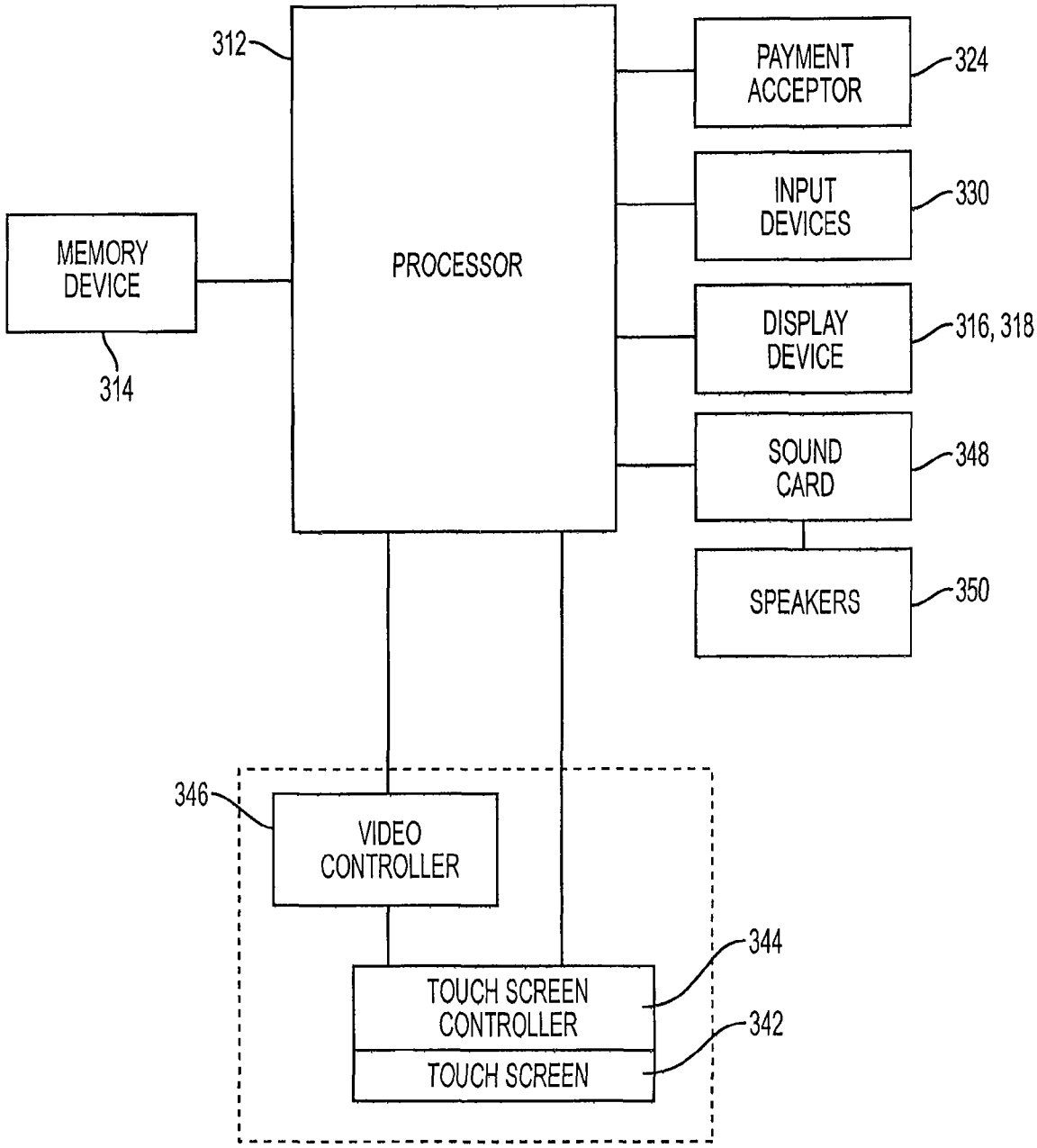
FIG. 32 is a schematic view of another electronic configuration of one embodiment of a game system.

In one embodiment, as illustrated in FIG. 32, the gaming device preferably includes at least one processor 312, such as a microprocessor, a microcontroller-based platform, a suitable integrated circuit or one or more application-specific integrated circuits (ASIC's). The processor is in communication with or operable to access or to exchange signals with at least one data storage or memory device 314. In one embodiment, the processor and the memory device reside within the cabinet of the gaming device. The memory device stores program code and instructions, executable by the processor, to control the gaming device. The memory device also stores other data such as image data, event data, player input data, random or pseudo-random number generators, pay-table data or information and applicable game logic (including, but not limited to, game logic 22 illustrated in FIG. 1) that relate to the play of the gaming device. In one embodiment, the memory device 314 stores computer-readable instructions and data associated with the functionality of the rotor-based game system 10 described above. In one embodiment, the memory device includes random access memory (RAM), which can include non-volatile RAM (NVRAM), magnetic RAM (MRAM), ferroelectric RAM (FeRAM) and other forms as commonly understood in the gaming industry. In one embodiment, the memory device includes read only memory (ROM). In one embodiment, the memory device includes flash memory and/or EEPROM (electrically erasable programmable read only memory). Any other suitable magnetic, optical and/or semiconductor memory may operate in conjunction with the gaming device disclosed herein.

In one embodiment, part or all of the program code and/or operating data described above can be stored in a detachable or removable memory device, including, but not limited to, a suitable cartridge, disk, CD ROM, DVD or USB memory device. In other embodiments, part or all of the program code and/or operating data described above can be downloaded to the memory device through a suitable network.

In one embodiment, an operator or a player can use such a removable memory device in a desktop computer, a laptop personal computer, a personal digital assistant (PDA), portable computing device, or other computerized platform to implement the present disclosure. In one embodiment, the gaming device or gaming machine disclosed herein is operable over a wireless network, such as part of a wireless game system. In this embodiment, the gaming machine may be a hand held device, a mobile device or any other suitable wireless device that enables a player to play any suitable game at a variety of different locations. It should be appreciated that a gaming device or gaming machine as disclosed herein may be a device that has obtained approval from a regulatory gaming commission or a device that has not obtained approval from a regulatory gaming commission. It should be appreciated that the processor and memory device may be collectively referred to herein as a "computer" or "controller."

In one embodiment, as discussed in more detail below, the gaming device randomly generates awards and/or other game outcomes based on probability data. In one such embodiment, this random determination is provided through utilization of a random number generator (RNG), such as a true random number generator, a pseudo random number generator or other suitable randomization process. In one embodiment, each award or other game outcome is associated with a probability and the gaming device generates the award or other game outcome to be provided to the player based on the associated probabilities. In this embodiment, since the gaming device generates outcomes randomly or based upon one or more probability calculations, there is no certainty that the gaming device will ever provide the player with any specific award or other game outcome.

In another embodiment, as discussed in more detail below, the gaming device employs a predetermined or finite set or pool of awards or other game outcomes. In this embodiment, as each award or other game outcome is provided to the player, the gaming device flags or removes the provided award or other game outcome from the predetermined set or pool. Once flagged or removed from the set or pool, the specific provided award or other game outcome from that specific pool cannot be provided to the player again. This type of gaming device provides players with all of the available awards or other game outcomes over the course of the play cycle and guarantees the amount of actual wins and losses.

In another embodiment, as discussed below, upon a player initiating play at the gaming device, the gaming device enrolls in a bingo game. In this embodiment, a bingo server calls the bingo balls that result in a specific bingo game outcome. The resultant game outcome is communicated to the individual gaming device to be provided to a player. In one embodiment, this bingo outcome is displayed to the player as a bingo game and/or in any form in accordance with the present disclosure.

In one embodiment, as illustrated in FIG. 32, the gaming device includes one or more display devices controlled by the processor. The display devices are preferably connected to or mounted to the cabinet of the gaming device. The embodiment shown in FIG. 30 includes a central display device 316 which displays a primary game. This display device may also display any suitable secondary game associated with the primary game as well as information relating to the primary or secondary game. The alternative embodiment shown in FIG. 31 includes a central display device 316 and an upper display device 318. The upper display device may display the primary game, any suitable secondary game associated or not associated with the primary game and/or information relating to the primary or secondary game. These display devices may also serve as digital glass operable to advertise games or other aspects of the gaming establishment. As seen in FIGS. 16 and 17, in one embodiment, the gaming device includes a credit display 320 which displays a player's current number of credits, cash, account balance or the equivalent. In one embodiment, gaming device includes a bet display 322 which displays a player's amount wagered.

In another embodiment, at least one display device may be a mobile display device, such as a PDA or tablet PC, that enables play of at least a portion of the primary or secondary game at a location remote from the gaming device.

The display devices may include, without limitation, a monitor, a television display, a plasma display, a liquid crystal display (LCD) a display based on light emitting diodes (LED), a display based on a plurality of organic light-emitting diodes (OLEDs), a display based on polymer light-emitting diodes (PLEDs), a display based on a plurality of surface-conduction electron-emitters (SEDs), a display including a projected and/or reflected image or any other suitable electronic device or display mechanism. In one embodiment, as described in more detail below, the display device includes a touch-screen with an associated touch-screen controller. The display devices may be of any suitable size and configuration, such as a square, a rectangle or an elongated rectangle.

The display devices of the gaming device are configured to display at least one and preferably a plurality of game or other suitable images, symbols and indicia such as any visual representation or exhibition of the movement of objects such as mechanical, virtual or video reels and wheels, dynamic lighting, video images, images of people, characters, places, things and faces of cards, and the like.

In another embodiment, the symbols, images and indicia displayed on or of the display device may be in mechanical form as described in further detail above. That is, the display device may include any electromechanical device, such as one or more mechanical objects, such as one or more rotatable wheels, rotors, reels or dice, configured to display at least one or a plurality of game or other suitable images, symbols or indicia.

As illustrated in FIG. 32, in one embodiment, the gaming device includes at least one payment acceptor 324 in communication with the processor. As seen in FIGS. 30 and 31, the payment acceptor may include a coin slot 326 and a payment, note or bill acceptor 328, where the player inserts money, coins or tokens. The player can place coins in the coin slot or paper money, a ticket or voucher into the payment, note or bill acceptor. In other embodiments, devices such as readers or validators for credit cards, debit cards or credit slips may accept payment. In one embodiment, a player may insert an identification card into a card reader of the gaming device. In one embodiment, the identification card is a smart card having a programmed microchip or a magnetic strip coded with a player's identification, credit totals (or related data) and other relevant information. In another embodiment, a player may carry a portable device, such as a cell phone, a radio frequency identification tag or any other suitable wireless device, which communicates a player's identification, credit totals (or related data) and other relevant information to the gaming device. In one embodiment, money may be transferred to a gaming device through electronic funds transfer. When a player funds the gaming device, the processor determines the amount of funds entered and displays the corresponding amount on the credit or other suitable display as described above.

As seen in FIGS. 30, 31 and 32, in one embodiment the gaming device includes at least one and preferably a plurality of input devices 330 in communication with the processor. The input devices can include any suitable device which enables the player to produce an input signal which is received by the processor. In one embodiment, after appropriate funding of the gaming device, the input device is a game activation device, such as a pull arm 332 or a play button 334 which is used by the player to start any primary game or sequence of events in the gaming device. The play button can be any suitable play activator such as a bet one button, a max bet button or a repeat the bet button. In one embodiment, upon appropriate funding, the gaming device begins the game play automatically. In another embodiment, upon the player engaging one of the play buttons, the gaming device automatically activates game play.

In one embodiment, as shown in FIGS. 30 and 31, one input device is a bet one button 336. The player places a bet by pushing the bet one button. The player can increase the bet by one credit each time the player pushes the bet one button. When the player pushes the bet one button, the number of credits shown in the credit display preferably decreases by one, and the number of credits shown in the bet display preferably increases by one. In another embodiment, one input device is a bet max button (not shown) which enables the player to bet the maximum wager permitted for a game of the gaming device.

In one embodiment, one input device is a cash out button 338. The player may push the cash out button and cash out to receive a cash payment or other suitable form of payment corresponding to the number of remaining credits. In one embodiment, when the player cashes out, the player receives the coins or tokens in a coin payout tray 340. In one embodiment, when the player cashes out, the player may receive other payout mechanisms such as tickets or credit slips redeemable by a cashier (or other suitable redemption system) or funding to the player's electronically recordable identification card.

In one embodiment, as mentioned above and seen in FIG. 32, one input device is a touch-screen 342 coupled with a touch-screen controller 344, or some other touch-sensitive display overlay to allow for player interaction with the images on the display. The touch-screen and the touch-screen controller are connected to a video controller 346. A player can make decisions and input signals into the gaming device by touching the touch-screen at the appropriate places. One such input device is a conventional touch-screen button panel.

The gaming device may further include a plurality of communication ports for enabling communication of the processor with external peripherals, such as external video sources, expansion buses, game or other displays, an SCSI port or a key pad.

In one embodiment, as seen in FIG. 32, the gaming device includes a sound generating device controlled by one or more sounds cards 348 which function in conjunction with the processor. In one embodiment, the sound generating device includes at least one and preferably a plurality of speakers 350 or other sound generating hardware and/or software for generating sounds, such as playing music for the primary and/or secondary game or for other plays of the gaming device, such as an attract play. In one embodiment, the gaming device provides dynamic sounds coupled with attractive multimedia images displayed on one or more of the display devices to provide an audio-visual representation or to otherwise display full-motion video with sound to attract players to the gaming device. During idle periods, the gaming device may display a sequence of audio and/or visual attraction messages to attract potential players to the gaming device. The videos may also be customized for or to provide any appropriate information.

In one embodiment, the gaming machine may include a sensor, such as a camera in communication with the processor (and possibly controlled by the processor) that is selectively positioned to acquire an image of a player actively using the gaming device and/or the surrounding area of the gaming device. In one embodiment, the camera may be configured to selectively acquire still or moving (e.g., video) images and may be configured to acquire the images in either an analog, digital or other suitable format. The display devices may be configured to display the image acquired by the camera as well as display the visible manifestation of the game in split screen or picture-in-picture fashion. For example, the camera may acquire an image of the player and the processor may incorporate that image into the primary and/or secondary game as a game image, symbol or indicia.

In addition to incorporating the rotor-based game elements for the rotor-related game 12, gaming device 310 can incorporate any ancillary wagering game. The ancillary wagering game can be incorporated into the game 12 or playable independent of game 12. The gaming machine or device may include some or all of the features of conventional gaming machines or devices. The ancillary game may comprise any suitable reel-type game, card game, cascading or falling symbol game, number game or other game of chance susceptible to representation in an electronic or electromechanical form, which in one embodiment produces a random outcome based on probability data at the time of or after placement of a wager. That is, different wagering games, such as video poker games, video blackjack games, video keno, video bingo or any other suitable game may be implemented.

In one embodiment, as illustrated in FIG. 31, an ancillary wagering game may be a slot game with one or more paylines 352. The paylines may be horizontal, vertical, circular, diagonal, angled or any combination thereof. In this embodiment, the gaming device includes at least one and preferably a plurality of reels 354, such as three to five reels 354, in either electromechanical form with mechanical rotating reels or video form with simulated reels and movement thereof. In one embodiment, an electromechanical slot machine includes a plurality of adjacent, rotatable reels which may be combined and operably coupled with an electronic display of any suitable type. In another embodiment, if the reels 354 are in video form, one or more of the display devices, as described above, display the plurality of simulated video reels 354. Each reel 354 displays a plurality of indicia or symbols, such as bells, hearts, fruits, numbers, letters, bars or other images which preferably correspond to a theme associated with the gaming device. In another embodiment, one or more of the reels are independent reels or unisymbol reels. In this embodiment, each independent or unisymbol reel generates and displays one symbol to the player. In one embodiment, the gaming device awards prizes after the reels of the ancillary wagering game stop spinning if specified types and/or configurations of indicia or symbols occur on an active payline or otherwise occur in a winning pattern, occur on the requisite number of adjacent reels and/or occur in a scatter pay arrangement.

In an alternative embodiment, rather than determining any outcome to provide to the player by analyzing the symbols generated on any wagered upon paylines as described above, the gaming device determines any outcome to provide to the player based on the number of associated symbols which are generated in active symbol positions on the requisite number of adjacent reels (i.e., not on paylines passing through any displayed winning symbol combinations). In this embodiment, if a winning symbol combination is generated on the reels, the gaming device provides the player one award for that occurrence of the generated winning symbol combination. For example, if one winning symbol combination is generated on the reels, the gaming device will provide a single award to the player for that winning symbol combination (i.e., not based on the number of paylines that would have passed through that winning symbol combination). It should be appreciated that because a gaming device with wagering on ways to win provides the player one award for a single occurrence of a winning symbol combination and a gaming device with paylines may provide the player more than one award for the same occurrence of a single winning symbol combination (i.e., if a plurality of paylines each pass through the same winning symbol combination), it is possible to provide a player with more ways to win for an equivalent bet or wager on a traditional slot gaming device with paylines.

In one embodiment, the total number of ways to win is determined by multiplying the number of symbols generated in active symbol positions on a first reel by the number of symbols generated in active symbol positions on a second reel by the number of symbols generated in active symbol positions on a third reel and so on for each reel of the gaming device with at least one symbol generated in an active symbol position. For example, a three reel gaming device with three symbols generated in active symbol positions on each reel includes 27 ways to win (i.e., 3 symbols on the first reel×3 symbols on the second reel×3 symbols on the third reel). A four reel gaming device with three symbols generated in active symbol positions on each reel includes 81 ways to win (i.e., 3 symbols on the first reel×3 symbols on the second reel×3 symbols on the third reel×3 symbols on the fourth reel). A five reel gaming device with three symbols generated in active symbol positions on each reel includes 243 ways to win (i.e., 3 symbols on the first reel×3 symbols on the second reel×3 symbols on the third reel×3 symbols on the fourth reel×3 symbols on the fifth reel). It should be appreciated that modifying the number of generated symbols by either modifying the number of reels or modifying the number of symbols generated in active symbol positions by one or more of the reels, modifies the number of ways to win.

In another embodiment, the gaming device enables a player to wager on and thus activate symbol positions. In one such embodiment, the symbol positions are on the reels. In this embodiment, if based on the player's wager, a reel is activated, then each of the symbol positions of that reel will be activated and each of the active symbol positions will be part of one or more of the ways to win. In one embodiment, if based on the player's wager, a reel is not activated, then a designated number of default symbol positions, such as a single symbol position of the middle row of the reel, will be activated and the default symbol position(s) will be part of one or more of the ways to win. This type of gaming machine enables a player to wager on one, more or each of the reels and the processor of the gaming device uses the number of wagered on reels to determine the active symbol positions and the number of possible ways to win. In alternative embodiments, (1) no symbols are displayed as generated at any of the inactive symbol positions, or (2) any symbols generated at any inactive symbol positions may be displayed to the player but suitably shaded or otherwise designated as inactive.

In one embodiment wherein a player wagers on one or more reels, a player's wager of one credit may activate each of the three symbol positions on a first reel, wherein one default symbol position is activated on each of the remaining four reels. In this example, as described above, the gaming device provides the player three ways to win (i.e., 3 symbols on the first reel×1 symbol on the second reel×1 symbol on the third reel×1 symbol on the fourth reel×1 symbol on the fifth reel). In another example, a player's wager of nine credits may activate each of the three symbol positions on a first reel, each of the three symbol positions on a second reel and each of the three symbol positions on a third reel wherein one default symbol position is activated on each of the remaining two reels. In this example, as described above, the gaming device provides the player twenty-seven ways to win (i.e., 3 symbols on the first reel×3 symbols on the second reel×3 symbols on the third reel×1 symbol on the fourth reel×1 symbol on the fifth reel).

In one embodiment, to determine any award(s) to provide to the player based on the generated symbols, the gaming device individually determines if a symbol generated in an active symbol position on a first reel forms part of a winning symbol combination with or is otherwise suitably related to a symbol generated in an active symbol position on a second reel. In this embodiment, the gaming device classifies each pair of symbols which form part of a winning symbol combination (i.e., each pair of related symbols) as a string of related symbols. For example, if active symbol positions include a first cherry symbol generated in the top row of a first reel and a second cherry symbol generated in the bottom row of a second reel, the gaming device classifies the two cherry symbols as a string of related symbols because the two cherry symbols form part of a winning symbol combination.

After determining if any strings of related symbols are formed between the symbols on the first reel and the symbols on the second reel, the gaming device determines if any of the symbols from the next adjacent reel should be added to any of the formed strings of related symbols. In this embodiment, for a first of the classified strings of related symbols, the gaming device determines if any of the symbols generated by the next adjacent reel form part of a winning symbol combination or are otherwise related to the symbols of the first string of related symbols. If the gaming device determines that a symbol generated on the next adjacent reel is related to the symbols of the first string of related symbols, that symbol is subsequently added to the first string of related symbols. For example, if the first string of related symbols is the string of related cherry symbols and a related cherry symbol is generated in the middle row of the third reel, the gaming device adds the related cherry symbol generated on the third reel to the previously classified string of cherry symbols.

On the other hand, if the gaming device determines that no symbols generated on the next adjacent reel are related to the symbols of the first string of related symbols, the gaming device marks or flags such string of related symbols as complete. For example, if the first string of related symbols is the string of related cherry symbols and none of the symbols of the third reel are related to the cherry symbols of the previously classified string of cherry symbols, the gaming device marks or flags the string of cherry symbols as complete.

After either adding a related symbol to the first string of related symbols or marking the first string of related symbols as complete, the gaming device proceeds as described above for each of the remaining classified strings of related symbols which were previously classified or formed from related symbols on the first and second reels.

After analyzing each of the remaining strings of related symbols, the gaming device determines, for each remaining pending or incomplete string of related symbols, if any of the symbols from the next adjacent reel, if any, should be added to any of the previously classified strings of related symbols. This process continues until either each string of related symbols is complete or there are no more adjacent reels of symbols to analyze. In this embodiment, where there are no more adjacent reels of symbols to analyze, the gaming device marks each of the remaining pending strings of related symbols as complete.

When each of the strings of related symbols is marked complete, the gaming device compares each of the strings of related symbols to an appropriate paytable and provides the player any award associated with each of the completed strings of symbols. It should be appreciated that the player is provided one award, if any, for each string of related symbols generated in active symbol positions (i.e., as opposed to being based on how many paylines that would have passed through each of the strings of related symbols in active symbol positions).

In one embodiment, the ancillary wagering game may be a poker game wherein the gaming device enables the player to play a conventional game of video draw poker and initially deals five cards all face up from a virtual deck of fifty-two card deck. Cards may be dealt as in a traditional game of cards or in the case of the gaming device, may also include that the cards are randomly selected from a predetermined number of cards. If the player wishes to draw, the player selects the cards to hold via one or more input device, such as pressing related hold buttons or via the touch screen. The player then presses the deal button and the unwanted or discarded cards are removed from the display and the gaming machine deals the replacement cards from the remaining cards in the deck. This results in a final five-card hand. The gaming device compares the final five-card hand to a payout table which utilizes conventional poker hand rankings to determine the winning hands. The gaming device provides the player with an award based on a winning hand and the credits the player wagered.

In another embodiment, the ancillary wagering game may be a multi-hand version of video poker. In this embodiment, the gaming device deals the player at least two hands of cards. In one such embodiment, the cards are the same cards. In one embodiment each hand of cards is associated with its own deck of cards. The player chooses the cards to hold in a primary hand. The held cards in the primary hand are also held in the other hands of cards. The remaining non-held cards are removed from each hand displayed and for each hand replacement cards are randomly dealt into that hand. Since the replacement cards are randomly dealt independently for each hand, the replacement cards for each hand will usually be different. The poker hand rankings are then determined hand by hand and awards are provided to the player.

In one embodiment, the ancillary wagering game may be a keno game wherein the gaming device displays a plurality of selectable indicia or numbers on at least one of the display devices. In this embodiment, the player selects at least one or a plurality of the selectable indicia or numbers via an input device such as the touch screen. The gaming device then displays a series of drawn numbers to determine an amount of matches, if any, between the player's selected numbers and the gaming device's drawn numbers. The player is provided an award based on the amount of matches, if any, based on the amount of determined matches and the number of numbers drawn.

In one embodiment, the game 12 may include a trigger which gives players the opportunity to win credits in an ancillary bonus or secondary game or ancillary bonus or secondary round. The ancillary bonus or secondary game enables the player to obtain a prize or payout in addition to the prize or payout, if any, obtained from the base or primary game 12. In general, the ancillary bonus or secondary game produces a significantly higher level of player excitement than the base or primary game because it provides a greater expectation of winning than the base or primary game and is accompanied with more attractive or unusual features than the base or primary game. In one embodiment, the ancillary bonus or secondary game may be any type of suitable game, either similar to or completely different from the base or primary game.

In one embodiment, the triggering event or qualifying condition may be a selected outcome in the primary game or a particular arrangement of one or more indicia on a display device in the primary game. In other embodiments, the triggering event or qualifying condition may be by exceeding a certain amount of game play (such as number of games, number of credits, amount of time), or reaching a specified number of points earned during game play.

In another embodiment, the gaming device processor or central server randomly provides the player one or more plays of one or more ancillary secondary games. In one such embodiment, the gaming device does not provide any apparent reasons to the player for qualifying to play a secondary or bonus game. In this embodiment, qualifying for a bonus game is not triggered by an event in or based specifically on any of the plays of any primary game. That is, the gaming device may simply qualify a player to play an ancillary secondary game without any explanation or alternatively with simple explanations. In another embodiment, the gaming device (or central server) qualifies a player for an ancillary secondary game at least partially based on a game triggered or symbol triggered event, such as at least partially based on the play of a primary game.

In one embodiment, the gaming device includes a program which will automatically begin a bonus round after the player has achieved a triggering event or qualifying condition in the base or primary game. In another embodiment, after a player has qualified for a bonus game, the player may subsequently enhance his/her bonus game participation through continued play on the base or primary game. Thus, for each bonus qualifying event, such as a bonus symbol, that the player obtains, a given number of bonus game wagering points or credits may be accumulated in a "bonus meter" programmed to accrue the bonus wagering credits or entries toward eventual participation in a bonus game. The occurrence of multiple such bonus qualifying events in the primary game may result in an arithmetic or exponential increase in the number of bonus wagering credits awarded. In one embodiment, the player may redeem extra bonus wagering credits during the ancillary bonus game to extend play of the ancillary bonus game.

In one embodiment, no separate entry fee or buy in for an ancillary bonus game need be employed. That is, a player may not purchase an entry into an ancillary bonus game, rather they must win or earn entry through play of the primary game thus, encouraging play of the primary game. In another embodiment, qualification of the ancillary bonus or secondary game is accomplished through a simple "buy in" by the player, for example, if the player has been unsuccessful at qualifying through other specified activities. In another embodiment, the player must make a separate side-wager on the ancillary bonus game or wager a designated amount in the primary game to qualify for the ancillary secondary game. In this embodiment, the ancillary secondary game triggering event must occur and the side-wager (or designated primary game wager amount) must have been placed to trigger the ancillary secondary game.

Figure 33:
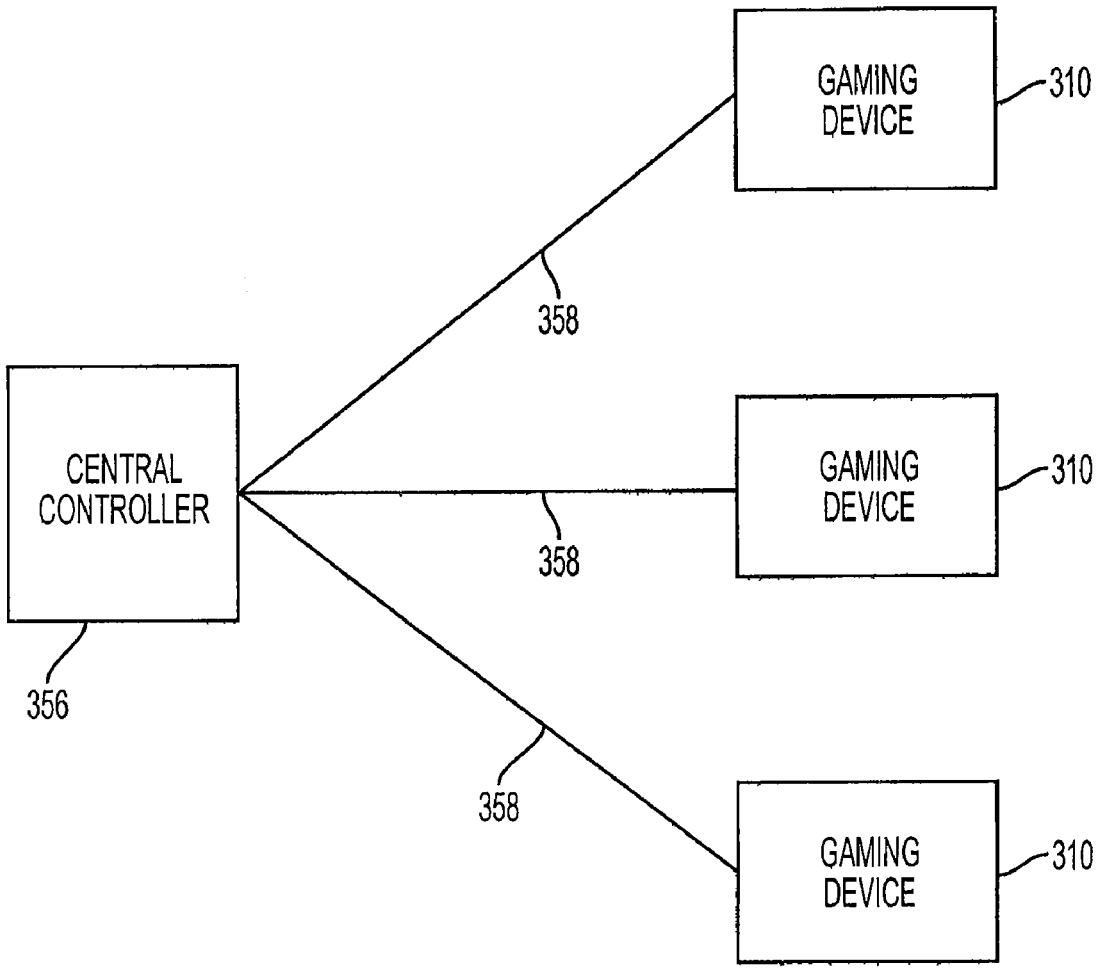
FIG. 33 is a schematic view of a central controller coupled to a plurality of embodiments of the game system.

In one embodiment, as illustrated in FIG. 33, one or more of the gaming devices 310 are in communication with each other and/or at least one central server, central controller or remote host 356 through a data network or remote communication link 358. In this embodiment, the central server, central controller or remote host is any suitable server or computing device which includes at least one processor and at least one memory or storage device. In different such embodiments, the central server is a progressive controller or a processor of one of the gaming devices in the game system. In these embodiments, the processor of each gaming device is designed to transmit and receive events, messages, commands or any other suitable data or signal between the individual gaming device and the central server. The gaming device processor is operable to execute such communicated events, messages or commands in conjunction with the operation of the gaming device. Moreover, the processor of the central server is designed to transmit and receive events, messages, commands or any other suitable data or signal between the central server and each of the individual gaming devices. The central server processor is operable to execute such communicated events, messages or commands in conjunction with the operation of the central server. It should be appreciated that one, more or each of the functions of the central controller as disclosed herein may be performed by one or more gaming device processors. It should be further appreciated that one, more or each of the functions of one or more gaming device processors as disclosed herein may be performed by the central controller.

In one embodiment, the game outcome for the Roulette-wheel related elements of any of the ancillary games described above is determined by a central server or controller and provided to the player at the gaming device. In this embodiment, each of a plurality of such gaming devices are in communication with the central server or controller. Upon a player initiating game play at one of the gaming devices, the initiated gaming device communicates a game outcome request to the central server or controller.

In one embodiment, the central server or controller receives the game outcome request and randomly generates an ancillary game outcome for the ancillary primary game based on probability data. In another embodiment, the central server or controller randomly generates a game outcome for the secondary game based on probability data. In another embodiment, the central server or controller randomly generates an ancillary game outcome for the primary game, the ancillary secondary game and any ancillary games based on probability data. In this embodiment, the central server or controller is capable of storing and utilizing program code or other data similar to the processor and memory device of the gaming device.

In an alternative embodiment, the central server or controller maintains one or more predetermined pools or sets of predetermined game outcomes. In this embodiment, the central server or controller receives the game outcome request and independently selects a predetermined ancillary game outcome from a set or pool of game outcomes. The central server or controller flags or marks the selected game outcome as used. Once a game outcome is flagged as used, it is prevented from further selection from the set or pool and cannot be selected by the central controller or server upon another wager. The provided game outcome can include a primary game outcome, a secondary game outcome, an ancillary secondary game outcome, primary, secondary and ancillary game outcomes, or a series of game outcomes such as free games.

The central server or controller communicates the generated or selected game outcome to the initiated gaming device. The gaming device receives the generated or selected game outcome and provides the game outcome to the player. In an alternative embodiment, how the generated or selected game outcome is to be presented or displayed to the player, such as a ball landing on a designated space in a Roulette-wheel, a reel symbol combination of a slot machine or a hand of cards dealt in a card game, is also determined by the central server or controller and communicated to the initiated gaming device to be presented or displayed to the player. Central production or control can assist a gaming establishment or other entity in maintaining appropriate records, controlling gaming, reducing and preventing cheating or electronic or other errors, reducing or eliminating win-loss volatility and the like.

In another embodiment, a predetermined ancillary game outcome value is determined for each of a plurality of linked or networked gaming devices based on the results of a bingo, keno or lottery game. In this embodiment, each individual gaming device utilizes one or more bingo, keno or lottery games to determine the predetermined ancillary game outcome value provided to the player for the interactive game played at that gaming device. In one embodiment, the bingo, keno or lottery game is displayed to the player. In another embodiment, the bingo, keno or lottery game is not displayed to the player, but the results of the bingo, keno or lottery game determine the predetermined game outcome value for the primary, secondary game or ancillary secondary game.

In the various bingo embodiments, as each gaming device is enrolled in the bingo game, such as upon an appropriate wager or engaging an input device, the enrolled gaming device is provided or associated with a different bingo card. Each bingo card consists of a matrix or array of elements, wherein each element is designated with a separate indicia, such as a number. It should be appreciated that each different bingo card includes a different combination of elements. For example, if four bingo cards are provided to four enrolled gaming devices, the same element may be present on all four of the bingo cards while another element may solely be present on one of the bingo cards.

In operation of these embodiments, upon providing or associating a different bingo card to each of a plurality of enrolled gaming devices, the central controller randomly selects or draws, one at a time, a plurality of the elements. As each element is selected, a determination is made for each gaming device as to whether the selected element is present on the bingo card provided to that enrolled gaming device. This determination can be made by the central controller, the gaming device, a combination of the two, or in any other suitable manner. If the selected element is present on the bingo card provided to that enrolled gaming device, that selected element on the provided bingo card is marked or flagged. This process of selecting elements and marking any selected elements on the provided bingo cards continues until one or more predetermined patterns are marked on one or more of the provided bingo cards. It should be appreciated that in one embodiment, the gaming device requires the player to engage a daub button (not shown) to initiate the process of the gaming device marking or flagging any selected elements.

After one or more predetermined patterns are marked on one or more of the provided bingo cards, an ancillary game outcome is determined for each of the enrolled gaming devices based, at least in part, on the selected elements on the provided bingo cards. As described above, the ancillary game outcome determined for each gaming device enrolled in the bingo game is utilized by that gaming device to determine the predetermined game outcome provided to the player. For example, a first gaming device to have selected elements marked in a predetermined pattern is provided a first outcome of win $10 which will be provided to a first player regardless of how the first player plays in a first ancillary game and a second gaming device to have selected elements marked in a different predetermined pattern is provided a second outcome of win $2 which will be provided to a second player regardless of how the second player plays a second ancillary game. It should be appreciated that as the process of marking selected elements continues until one or more predetermined patterns are marked, this embodiment ensures that at least one bingo card will win the bingo game and thus at least one enrolled gaming device will provide a predetermined winning game outcome to a player. It should be appreciated that other suitable methods for selecting or determining one or more predetermined game outcomes may be employed.

In one example of the above-described embodiment, the predetermined ancillary game outcome may be based on an ancillary award in addition to any award provided for winning the bingo game as described above.

In this embodiment, if one or more elements are marked in ancillary patterns within a designated number of drawn elements, an ancillary or intermittent award or value associated with the marked ancillary pattern is provided to the player as part of the predetermined ancillary game outcome. For example, if the four corners of a bingo card are marked within the first twenty selected elements, an ancillary award of $10 is provided to the player as part of the predetermined ancillary game outcome. It should be appreciated that in this embodiment, the player of a gaming device may be provided an ancillary or intermittent award regardless of if the enrolled gaming device's provided bingo card wins or does not win the bingo game as described above.

In another embodiment, one or more of the gaming devices are in communication with a central server or controller for monitoring purposes only. That is, each individual gaming device randomly generates the ancillary game outcomes to be provided to the player and the central server or controller monitors the activities and events occurring on the plurality of gaming devices. In one embodiment, the gaming network includes a real-time or on-line accounting and gaming information system operably coupled to the central server or controller. The accounting and gaming information system of this embodiment includes a player database for storing player profiles, a player tracking module for tracking players and a credit system for providing automated casino transactions.

In one embodiment, the gaming device disclosed herein is associated with or otherwise integrated with one or more player tracking systems. In this embodiment, the gaming device and/or player tracking system tracks any players gaming activity at the gaming device. In one such embodiment, the gaming device and/or associated player tracking system timely tracks when a player inserts their playing tracking card to begin a gaming session and also timely tracks when a player removes their player tracking card when concluding play for that gaming session. In another embodiment, rather than requiring a player to insert a player tracking card, the gaming device utilizes one or more portable devices carried by a player, such as a cell phone, a radio frequency identification tag or any other suitable wireless device to track when a player begins and ends a gaming session. In another embodiment, the gaming device utilizes any suitable biometric technology or ticket technology to track when a player begins and ends a gaming session.

During one or more gaming sessions, the gaming device and/or player tracking system tracks any suitable information, such as any amounts wagered, average wager amounts and/or the time these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data.

In one embodiment, a plurality of the gaming devices are capable of being connected together through a data network. In one embodiment, the data network is a local area network (LAN), in which one or more of the gaming devices are substantially proximate to each other and an on-site central server or controller as in, for example, a gaming establishment or a portion of a gaming establishment. In another embodiment, the data network is a wide area network (WAN), such as a portion of the worldwide web, in which one or more of the gaming devices are in communication with at least one off-site central server or controller. In this embodiment, the plurality of gaming devices may be located in a different part of the gaming establishment or within a different gaming establishment than the off-site central server or controller. Thus, the WAN may include an off-site central server or controller and an off-site gaming device located within gaming establishments in the same geographic area, such as a city or state. The WAN game system may be substantially identical to the LAN game system described above, although the number of gaming devices in each system may vary relative to each other.

In another embodiment, the data network is an internet or intranet. In this embodiment, the operation of the gaming device can be viewed at the gaming device with at least one internet browser. In this embodiment, operation of the gaming device and accumulation of credits may be accomplished with only a connection to the central server or controller (the internet/intranet server) through a conventional phone or other data transmission line, digital subscriber line (DSL), T-1 line, coaxial cable, fiber optic cable, or other suitable connection. In this embodiment, players may access an internet game page from any location where an internet connection and computer, or other internet facilitator is available. The expansion in the number of computers and number and speed of internet connections in recent years increases opportunities for players to play from an ever-increasing number of remote sites. It should be appreciated that enhanced bandwidth of digital wireless communications may render such technology suitable for some or all communications, particularly if such communications are encrypted. Higher data transmission speeds may be useful for enhancing the sophistication and response of the display and interaction with the player.

As mentioned above, in one embodiment, the present disclosure may be employed in a server based game system. In one such embodiment, as described above, one or more gaming devices are in communication with a central server or controller. The central server or controller may be any suitable server or computing device which includes at least one processor and a memory or storage device. In alternative embodiments, the central server is a progressive controller or another gaming machine in the game system. In one embodiment, the memory device of the central server stores different game programs and instructions, executable by a gaming device processor, to control the gaming device. Each executable game program represents a different game or type of game which may be played on one or more of the gaming devices in the game system. Such different games may include the same or substantially the same game play with different pay tables. In different embodiments, the executable game program is for a primary game, a secondary game, an ancillary game or a combination of such games. In another embodiment, the game program may be executable as an ancillary game to be played simultaneous with the play of a primary game (which may be downloaded to or fixed on the gaming device) or vice versa.

In this embodiment, each gaming device at least includes one or more display devices and/or one or more input devices for interaction with a player. A local processor, such as the above-described gaming device processor or a processor of a local server, is operable with the display device(s) and/or the input device(s) of one or more of the gaming devices.

In operation, the central controller is operable to communicate one or more of the stored game programs to at least one local processor. In different embodiments, the stored game programs are communicated or delivered by embedding the communicated game program in a device or a component (e.g., a microchip to be inserted in a gaming device), writing the game program on a disc or other media, downloading or streaming the game program over a dedicated data network, internet or a telephone line. After the stored game programs are communicated from the central server, the local processor executes the communicated program to facilitate play of the communicated program by a player through the display device(s) and/or input device(s) of the gaming device. That is, when a game program is communicated to a local processor, the local processor changes the game or type of game played at the gaming device.

In another embodiment, a plurality of gaming devices at one or more gaming sites may be networked to the central server in a progressive configuration, as known in the art, wherein a portion of each wager to initiate a base or primary game may be allocated to one or more progressive awards. In one embodiment, a progressive game system host site computer is coupled to a plurality of the central servers at a variety of mutually remote gaming sites for providing a multi-site linked progressive automated game system. In one embodiment, a progressive game system host site computer may serve gaming devices distributed throughout a number of properties at different geographical locations including, for example, different locations within a city or different cities within a state.

In one embodiment, the progressive game system host site computer is maintained for the overall operation and control of the progressive game system. In this embodiment, a progressive game system host site computer oversees the entire progressive game system and is the master for computing all progressive jackpots. All participating gaming sites report to, and receive information from, the progressive game system host site computer. Each central server computer is responsible for all data communication between the gaming device hardware and software and the progressive game system host site computer. In one embodiment, an individual gaming machine may trigger a progressive award win. In another embodiment, a central server (or the progressive game system host site computer) determines when a progressive award win is triggered. In another embodiment, an individual gaming machine and a central controller (or progressive game system host site computer) work in conjunction with each other to determine when a progressive win is triggered, for example through an individual gaming machine meeting a predetermined requirement established by the central controller.

In one embodiment, a progressive award win is triggered based on one or more game play events, such as a symbol-driven trigger. In other embodiments, the progressive award triggering event or qualifying condition may be by exceeding a certain amount of game play (such as number of ancillary games, number of credits, or amount of time), or reaching a specified number of points earned during game play. In another embodiment, a gaming device is randomly or apparently randomly selected to provide a player of that gaming device one or more progressive awards. In one such embodiment, the gaming device does not provide any apparent reasons to the player for winning a progressive award, wherein winning the progressive award is not triggered by an event in or based specifically on any of the plays of any primary game. That is, a player is provided a progressive award without any explanation or alternatively with simple explanations. In another embodiment, a player is provided a progressive award at least partially based on a game triggered or symbol triggered event, such as at least partially based on the play of a primary game.

In one embodiment, one or more of the progressive awards are each funded via a side bet or side wager. In this embodiment, a player must place or wager a side bet to be eligible to win the progressive award associated with the side bet. In one embodiment, the player must place the maximum bet and the side bet to be eligible to win one of the progressive awards. In another embodiment, if the player places or wagers the required side bet, the player may wager at any credit amount during the primary game (i.e., the player need not place the maximum bet and the side bet to be eligible to win one of the progressive awards). In one such embodiment, the greater the player's wager (in addition to the placed side bet), the greater the odds or probability that the player will win one of the progressive awards. It should be appreciated that one or more of the progressive awards may each be funded, at least in part, based on the wagers placed on the primary games of the gaming machines in the game system, via a gaming establishment or via any suitable manner.

In another embodiment, one or more of the progressive awards are partially funded via a side-bet or side-wager which the player may make (and which may be tracked via a side-bet meter). In one embodiment, one or more of the progressive awards are funded with only side-bets or side-wagers placed. In another embodiment, one or more of the progressive awards are funded based on player's wagers as described above as well as any side-bets or side-wagers placed.

In one alternative embodiment, a minimum wager level is required for a gaming device to qualify to be selected to obtain one of the progressive awards. In one embodiment, this minimum wager level is the maximum wager level for the primary game in the gaming machine. In another embodiment, no minimum wager level is required for a gaming machine to qualify to be selected to obtain one of the progressive awards.

In another embodiment, a plurality of players at a plurality of linked gaming devices in a game system participate in a group gaming environment. In one embodiment, a plurality of players at a plurality of linked gaming devices work in conjunction with one another, such as playing together as a team or group, to win one or more awards. In one such embodiment, any award won by the group is shared, either equally or based on any suitable criteria, amongst the different players of the group. In another embodiment, a plurality of players at a plurality of linked gaming devices compete against one another for one or more awards. In one such embodiment, a plurality of players at a plurality of linked gaming devices participate in a gaming tournament for one or more awards. In another embodiment, a plurality of players at a plurality of linked gaming devices play for one or more awards wherein an outcome generated by one gaming device affects the outcomes generated by one or more linked gaming devices.

In one embodiment, the game system 10 and/or the gaming device 310 includes any one of the embodiments described above. In another embodiment, the game system 10 and/or the gaming device 310 includes any suitable combination of such embodiments. In a further embodiment, the game system 10 and/or the gaming device 310 includes any suitable combination of one or more portions of such embodiments.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A method for operating a gaming device, the method comprising:

(a) causing at least one processor to execute a plurality of instructions stored in at least one memory device to operate with at least one input device to receive a first wager at a wagering station;

(b) causing the at least one processor to execute the plurality of instructions to cause a first spin of a rotor for a first play of a game, the rotor having a first quantity of ball landings available for the first play of the game;

(c) causing the at least one processor to execute the plurality of instructions to determine whether a triggering condition has been fulfilled based, at least in part, on the position of a symbol designator, the symbol designator being positioned adjacent to the rotor;

(d) causing the at least one processor to execute the plurality of instructions to cause the symbol designator to indicate information relating to a second quantity of ball landings, the first quantity of ball landings being greater than the second quantity of ball landings, the probability of one of the second quantity of ball landings receiving a ball being greater than the probability of one of the first quantity of ball landings receiving a ball;

(e) using a ball landing availability reducer to reduce the availability of the first quantity of ball landings to the second quantity of ball landings when the triggering condition is fulfilled;

(f) causing the at least one processor to execute the plurality of instructions to operate with the at least one input device to receive a second wager at the wagering station; and (g) causing the at least one processor to execute the plurality of instructions to cause a second spin of the rotor for the second play of the game.

2. The method of claim 1, wherein the triggering condition includes an indication of at least one of the ball landings in the first quantity of ball landings.

3. The method of claim 1, which includes causing the at least one processor to execute the plurality of instructions to cause the symbol designator to randomly indicate at least one of the first quantity of ball landings.

4. The method of claim 1, wherein the ball landing availability reducer includes a computer-controlled ball landing selector.

5. The method of claim 1, which includes operating the gaming device over a data network.

6. The method of claim 5, wherein the data network is an internet.

7. The method of claim 1, wherein the ball landing availability reducer includes a block configured for insertion into a ball landing in the first quantity of ball landings.

8. The method of claim 1, wherein the ball landing availability reducer randomly selects at least one of the ball landings in the first quantity of ball landings.

9. A method for operating a gaming device, the method comprising:

(a) causing at least one processor to execute a plurality of instructions stored in at least one memory device to operate with at least one input device to receive a first wager at a wagering station;

(b) causing the at least one processor to execute the plurality of instructions to cause a first spin of a rotor for a first play of a game, the rotor having a first quantity of ball landings available for the first play of the game;

(c) causing the at least one processor to execute the plurality of instructions to determine whether a triggering condition has been fulfilled based, at least in part, on the position of an indicator, the indicator being positioned adjacent to the rotor;

(d) causing the at least one processor to execute the plurality of instructions to cause the indicator to indicate information relating to a second quantity of ball landings, the first quantity of ball landings being greater than the second quantity of ball landings, the probability of one of the second quantity of ball landings receiving a ball being greater than the probability of one of the first quantity of ball landings receiving a ball;

(e) using a ball landing availability reducer to reduce the availability of the first quantity of ball landings to the second quantity of ball landings when the triggering condition is fulfilled;

(f) causing the at least one processor to execute the plurality of instructions to operate with the at least one input device to receive a second wager at the wagering station; and (g) causing the at least one processor to execute the plurality of instructions to cause a second spin of the rotor for the second play of the game.

10. The method of claim 9, wherein the triggering condition includes randomly determining a number before the second play of the game using the indicator.

11. The method of claim 9, wherein the ball landing availability reducer includes a block configured for insertion into a ball landing in the first quantity of ball landings.

12. The method of claim 9, wherein the ball landing availability reducer includes a computer-controlled ball landing selector.

13. The method of claim 9, wherein the information includes a quantity resulting from a difference between the first quantity of ball landings and the second quantity of ball landings.

14. The method of claim 9, which includes causing the at least one processor to execute the plurality of instructions to cause the ball landing availability reducer to randomly select at least one of the ball landings in the first quantity of ball landings.

15. The method of claim 9, which includes operating the gaming device over a data network.

16. The method of claim 15, wherein the data network is an internet.

17. A gaming device comprising:

an input device;

a display device;

a processor; and a memory device storing a plurality of instructions which, when executed by the processor, cause the processor to operate with the input device and the display device, for a first play of a game and a second play of the game, to:

(a) display a wagering station;

(b) accept one or more wagers;

(c) display a rotor, the rotor including:

(i) a plurality of symbols; and (ii) a first quantity of ball landings positioned adjacent to the symbols, the first quantity of ball landings being available for the first play of the game, the first play of the game involving a first spin of the rotor;

(d) display a symbol designator positioned adjacent to the rotor, the symbol designator configured to indicate information relating to the availability of a second quantity of ball landings, which is less than the first quantity of ball landings, for the second play of the game, the second play of the game involving a second spin of the rotor, the probability of one of the second quantity of ball landings receiving a ball being greater than the probability of one of the first quantity of ball landings receiving the ball;

(e) determine whether a triggering condition has been fulfilled based, at least in part, on the position of the symbol designator; and (f) reduce the availability of the first quantity of ball landings to the second quantity of ball landings with a ball landing availability reducer when the triggering condition is fulfilled.

18. The gaming device of claim 17, wherein the ball landing availability reducer randomly selects one of the ball landings in the first quantity of ball landings.

19. The gaming device of claim 17, wherein the symbol designator randomly indicates at least one of the first quantity of ball landings.

20. The gaming device of claim 17, wherein the triggering condition includes an indication of at least one of the ball landings in the first quantity of ball landings.

21. The gaming device of claim 17, wherein the ball landing availability reducer reduces the availability of the first quantity of ball landings to the second quantity of ball landings for the second play of the game by changing a size of: (i) the ball or (ii) one or more of the ball landings.

22. The gaming device of claim 17, wherein the ball landing availability reducer reduces the availability of the first quantity of ball landings to the second quantity of ball landings for the second play of the game by illuminating one or more of the ball landings.

23. A gaming device comprising:

an input device;

a display device;

a processor; and a memory device storing a plurality of instructions which, when executed by the processor, cause the processor to operate with the input device and the display device, for a first play of a game and a second play of the game, to:

(a) display a wagering station;

(b) accept one or more wagers;

(c) display a rotor, the rotor including:

(i) a plurality of symbols; and (ii) a first quantity of ball landings positioned adjacent to the symbols, the first quantity of ball landings being available for the first play of the game, the first play of the game involving a first spin of the rotor;

(d) display an indicator positioned adjacent to the rotor, the indicator configured to indicate information relating to the availability of a second quantity of ball landings, which is less than the first quantity of ball landings, for the second play of the game, the second play of the game involving a second spin of the rotor, the probability of one of the second quantity of ball landings receiving a ball being greater than the probability of one of the first quantity of ball landings receiving the ball;

(e) determine whether a triggering condition has been fulfilled based, at least in part, on the position of the indicator; and (f) reduce the availability of the first quantity of ball landings to the second quantity of ball landings with a ball landing availability reducer when the triggering condition is fulfilled.

24. The gaming device of claim 23, wherein the ball landing availability reducer randomly selects one of the ball landings in the first quantity of ball landings.

25. The gaming device of claim 23, wherein the information includes a quantity resulting from a difference between the first quantity of ball landings and the second quantity of ball landings.

26. The gaming device of claim 23, wherein the triggering condition includes randomly determining a number before the second play of the game using the indicator.

27. The gaming device of claim 23, wherein the ball landing availability reducer reduces the availability of the first quantity of ball landings to the second quantity of ball landings for the second play of the game by changing a size of: (i) the ball or (ii) one or more of the ball landings.

28. The gaming device of claim 23, wherein the ball landing availability reducer reduces the availability of the first quantity of ball landings to the second quantity of ball landings for the second play of the game by illuminating one or more of the ball landings.

* * * * *

UNITED STATES PATENT AND TRADEMARK OFFICE

CERTIFICATE OF CORRECTION

PATENT NO. : 8,177,234 B2
APPLICATION NO. : 12/731862
DATED : May 15, 2012
INVENTOR(S) : Mark C. Nicely It is certified that error appears in the above-identified patent and that said Letters Patent is hereby corrected as shown below:

IN THE CLAIMS

In Claim 1, Column 44, Line 53, replace “the” with --a--.
In Claim 1, Column 44, Line 60, replace the second instance of “the” with --a--.
In Claim 1, Column 44, Line 62, replace the first instance of “the” with --a--.
In Claim 1, Column 44, Line 63, replace “a” with --the--.
In Claim 1, Column 44, Line 64, replace “the” with --an--.
In Claim 1, Column 45, Line 7, replace the first instance of “the” with --a--.
In Claim 7, Column 45, Line 24, replace “a ball landing” with --one of the ball landings--.
In Claim 9, Column 45, Line 40, replace “the” with --a--.
In Claim 9, Column 45, Line 47, replace “the” with --a--.
In Claim 9, Column 45, Line 49, replace the first instance of “the” with --a--.
In Claim 9, Column 45, Line 50, replace “a” with --the--.
In Claim 9, Column 45, Line 51, replace “the” with --an--.
In Claim 9, Column 45, Line 61, replace the first instance of “the” with --a--.
In Claim 11, Column 45, Line 67, replace “a ball landing” with --one of the ball landings--.
In Claim 17, Column 46, Line 37, replace “the” with --an--.
In Claim 17, Column 46, Line 41, replace the second instance of “the” with --a--.
In Claim 17, Column 46, Line 43, replace the first instance of “the” with --a--.
In Claim 17, Column 46, Line 46, replace the first instance of “the” with --a--.
In Claim 17, Column 46, Line 48, replace the first instance of “the” with --a--.
In Claim 23, Column 47, Line 23, replace “the availability” with --an availability--.
In Claim 23, Column 47, Line 27, replace “the probability” with --a probability--.
In Claim 23, Column 47, Line 28, replace “than the” with --than a--.
In Claim 23, Column 48, Line 2, replace the first instance of “the” with --a--.
In Claim 23, Column 48, Line 4, replace the first instance of “the” with --an--.

Signed and Sealed this
Twentieth Day of November, 2012

David J. Kappos

David J. Kappos
*Director of the United States Patent and Trademark Office*